US007690220B2

(12) United States Patent
Okamura

(10) Patent No.: US 7,690,220 B2
(45) Date of Patent: Apr. 6, 2010

(54) PERSONAL ORNAMENT

(75) Inventor: Kazuo Okamura, Tokyo (JP)

(73) Assignee: Triple A Co., Ltd., Tokyo (JP)

( * ) Notice: Subject to any disclaimer, the term of this patent is extended or adjusted under 35 U.S.C. 154(b) by 464 days.

(21) Appl. No.: 11/787,696

(22) Filed: Apr. 17, 2007

(65) Prior Publication Data

US 2008/0256979 A1 Oct. 23, 2008

(51) Int. Cl.
*A44C 5/00* (2006.01)

(52) U.S. Cl. ..... 63/3; 63/33; 63/3.1; 446/129

(58) Field of Classification Search ..... None
See application file for complete search history.

(56) References Cited

U.S. PATENT DOCUMENTS

| | | | | |
|---|---|---|---|---|
| 4,406,043 | A * | 9/1983 | Friedman | 24/171 |
| 2007/0167106 | A1* | 7/2007 | Hoover | 446/26 |

FOREIGN PATENT DOCUMENTS

| | | |
|---|---|---|
| JP | 08-084612 | 4/1996 |
| JP | 09-047308 | 2/1997 |
| JP | 10-165211 | 6/1998 |
| JP | 2002-119313 | 4/2002 |
| JP | 2003-210215 | 7/2003 |
| JP | 2004-166809 | 6/2004 |

* cited by examiner

*Primary Examiner*—Jack W. Lavinder
(74) *Attorney, Agent, or Firm*—Flynn, Thiel, Boutell & Tanis, P.C.

(57) ABSTRACT

The invention provides a personal ornament capable of reliably retaining the personal ornament with strong magnetic attraction force of metallic magnets. The magnetic attraction force is not less than a predetermined value, and hence it enhances safety against theft, and is excellent in wearing and removing by a wearer. The personal ornament comprises a string-shaped tube made of a flexible material and capable of being twisted and bent, a plurality of columnar metallic magnets inserted into the string-shaped tube, and an outer covering provided on an outer peripheral surface of the string-shaped tube. Alternatively, the personal ornament comprises a personal ornament body formed by inserting a plurality of columnar metallic magnets into a string-shaped tube, and a retainer capable of fixing one end side and the other end side of the personal ornament body in a state where both end sides are aligned in parallel with each other.

5 Claims, 61 Drawing Sheets

PERSONAL ORNAMENT

FIELD OF THE INVENTION

The invention relates to a personal ornament such as a necklace to be used while wound around a body, particularly to a personal ornament having magnets serving as a means for retaining both ends of the personal ornament to be wound around a neck are used for rendering a wearing state strong so that the personal ornament is hardly come off the body.

BACKGROUND OF THE INVENTION

A personal ornament such as a necklace and so forth is generally configured in a string shape, and both ends of the personal ornament are provided with a retainer comprised of a pair of hooks and so forth which are assembled with each other to detachably retain the personal ornament. In the case of wearing such a personal ornament around a neck of a body and so forth, a wearer holds both ends of the personal ornament with both hands and disposes the intermediate portion of the personal ornament at the back of the neck, then turns both ends of the personal ornament to the front of the neck to be wound around the neck, thereafter retains a retainer such hooks and so forth provided at both ends of the personal ornament. As a result, the personal ornament is wound around the neck in a ring shape to be rendered in a closed state.

There are various configurations of retainers of the personal ornament, such as a configuration wherein a pin is provided at one end of a personal ornament which pin comes in or comes out from the one end of the personal ornament, and a loop is provided at the other end of the personal ornament, causing the pin to pass through the loop to retain both ends, or a configuration wherein an openable and closable loop is provided at one end of the personal ornament and the other end of the personal ornament is caused to be inserted into the loop, thereby forming a ring having an arbitrary diameter to be worn by a wearer.

These retainers are normally configured to be small not to influence upon a decorative effect of the personal ornament, for example, configured to be small to an extent to be barely clipped by fingers. In the case of such retainers, there is no obstacle to a young person, a person having good vision, person having excellent feeling in fingers, when wearing the personal ornament or implementing removal operation and so forth, but there is an obstacle to an aged person, a person having inferior vision, a person having inferior feeling in fingers, when wearing the personal ornament or implementing removal operation and so forth.

On the other hand, there has been conventionally employed a configuration to use magnets as a retaining means such as a necklace and so forth so as to implement a wearing operation of the personal ornament with ease. For example, there has been proposed a plastic magnet formed by injection molding or extrusion molding by mixing magnet powder in a string-shaped body or formed of a rubber magnet as disclosed in e.g. JP 2002-119313A and JP 10-165211A.

According to the plastic magnet or rubber magnet as disclosed in JP 2002-119313A and JP 10-165211A, since there is a limit on a magnetic material content, a magnetic attraction force to be obtained is low on the order of 300 gauss.

Accordingly, when such a magnet is applied to a retaining means of the personal ornament, it can not implement a strong retaining operation, and it is easily come off when pulled by a human power. Accordingly, in the case where an aged person and so forth wear such a personal ornament which is prone to be come off, there is a tendency of increasing theft damage wherein the aged person is deprived of the personal ornament by other person.

Meanwhile, there is disclosed, in JP 2003-210215 A and JP 2004-166809 A, a configuration of a personal ornament wherein a personal ornament body is held by a retainer employing a metallic magnet having a high magnetic attraction force which retainer is prepared separately from the personal ornament body as a retaining means of the personal ornament and incorporated in the personal ornament body from outside.

Meanwhile there has been known a configuration wherein a retainer using metallic magnets having the high magnetic attraction force serving as a retaining means of the personal ornament is provided separately from a personal ornament body, and the retainer using the metallic magnets is built in the personal ornament body from the outside. However, in such a configuration, the magnetic attraction force of the magnets becomes excessively strong, and hence there is a likelihood of occurrence of inconvenience in using thereof such that the retainer is hardly come off by the wearer by himself or herself.

SUMMARY OF THE INVENTION

The invention has been developed under such circumstances, and it is an object of the invention to provide a personal ornament capable of reliably retaining the personal ornament with a strong magnetic attraction force of metallic magnets, said magnetic attraction force being not less than a given value, and hence it enhances safety relative to theft and so forth, and also it is excellent in wearing relative to a wearer, and excellent in wearing and removal by the wearer himself or herself.

To achieve the above object, the personal ornament of the first aspect of the invention is characterized in comprising a string-shaped tube made of a flexible material and capable of being twisted and bent, a plurality of columnar metallic magnets being inserted into the tube along the longitudinal direction thereof and tandemly arranged therein while both ends thereof being opposed to each other in the axial direction, and an outer covering provided on an outer peripheral surfaces of the tube, wherein N poles and S poles of the respective magnets are arranged alternately on opposite peripheral surface of the columnar magnets.

The personal ornament of the second aspect of the invention is characterized in comprising a string-shaped tube made of a flexible material and capable of being twisted and bent, a plurality of columnar metallic magnets being inserted into the tube along the longitudinal direction thereof and tandemly arranged therein while both ends thereof being opposed to each other in the axial direction, spacers arranged between the magnets and made of a non-magnetic material, and an outer covering provided on an outer peripheral surface of the tube, wherein N poles and S poles of the respective magnets are arranged alternately on opposite peripheral surface of the columnar magnets.

The personal ornament of the third aspect of the invention is characterized in that the magnets are arranged in full range of the tube along the longitudinal direction or in a given range at both ends of the tube.

The personal ornament of the fourth aspect of the invention is characterized in that the magnets and spacers are arranged alternately by an arbitrary number of one or not less than two.

The personal ornament of the fifth aspect of the invention is characterized in that a magnetic force of a part of the magnets are larger that magnetic forces of other magnets.

The personal ornament according to the sixth aspect of the invention is characterized in comprising a personal ornament body formed by inserting a plurality of columnar metallic magnets into a string-shaped tube made of a flexible material and capable of being twisted and bent, wherein N poles and S poles of the respective magnets are arranged alternately on opposite peripheral surfaces of the columnar magnets, and a retainer capable of fixing one end side and other end side of the personal ornament body in a state where both end sides of the personal ornament body are aligned in parallel with each other.

The personal ornament according to the seventh aspect of the invention is characterized in comprising a personal ornament body formed by inserting a plurality of columnar metallic magnets into a string-shaped tube made of a flexible material and capable of being twisted and bent, wherein N poles and S poles of the respective magnets are arranged alternately on opposite peripheral surfaces of the columnar magnets, and a detachable retainer capable of fixing one end side and other end side of the personal ornament body in a state where both end sides of the personal ornament body are aligned in parallel with each other.

The personal ornament according to the eighth aspect of the invention is characterized in comprising a personal ornament body formed by inserting a plurality of columnar metallic magnets into a string-shaped tube made of a flexible material and capable of being twisted and bent, wherein N poles and S poles of the respective magnets are alternately arranged on opposite peripheral surface of the columnar magnets, and a retainer fixed to other end side of the personal ornament body and capable of fixing one end of the personal ornament body to the other end side of the personal ornament body in a state where one end side and other end side of the personal ornament body are aligned in parallel with each other.

According to the first to fifth aspect of inventions, since the personal ornament is configured such that a plurality of columnar metallic magnets are inserted into the string-shaped tube along the longitudinal direction thereof and tandemly arranged therein while both ends thereof faces each other in the axial direction, and the tube is made of a flexible material and capable of being twisted and bent, wherein N poles and S poles of the respective magnets are arranged on opposite peripheral surfaces of the columnar magnets, so that the personal ornament can be reliably retained with a strong magnetic attraction force of the metallic magnets, said magnetic attraction force being not less than a given value, and hence it enhances a safety relative to theft and so forth, and also it is excellent in wearing relative to a wearer, and excellent in wearing and removal by the wearer himself or herself.

According to the sixth to eighth aspect of inventions, since the personal ornament is configured such that a plurality of columnar metallic magnets are inserted into the string-shaped tube along the longitudinal direction thereof and tandemly arranged therein while both ends thereof faces each other in the axial direction, and the tube is made of a flexible material and capable of being twisted and bent, wherein N poles and S poles of the respective magnets are arranged on opposite peripheral surfaces of the columnar magnets, so that the personal ornament can be reliably retained with a strong magnetic attraction force of the metallic magnets, said magnetic attraction force being not less than a given value, and hence it enhances a safety relative to theft and so forth, and retains the personal ornament more assurance by the retainer, and also it is excellent in wearing relative to a wearer, and excellent in wearing and removal by the wearer himself or herself.

PREFERRED EMBODIMENTS OF THE INVENTION

Embodiments of a personal ornament according to the invention are described hereinafter with reference to the attached drawings. According to the embodiments, there is described a case where the personal ornament of the invention is applied to a necklace. However, the personal ornament of the invention can be applied to other personal ornaments, for example, to a bracelet, a belt, other various ring-shaped personal ornaments.

First Embodiment (FIG. 1 to FIG. 20)

Figure 1:
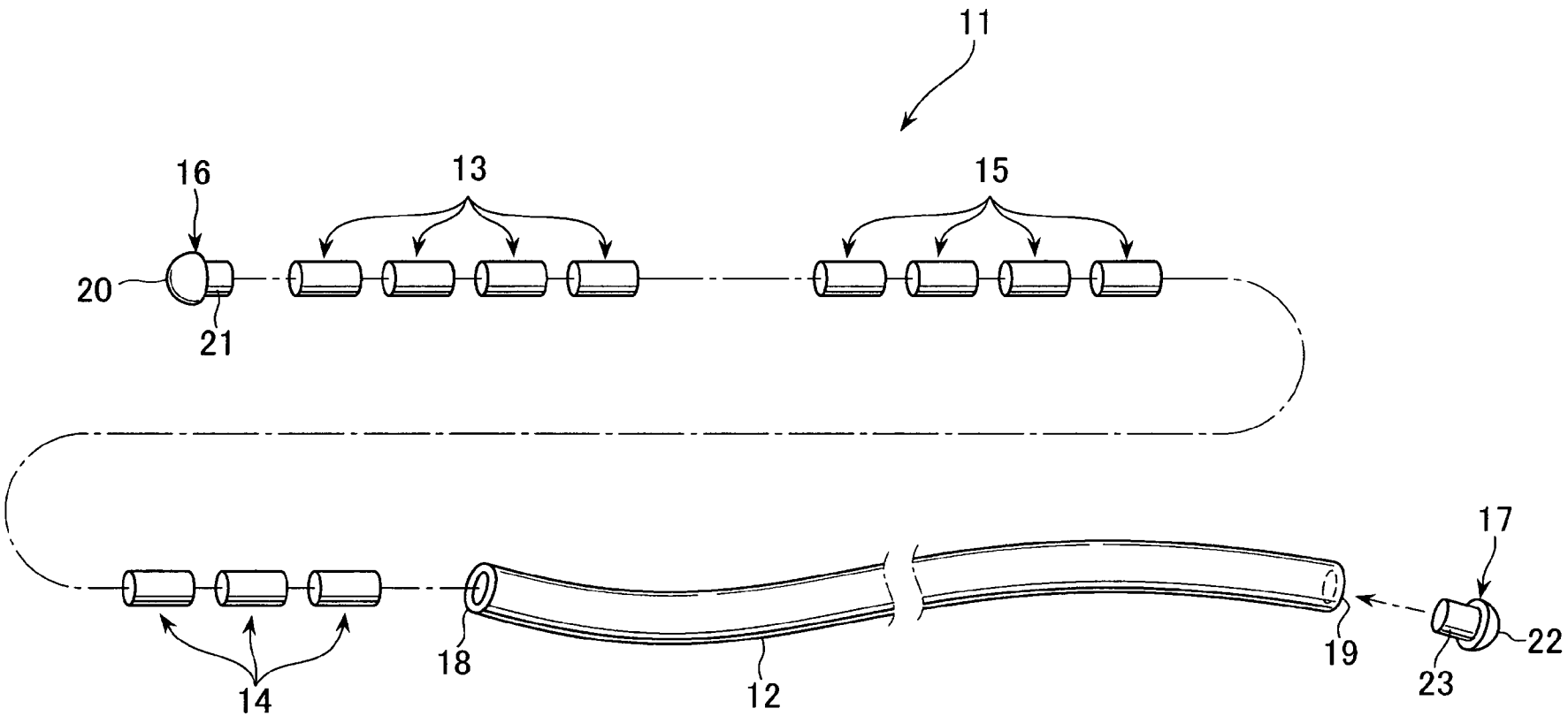
FIG. 1 is an exploded perspective view showing a personal ornament body according to a first embodiment of the invention.

FIG. 1 is an exploded perspective view showing a component configuration of a body constituting a basic configuration of the personal ornament (hereinafter referred to as a personal ornament body) according to the first embodiment of the invention. As shown in FIG. 1, a personal ornament body 11 according to the first embodiment comprises one string-shaped tube 12 which is opened at both ends, a plurality of magnets 13 . . . , 14 . . . , 15 . . . which are inserted into the tube 12, one end side cap 16 for closing one end side opening 18 of the tube 12, and other end side cap 17 for closing other end side opening 19 of the tube 12.

The tube 12 is first set at a given length capable of being worn around a neck of a user who wears the personal ornament body 11, and is structured in a circular tube by a flexible material such as a flexible synthetic resin, rubber and so forth. With such a configuration, the tube 12 can be easily twisted not less than 180 degrees relatively about the center of axis between both ends thereof along the longitudinal direction, and also easily bent by being wound around the neck of the user and also it can be ring-shaped. A tensile strength of the tube 12 is preferable to an extent not to be easily ruptured by a human power. The tube 12 is also preferable to have various decorative effects such as a transparent body, a half-transparent body, or a colored body and so forth.

Next the magnets 13 . . . are a plurality of one end side magnets which are inserted into the one end side opening 18 of the tube 12. These one end side magnets 13 . . . are configured to have the same diameter and length and are columnar in shape, wherein when the one end side magnets 13 . . . are inserted into the one end side opening 18 of the tube 12, the central portion of a circular tube of the tube 12 is in a state to be brought in line with those of the one end side magnets 13 . . . . Further, the one end side magnets 13 . . . each are inserted into the tube 12 along the longitudinal direction of the tube 12, and tandemly arranged therein while both ends of the one end side magnets 13 . . . are opposed to each other in an axial direction. The one end side magnets 13 . . . are made of a metallic magnet, for example, a ferrite magnet having a strong magnetic attraction force (e.g. 2000 gauss).

Further, the magnet 14 . . . are a plurality of other end side magnets which are inserted into an end of the tube 12, which is opposite to the end into which the one end side magnets 13 . . . are inserted, namely, to other end side opening 19 of the tube 12. The other end side magnets 14 . . . are also configured to have the same diameter and length and are columnar in shape like the one end side magnets 13 . . . , and the other end side magnets 14 . . . are inserted into the tube 12 along the longitudinal direction of the tube 12, and tandemly arranged therein while both ends of the other end side magnets 14 . . . are opposed to each other in an axial direction. The other end side magnets 14 . . . are made of a metallic magnet, for example, a ferrite magnet having the strong magnetic attraction force (e.g. 2000 gauss) like the one end side magnets 13 . . . .

The one end side magnets 13 . . . and other end side magnets, 14 . . . generate the magnetic attraction force mutually at the portion where the one end side opening 18 and other end side opening 19 of the tube 12 are overlapped or a crossed with each other in a state where the tube 12 is wound around the neck of the user.

Further, the magnets 15 . . . are intermediate magnets which are inserted into the portion other than the portion, into which the one end side magnets 13 . . . and other end side magnets 14 . . . are inserted, namely, an intermediate portion inside the tube 12. The intermediate magnets 15 . . . have the same diameter and length and are columnar in shape, and are inserted into the tube 12 along the longitudinal direction of the tube 12, and tandemly arranged therein while both ends of the intermediate magnets 15 . . . are opposed to each other in an axial direction, like the one end side magnets 13 . . . and other end side magnets 14 . . . . The intermediate magnets 15 . . . are used mainly around the neck of the user, and strong magnetic attraction force is not always needed in the case where they do not function as a retainer means of the tube 12. However, if the intermediate magnets 15 . . . function as the retainer means of the tube 12 depending on a state of use, they are preferable to be made of a metallic magnet having the strong magnetic attraction force (e.g. 2000 gauss) such as a ferrite magnet like the one end side magnets 13 . . . and other end side magnets 14 . . . .

The one end side cap 16 comprises a hemispherical cap main body 20 having a diameter same as the outer diameter of the tube 12, and a columnar insertion part 21 having a diameter same as a diameter of a hole of the tube 12 and protruding from a flat surface of the cap main body 20. When the columnar insertion part 21 of the one end side cap 16 is inserted into the one end side opening 18 of the tube 12, the one end side opening 18 can be closed by the cap main body 20. Likewise, the other end side cap 17 comprises a hemispherical cap main body 22 having a diameter same as the outer diameter of the tube 12, and a columnar insertion part 23 having a diameter same as the diameter of the hole of the tube 12 and protruding from a flat surface of the cap main body 22. When the columnar insertion part 23 of the other end side cap 17 is inserted into the other end side opening 19 of the tube 12, the other end side opening 19 can be closed by the cap main body 22.

Figure 2:
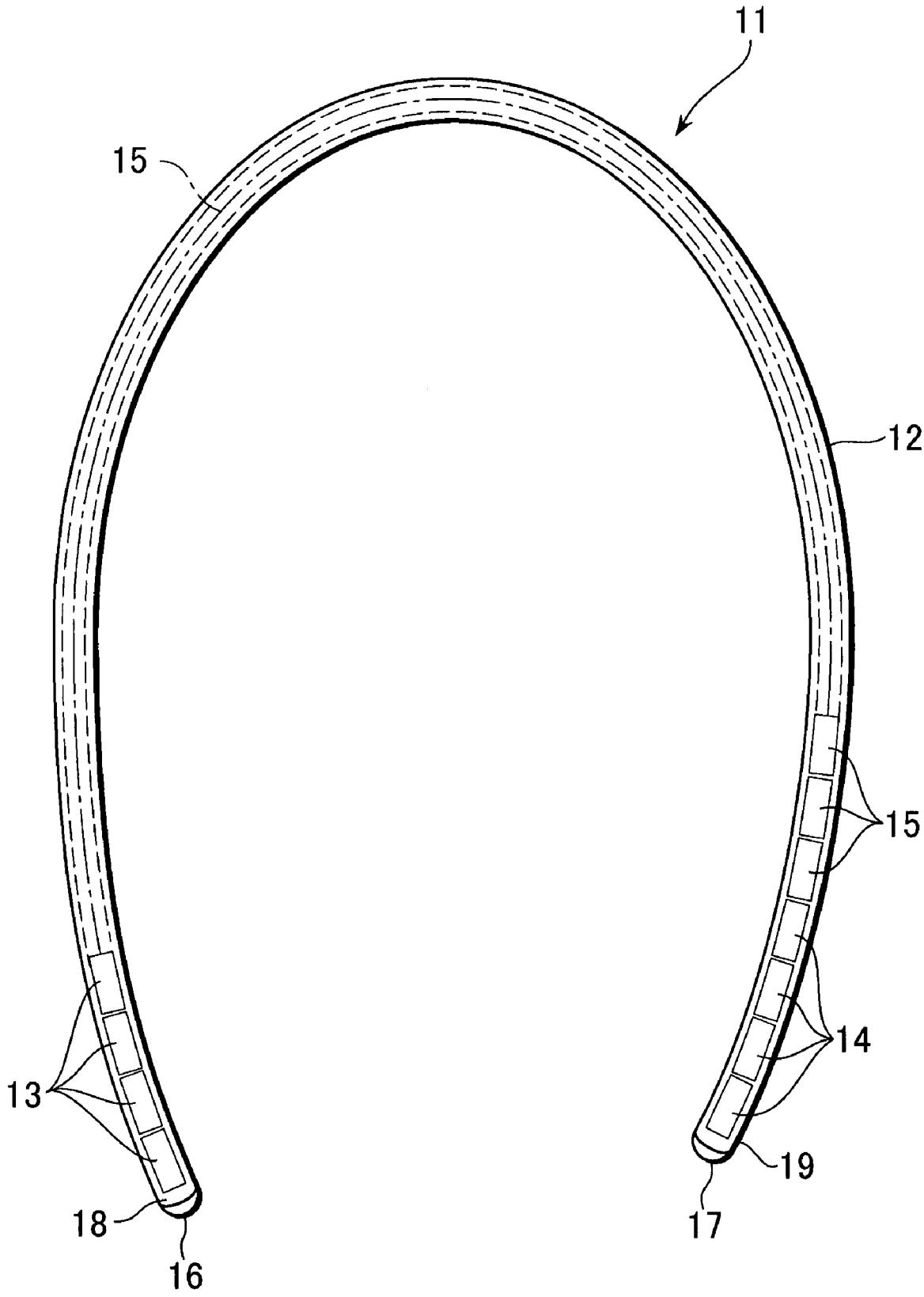
FIG. 2 an entire sectional view showing the personal ornament body according to the first embodiment of the invention.

FIG. 2 is an entire sectional view showing a state where components shown in FIG. 1 are assembled as the personal ornament body 11. In FIG. 2, the personal ornament body 11 is shown in an inverted U-shaped state. As shown in FIG. 2, a plurality of one end side magnets 13 . . . are inserted into the other end side opening 18 of the tube 12 while tandemly arranged, and a plurality of other end side magnets 14 . . . are inserted into the one end side opening 19 of the tube 12 while tandemly arranged. A plurality of intermediate magnets 15 . . . are inserted into the portion other than the one end side opening 18 and other end side opening 19 into which the one end side magnets 13 . . . and other end side magnets 14 . . . are inserted, i.e., into the intermediate portion of the tube 12 while tandemly arranged. In such a manner, the one end side magnets 13 . . . , other end side magnets 14 . . . and intermediate magnets 15 . . . are arranged in the entire range of the tube 12 in the longitudinally direction thereof.

Meanwhile, when the one end side magnets 13 . . . , other end side magnets 14 . . . and intermediate magnets 15 . . . are inserted into the tube 12 in a state where the end surfaces thereof in an axial direction are pressed to contact each other, there is no space for these end surfaces to be inclined, causing the tube 12 not to be bent. Accordingly, there are secured given gaps between the one end side magnets 13 . . . , between the other end side magnets 14 . . . , between the one end side magnets 13 . . . , other end side magnets 14 . . . and the intermediate magnets 15 . . . , and between the intermediate magnets 15 . . . , whereby the one end side magnets 13 . . . , other end side magnets 14 . . . and intermediate magnets 15 . . . can be inclined respectively, causing the tube 12 to be bent.

The one end side opening 18 and other end side opening 19 of the tube 12 are closed by the one end side cap 16 and other end side cap 17, respectively, and they are fixed by adhesion, a screw structure and so forth. As a result, the one end side magnets 13 . . . , other end side magnets 14 . . . and so forth are prevented from being come off the one end side cap 16 and other end side cap 17 of the tube 12.

Figure 3:
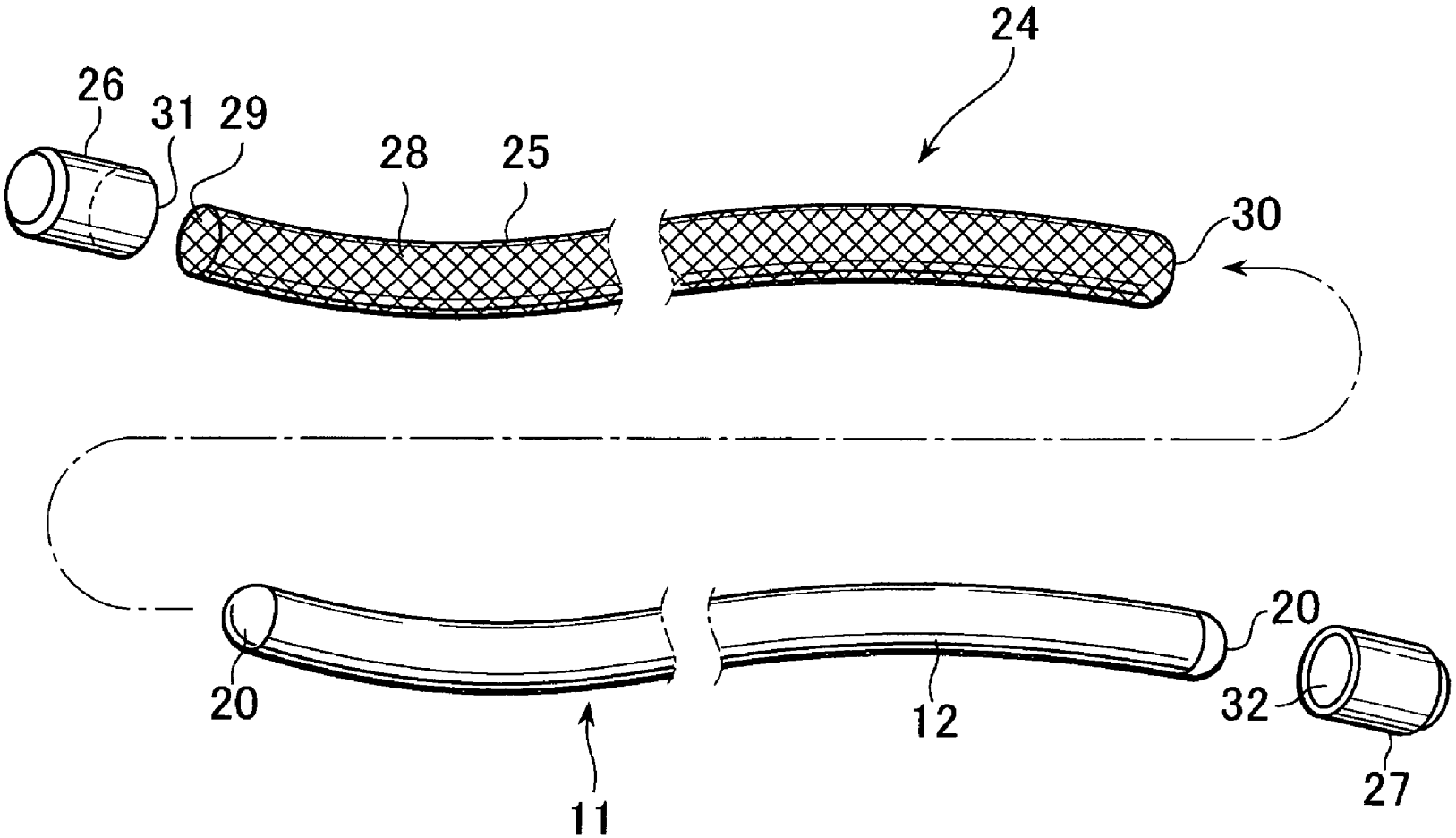
FIG. 3 is an exploded perspective view showing an entire component of a personal ornament according to the first embodiment of the invention.

FIG. 3 is an exploded perspective view showing an entire configuration of a personal ornament 24 including an outer covering 25 which is provided on an outer peripheral surface of the personal ornament body 11.

As shown in FIG. 3, the outer covering 25 is a cylindrical mesh member made of, e.g., gold, silver, platinum, other precious metals or fibers configured by knitting various flexible wire rods to which decorative effects are applied. The outer covering 25 is configured to cover substantially the entire tube 12 of the personal ornament body 11, and has one end opening 29 at one end side and the other end opening 30 at the other end side thereof in an axial direction.

As means for closing the one end opening 29 and other end opening 30, there are provided one end side outer cap 26 for closing the one end opening 29 and other end side outer cap 27 for closing the other end opening 30.

The one end side outer cap 26 has a short cylindrical shape which is closed at one end and has an inner diameter which is substantially the same as the outer diameter of the outer covering 25, and it is configured such that an opening 31 bored at the other end of the one end side outer cap 26 is engaged with an outer peripheral side of the one end opening 29 of the outer covering 25.

The other end side outer cap 27 has a short cylindrical shape which is closed at one end and has an inner diameter which is substantially the same as the outer diameter of the outer covering 25, and it is configured such that an opening 32 bored at the other end of the other end side outer cap 27 is engaged with an outer peripheral side of the other end opening 30 of the outer covering 25.

With such a configuration, in the case where the personal ornament body 11 and outer covering 25 are assembled with each other, the one end side of the personal ornament body 11 is inserted into the outer covering 25 from the other end opening 30 side, as shown in an arrow in FIG. 3, then it is slidely moved for causing one end side of the personal ornament body 11 to be brought in line with an end position of the one end opening 29 of the outer covering 25. Thereafter, the one end opening 29 of the outer covering 25 is covered with the one end side outer cap 26 to be fixed by adhesion and so forth while the other end side of the outer covering 25 is covered with the other end side outer cap 27 to be fixed by adhesion and so forth.

Figure 4:
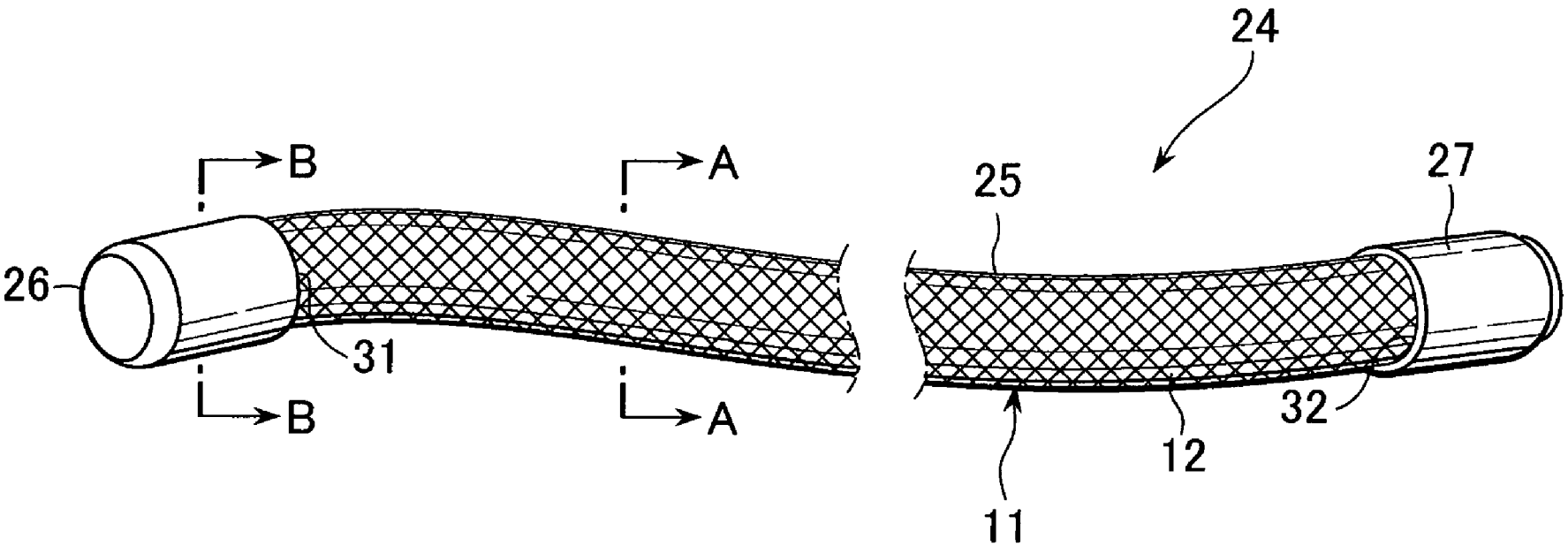
FIG. 4 is a perspective view showing an entire configuration of the personal ornament according to the first embodiment of the invention.

FIG. 4 is a perspective view showing an entire configuration of the personal ornament 24 which is completed in assembly by the operations described above. As shown in FIG. 4, the personal ornament 24 is configured such that the outer peripheral side of the tube 12 of the personal ornament body 11 is covered with the outer covering 25 serving as the cylindrical mesh member, and it is also configured that the outer peripheral surface of the tube 12 of the personal ornament body 11 can be seen from gaps of the mesh portions of the outer covering 25. One end sides of the personal ornament body 11 and outer covering 25 are inserted into the opening 31 of the one end sides outer cap 26 and are covered from the outside, and the other end sides of the personal ornament body 11 and outer covering 25 are inserted into the opening 32 of the other end side outer cap 27 and covered from the outside.

Figure 5:
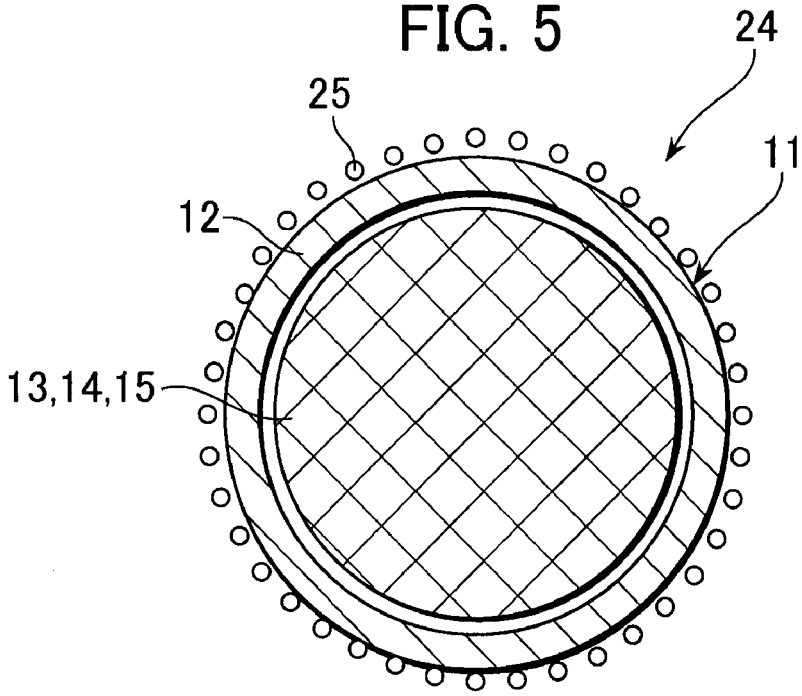
FIG. 5 is a sectional view taken along the line A-A in FIG. 4.

FIG. 5 is a sectional view taken along the line A-A in FIG. 4 (a sectional view taken along a plane orthogonal to an axis of the personal ornament 24 at an arbitrary position in the axial direction). As shown in FIG. 5, the one end side magnets 13, other end side magnets 14, and intermediate magnets 15 of the personal ornament body 11 are arranged at the central position of the personal ornament 24 in the radial direction. The tube 12 of the personal ornament body 11 are arranged on the outer peripheral sides of the one end side magnets 13, other end side magnets 14, and intermediate magnets 15, while the outer covering 25 is arranged on the outer peripheral side of the tube 12.

With such a configuration, it is evident that the outer peripheral surface of the tube 12 of the personal ornament body 11 is seen from the gaps of mesh portions of the outer covering 25 arranged at the outermost periphery, and further the personal ornament 24 including the tube 12 of the personal ornament body 11, one end side magnets 13, other end side magnets 14 and intermediate magnets 15 can be integrally bent.

Figure 6:
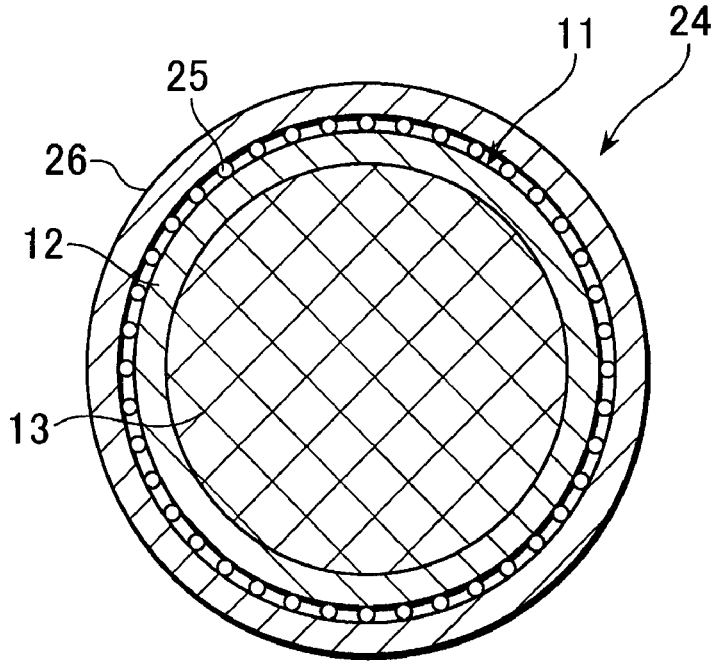
FIG. 6 is a sectional view taken along the line B-B in FIG. 4.

FIG. 6 is a sectional view taken along the line B-B in FIG. 4 (a sectional view taken along a plane orthogonal to an axis of the personal ornament 24 at an arbitrary position in the axial direction). As shown in FIG. 6, the one end side magnets 13 . . . of the personal ornament body 11 are arranged at the central position of the personal ornament 24 in a radial direction at one end side of the personal ornament 24 in the axial direction. The tube 12, outer covering 25 and one end side outer cap 26 are arranged on the outer peripheral sides of the one end side magnets 13 . . . .

With such a configuration, it is evident that the one end side magnets 13 . . . , tube 12, outer covering 25 and one end side outer cap 26 are integrally fixed at one end side of the personal ornament 24 in the axial direction by the one end side outer cap 26.

Although, not shown, even in the configuration of the other end side of the personal ornament 24 in the axial direction, the other end side magnets 14 . . . of the personal ornament body 11 are arranged at the central position in a radial direction in the same manner as shown in FIG. 6. The outer covering 25 and other end side outer cap 27 are arranged at the peripheral sides of the other end side magnets 14. The other end side magnets 14, outer covering 25 and other end side outer cap 27 are integrally fixed to the other end side of the personal ornament 24 in the axial direction by the other end side outer cap 27.

Figure 7:
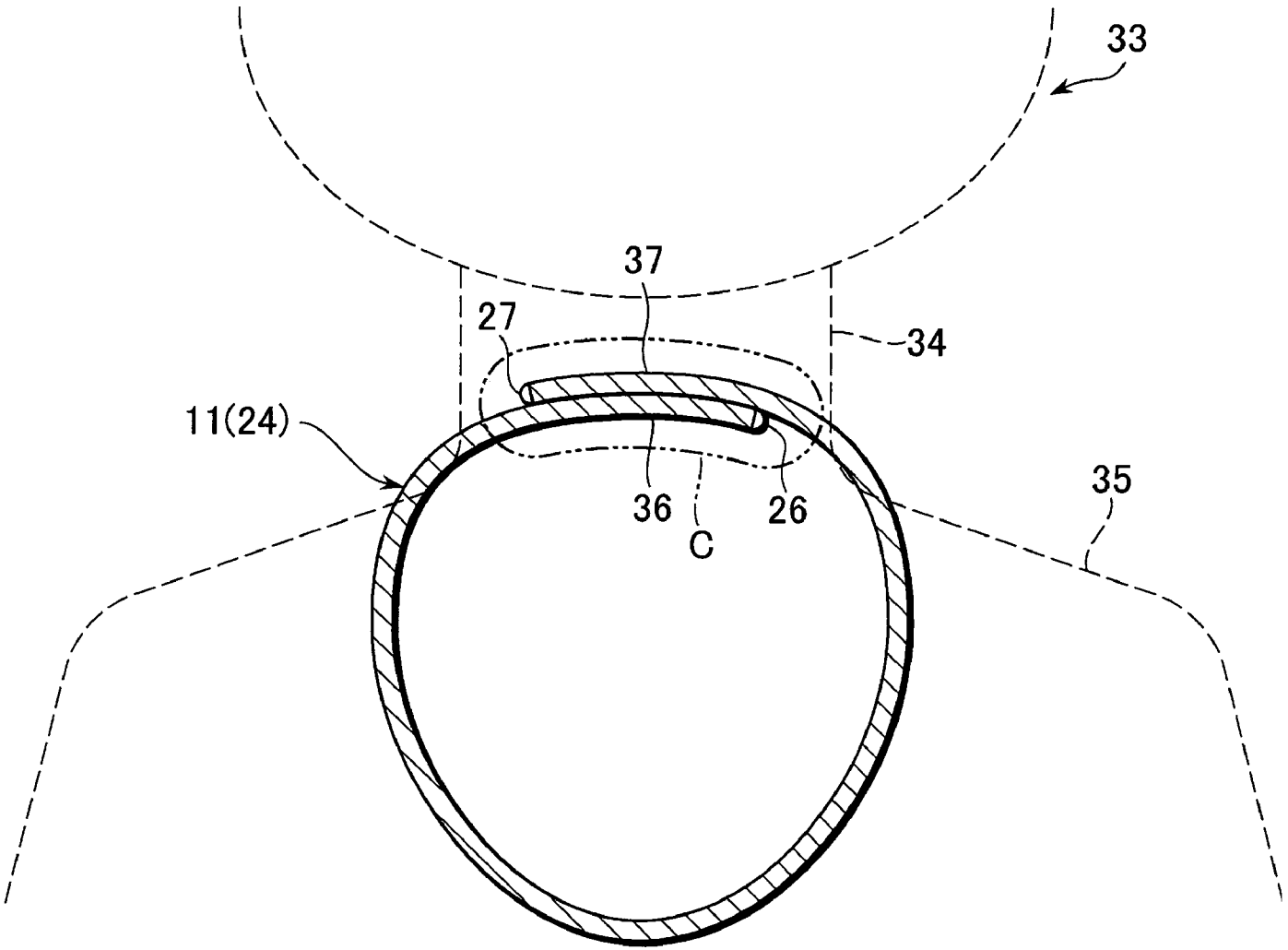
FIG. 7 is a view for explaining an example of a wearing state of the personal ornament according to the first embodiment of the invention.

FIG. 7 is a view for explaining an example of a wearing state of the personal ornament 24. The example of the FIG. 7 shows a method of wearing the personal ornament 24 wherein the personal ornament 24 is worn around a neck 34 of a wearer 33 and the one end side 36 and other end side 37 of the personal ornament 24 are overlapped with each other at the backside of the neck 34 to be retained with the magnetic force, and the wearing method is explained in a state to be seen from the front of the wearer 33.

In the case of using the wearing method, the wearer 33 grasps the one end side 36 of the personal ornament 24 with one hand (right hand) and also grasps the other end side 37 of the personal ornament 24 with the other hand (left hand). The wearer 33 gradually raises the personal ornament 24 from the front lower portion of the neck 34 (under the chin) in the upward direction, and both ends of the personal ornament 24 are turned at the backside of the neck 34 from the upper portion of the shoulder 35. Thereafter, the one end side 36 and other end side 37 of the personal ornament 24 are overlapped with each other.

Then, once the one end side 36 and other end side 37 of the personal ornament 24 are moved to approach each other for a given distance, they are immediately rendered in an adhesion state by the magnetic attraction forces. That is, just causing the wearer 33 to approach the one end side 36 toward the other end side 37 at the back side of the neck 34, the one end side 36 and other end side 37 can be easily and quickly fitted and fixed to each other with the strong magnetic attraction force.

Figure 8:
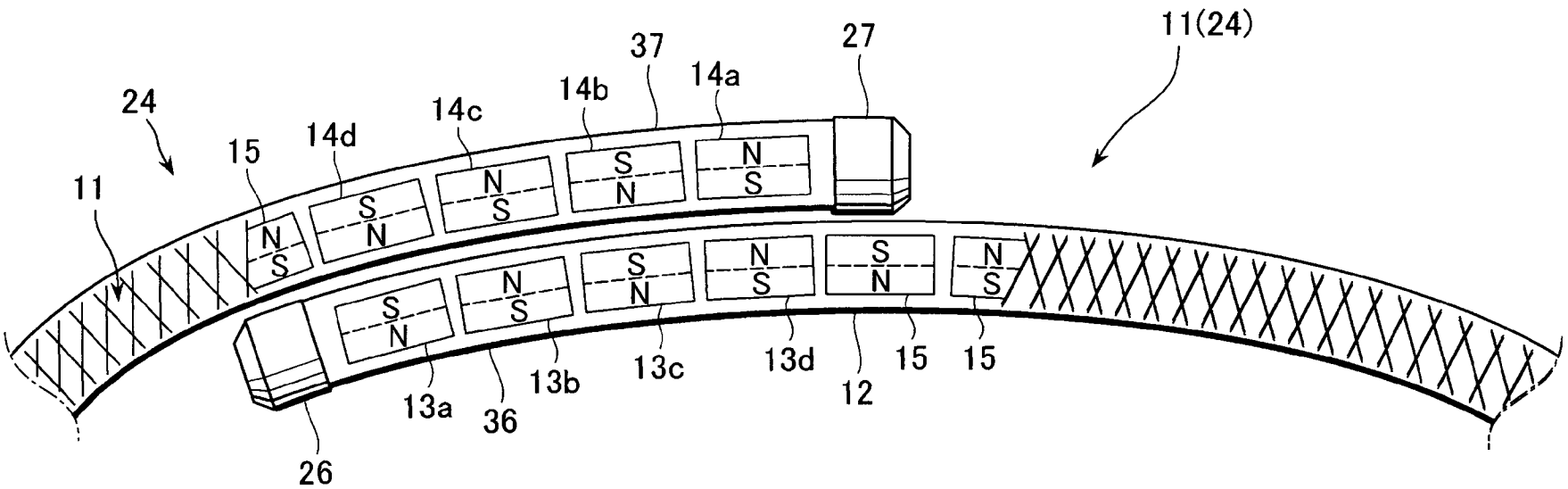
FIG. 8 is a partial sectional view in which a part C in FIG. 7 is enlarged.

An adhesion operation caused by the magnetic attraction force is now described with reference to FIG. 8. FIG. 8 is a partial sectional view in which a C portion in FIG. 7, i.e., an overlapped portion of the one end side 36 and other end side 37 of the personal ornament 24 at the backside of the neck 34 is enlarged, and which shows a magnet structure and the magnetic attraction operation inside the personal ornament body 11 at the one end side 36 and other end side 37 of the personal ornament 24.

As shown in FIG. 8, at the overlapped portion of the one end side 36 and other end side 37 of the personal ornament 24, for example, four one end side magnets 13 (13*a*, 13*b*, 13*c* 13*d*) are tandemly arranged in the personal ornament body 11 of the one end side 36 from the one end side outer cap 26 side. The one end side magnets 13 (13*a*, 13*b*, 13*c* 13*d*) are configured to be columnar, respectively, as described above, and N-poles (N) and S-poles (S) of the one end side magnets 13 (13*a*, 13*b*, 13*c* 13*d*) are arranged on the opposite side outer peripheral surfaces of the columnar magnets. Then, the N-poles (N) and S-poles (S) of the one end side magnets 13 (13*a*, 13*b*, 13*c* 13*d*) which are adjacent to each other are arranged in an alternate direction. More in detail, the N-pole (N) of the one end side magnet 13*a* arranged at the end side closest to the one end side outer cap 26 side of the personal ornament 24 is directed downward, the S-pole (S) thereof is directed upward. Then, the N-pole (N) of the one end side magnet 13*b* arranged at the second from the end side adjacent to the one end side magnet 13*a* is directed upward, and the S-pole (S) is directed downward. Further, the N-pole (N) of the one end side magnet 13*c* arranged at the third from the one end side adjacent to the one end side magnet 13*b* is directed downward, and the S-pole (S) is directed upward, opposite to the second one end side magnet 13*b*. Still further, the N-pole (N) of the one end side magnet 13*d* arranged at the fourth from the end side adjacent to the one end side magnet 13*c* is directed upward, and the S-pole (S) is directed downward, opposite to the third one end side magnet 13*c*. The N-poles (N) and S-poles (S) of the intermediate magnets 15 . . . subsequent to the one end side magnets 13 . . . are arranged in an alternate direction.

On the other hand, at the overlapped portion of the one end side 36 and other end side 37 of the personal ornament 24, for example, four other end side magnets 14 (14*a*, 14*b*, 14*c* 14*d*) are tandemly arranged in the personal ornament body 11 of the other end side 37 from the other end side outer cap 27 side. The other end side magnets 14 (14*a*, 14*b*, 14*c* 14*d*) are configured to be columnar, respectively, as described above, and N-poles (N) and S-poles (S) of the other end side magnets 14 (14*a*, 14*b*, 14*c* 14*d*) are arranged on the opposite side outer peripheral surfaces of the columnar magnets. Then, the N-poles (N) and S-poles (S) of the other end side magnets 14 (14*a*, 14*b*, 14*c* 14*d*) which are adjacent to each other are arranged in an alternate direction.

More in detail, the N-pole (N) of the other end side magnet 14*a* arranged at the end side closest to the other end side outer cap 27 side of the personal ornament 24 is directed upward, the S-pole (S) thereof is directed downward. Then, the N-pole (N) of the other end side magnet 14*b* arranged at the second from the end side adjacent to the other end side magnet 14*a* is directed downward, and the S-pole (S) is directed upward opposite to the first other end side magnet 14*a*. Further, the N-pole (N) of the other end side magnet 14*c* arranged at the third from the one end side adjacent to the other end side magnet 14*b* is directed upward, and the S-pole (S) is directed downward, opposite to the second other end side magnet 14*b*. Still further, the N-pole (N) of the other end side magnet 14*d* arranged at the fourth from the end side adjacent to the other end side magnet 14*c* is directed downward, and the S-pole (S) is directed upward, opposite to the third other end side magnet 14*c*. The N-poles (N) and S-poles (S) of the intermediate magnets 15 . . . subsequent to the other end side magnets 14 . . . are arranged in an alternate direction, in the same manner described above.

Accordingly, at the overlapped portion of the one end side 36 and other end side 37 of the personal ornament 24, the N-poles (N) and S-poles (S) of the four one end side magnets 13 (13*a*, 13*b*, 13*c* 13*d*) and the S-poles (S) and N-poles (N) of the four other end side magnets 14 (14*a*, 14*b*, 14*c* 14*d*) are opposed to each other so that they can be magnetically adhered to each other. Since the magnets are made of a metallic magnet, they can be strongly magnetically adhered to each other so that they can not be torn off each other.

Further, since the tube 12 of the personal ornament body 11 is configured to be easily twisted not less than 180 degrees relatively about the center of axis between both ends thereof along the longitudinal direction, even if the N-poles (N) themselves or S-poles (S) themselves are rendered in a state where they are opposed to each other immediately after the personal ornament body 11 is wound around the neck of the wearer, the N-poles (N) and S-poles (S) are rendered in a state shown in FIG. 8, where they are opposed to each other naturally owing to the magnetic attraction force thereof. Accordingly, it is not necessary for the wearer to artificially implement a rotary operation of the personal ornament body 11 so that the personal ornament body 11 can be easily worn.

Figure 9:
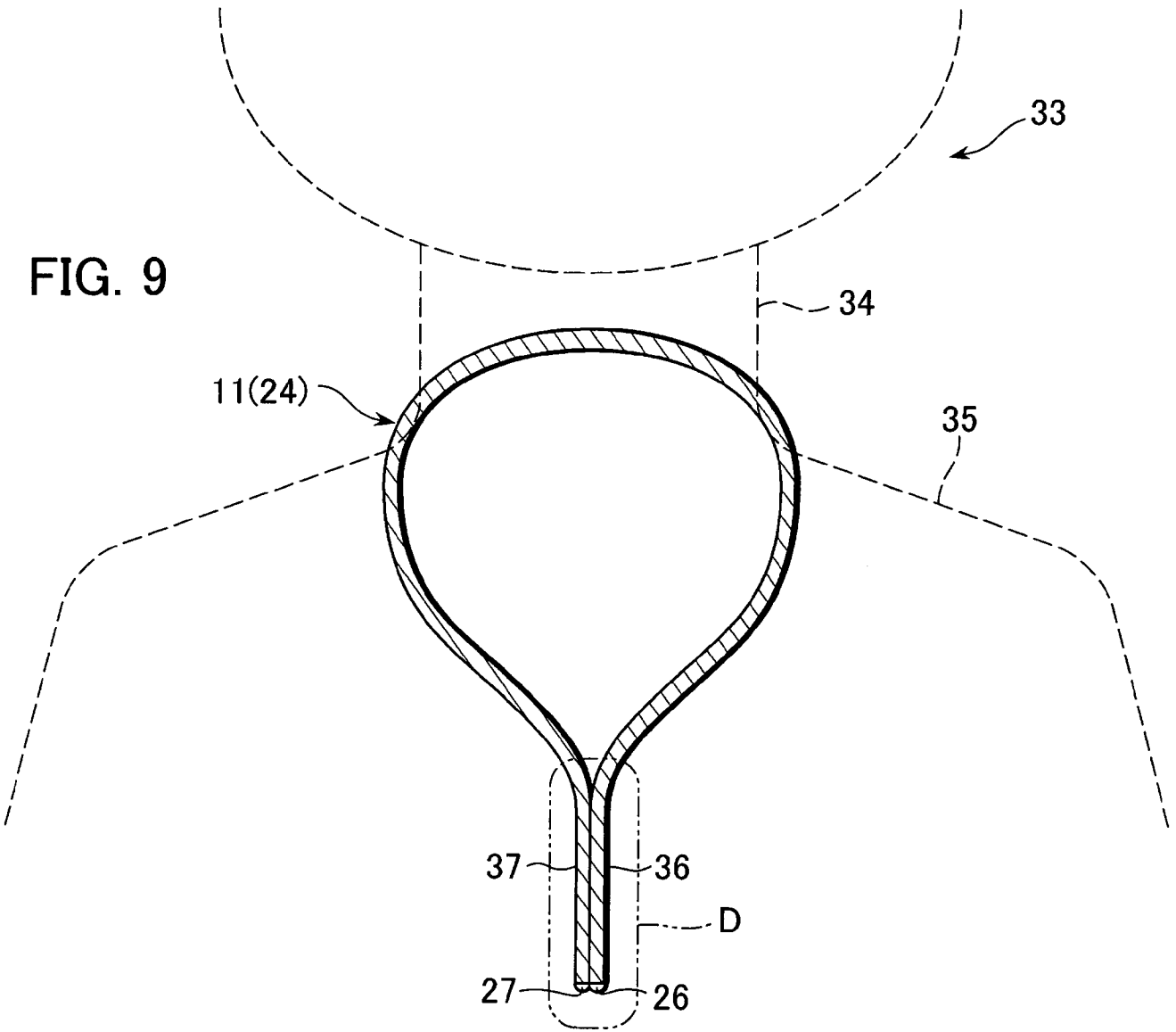
FIG. 9 is a view for explaining another example of a wearing state of the personal ornament according to the first embodiment of the invention.

FIG. 9 is a view for explaining another example of a wearing state of the personal ornament 24. The example of the FIG. 9 shows a method of wearing the personal ornament 24 wherein the personal ornament 24 is worn around the neck 34 of the wearer 33 and the one end side 36 and other end side 37 of the personal ornament 24 are rendered in a state where they are parallel with each other downward in front of neck 34 to be retained by rightward and leftward magnetic forces, and the wearing method is explained in a state to be seen from the front of the wearer 33.

In the case of using the wearing method, the wearer 33 grasps the one end side 36 of the personal ornament 24 with one hand (left hand) and also grasps the other end side 37 of the personal ornament 24 with the other hand (right hand). The wearer 33 lowers the personal ornament 24 from the backside of the neck 34 of the wearer 33 toward both sides, thereby causing both ends of the personal ornament 24 to be aligned in parallel with each other in front of the shoulder 35 so as to overlap the one end side 36 and other end side 37 of the personal ornament 24 with each other.

Then, once the one end side 36 and other end side 37 of the personal ornament 24 are moved to approach each other for a given distance, they are immediately rendered in an adhesion state by the magnetic attraction forces. That is, just causing the wearer 33 to approach the one end side 36 toward the other end side 37 at the front of and below the neck 34, the one end side 36 and other end side 37 can be easily and quickly fitted and fixed to each other with the strong magnetic attraction force.

Figure 10:
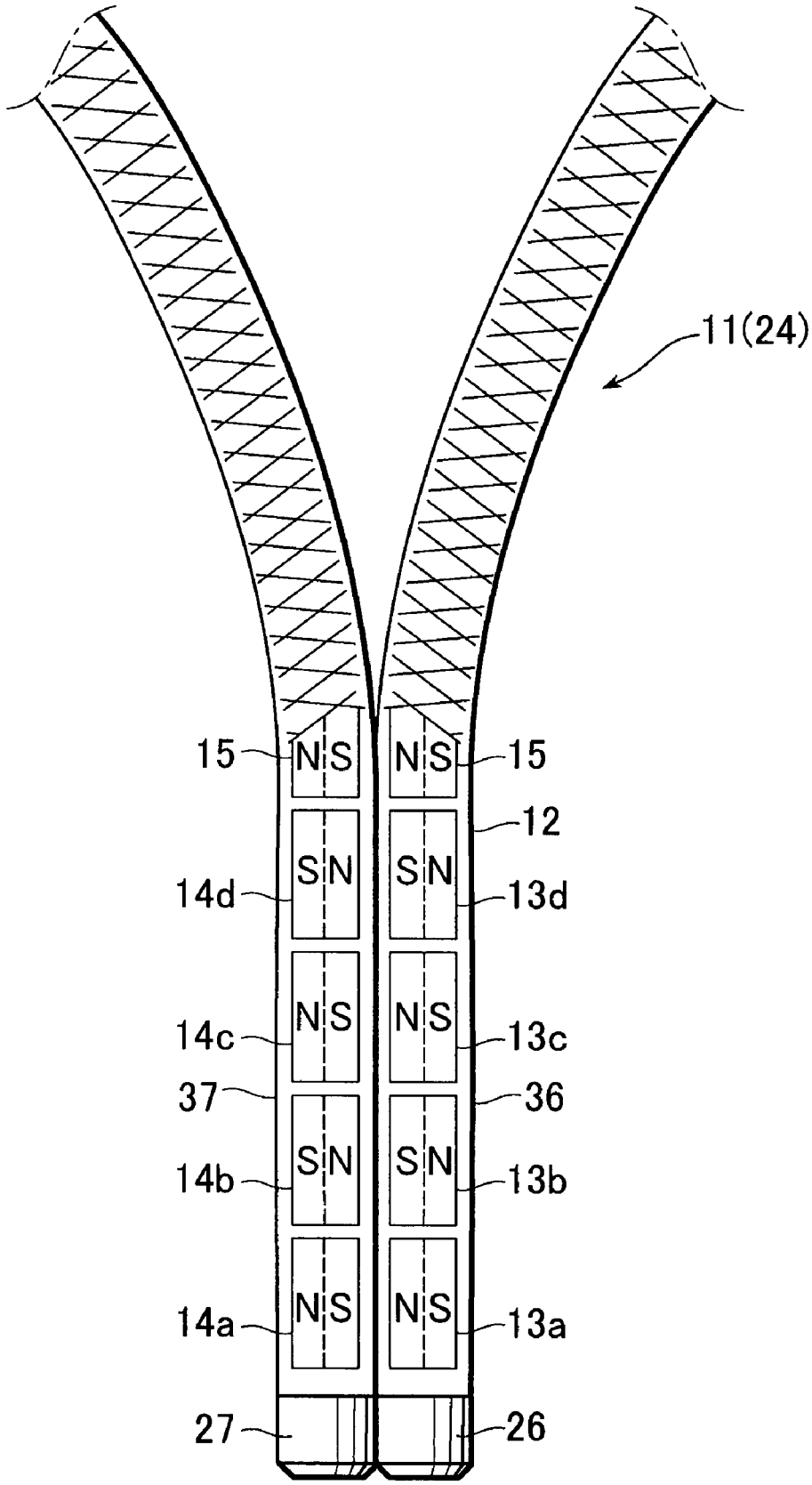
FIG. 10 is a partial sectional view for explaining a wearing process in which a part D in FIG. 9 is enlarged.

An adhesion operation caused by the magnetic attraction force is now described with reference to FIG. 10. FIG. 10 is a partial sectional view in which a D portion in FIG. 10, in which an overlapped portion of the one end side 36 and other end side 37 of the personal ornament 24 at the front of and below the neck 34 is enlarged, and which shows a magnet structure and the magnetic attraction operation inside the personal ornament body 11 at the one end side 36 and other end side 37 of the personal ornament 24.

As shown in FIG. 10, at the overlapped portion of the one end side 36 and other end side 37 of the personal ornament 24, for example, four one end side magnets 13 (13*a*, 13*b*, 13*c* 13*d*) are tandemly arranged in the personal ornament body 11 of the one end side 36 from the one end side outer cap 26 side. The one end side magnets 13 (13*a*, 13*b*, 13*c* 13*d*) are configured to be columnar, respectively, as described above, and N-poles (N) and S-poles (S) of the one end side magnets 13 (13*a*, 13*b*, 13*c* 13*d*) are arranged on the opposite side outer peripheral surfaces of the columnar magnets. Then, the N-poles (N) and S-poles (S) of the one end side magnets 13 (13*a*, 13*b*, 13*c* 13*d*) which are adjacent to each other are arranged in an alternate direction. More in detail, the N-pole (N) of the one end side magnet 13*a* arranged at the end side closest to the one end side outer cap 26 side of the personal ornament 24 as shown in right side in FIG. 10 is directed leftward, the S-pole (S) thereof is directed rightward. Then, the N-pole (N) of the one end side magnet 13*b* arranged at the second from the end side adjacent to the one end side magnet 13*a* is directed rightward, and the S-pole (S) is directed leftward. Further, the N-pole (N) of the one end side magnet 13*c* arranged at the third from the one end side adjacent to the one end side magnet 13*b* is directed leftward, and the S-pole (S) is directed rightward, opposite to the second one end side magnet 13*b*. Still further, the N-pole (N) of the one end side magnet 13*d* arranged at the fourth from the end side adjacent to the one end side magnet 13*c* is directed rightward, and the S-pole (S) is directed leftward, opposite to the third one end side magnet 13*c*. The N-poles (N) and S-poles (S) of the intermediate magnets 15 . . . subsequent to the one end side magnets 13 . . . are arranged in an alternate direction in the same manner as described above.

On the other hand, at the overlapped portion of the one end side 36 and other end side 37 of the personal ornament 24, for example, four other end side magnets 14 (14*a*, 14*b*, 14*c* 14*d*) are tandemly arranged in the personal ornament body 11 of the other end side 37 from the other end side outer cap 27 side. The other end side magnets 14 (14*a*, 14*b*, 14*c* 14*d*) are configured to be columnar, respectively, as described above, and N-poles (N) and S-poles (S) of the other end side magnets 14 (14*a*, 14*b*, 14*c* 14*d*) are arranged on the opposite side outer peripheral surfaces of the columnar magnets. Then, the N-poles (N) and S-poles (S) of the other end side magnets 14 (14*a*, 14*b*, 14*c* 14*d*) which are adjacent to each other are arranged in an alternate direction.

More in detail, the N-pole (N) of the other end side magnet 14*a* arranged at the end side closest to the other end side outer cap 27 side of the personal ornament 24 is directed leftward, the S-pole (S) thereof is directed rightward. Then, the N-pole (N) of the other end side magnet 14*b* arranged at the second from the end side adjacent to the other end side magnet 14*a* is directed rightward, and the S-pole (S) is directed leftward opposite to the first other end side magnet 14*a*. Further, the N-pole (N) of the other end side magnet 14*c* arranged at the third from the one end side adjacent to the other end side magnet 14*b* is directed leftward, and the S-pole (S) is directed rightward, opposite to the second other end side magnet 14*b*. Still further, the N-pole (N) of the other end side magnet 14*d* arranged at the fourth from the end side adjacent to the other end side magnet 14*c* is directed rightward, and the S-pole (S) is directed leftward, opposite to the third other end side magnet 14*c*. The N-poles (N) and S-poles (S) of the intermediate magnets 15 . . . subsequent to the other end side magnets 14 . . . are arranged in an alternate direction, in the same manner described above.

Accordingly, at the overlapped portion of the one end side 36 and other end side 37 of the personal ornament 24, N-poles (N) and S-poles (S) of the four one end side magnets 13 (13*a*, 13*b*, 13*c* 13*d*), S-poles (S) and N-poles (N) of the four other end side magnets 14 (14*a*, 14*b*, 14*c* 14*d*) are arranged to be opposed to each other so that they can be magnetically adhered to each other. Since the magnets are made of a metallic magnet, they can be strongly magnetically adhered to each other so that they can not be torn from each other.

Since the tube 12 of the personal ornament body 11 is configured to be easily twisted not less than 180 degrees relatively about the center of axis between both ends thereof along the longitudinal direction, even if the N-poles (N) themselves or S-poles (S) themselves are rendered in a state where they are opposed to each other immediately after the personal ornament body 11 is wound around the neck of the wearer, the N-poles (N) and S-poles (S) are rendered in a state shown in FIG. 10, where they are opposed to each other naturally owing to the magnetic attraction forces thereof. Accordingly, it is not necessary for the wearer to artificially implement a rotary operation of the personal ornament body 11 so that the personal ornament body 11 can be easily worn.

Figure 11:
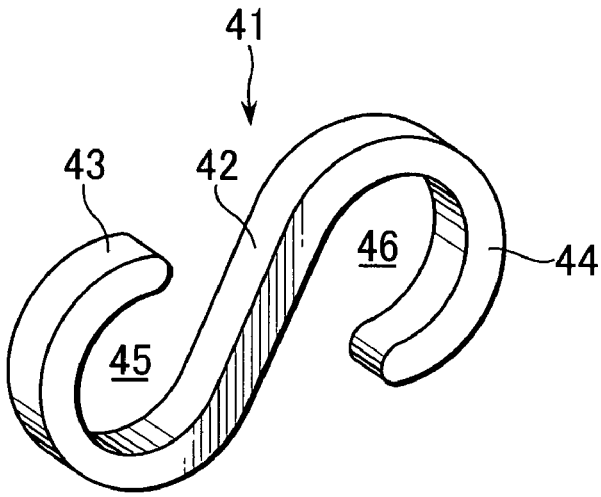
FIG. 11 is a perspective view showing an example of a retainer of the personal ornament according to the first embodiment of the invention.

FIG. 11 is a perspective view showing an example of the retainer 41 of the personal ornament 24 according to the first embodiment of the invention. As shown in FIG. 11, the retainer 41 is molded or bent out of a material such as a metal or a resin and so forth, or bending process and is formed substantially in S-shape as viewed from the side surface. That is, a central part 42 of the retainer 41 is substantially linear, and the one end part 43 thereof has an inner diameter which is slightly larger than an outer diameter of the personal ornament 24 and is bent in a circular shape. A gap which is smaller than the outer diameter of the personal ornament 24 is formed between the linear central part 42 of the retainer 41 and a tip end of the one end part 43. With the formation of the gap, a circular space portion inside the curved one end part 43 of the retainer 41 serves as one through part 45 through which the tip end of the personal ornament 24 can pass.

The other end part 44 of the retainer 41 is bent circularly in the direction opposite to the one end part 43, and the inner diameter of the bent portion is slightly larger than the outer diameter of the personal ornament 24. There is formed a gap which is smaller than the outer diameter of the personal ornament 24 between the linear central part 42 of the retainer 41 and a tip end of the other end part 44. With the formation of the gap, a circular space portion inside the curved other end part 44 of the retainer 41 serves as the other through part 46 through which the tip end of the personal ornament 24 can pass.

Figure 12:
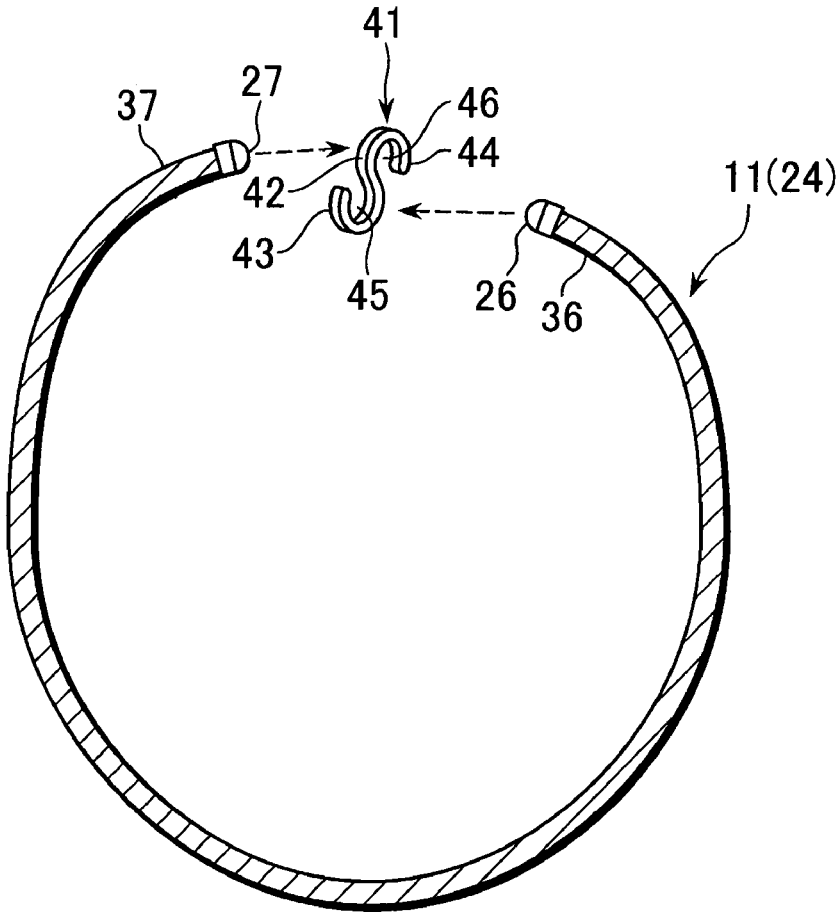
FIG. 12 is a view for explaining an example of a wearing process using the retainer shown in FIG. 11.

FIG. 12 is a view for explaining an example of a wearing process using the retainer 41 shown in FIG. 11. The wearing process enhances the retaining of the personal ornament 24 around the neck with more assurance by use of the retainer 41 with the wearing process shown in FIG. 7, that is, the wearing process wherein the personal ornament 24 is worn around the neck 34 of the wearer 33 while the one end side 36 and other end side 37 of the personal ornament 24 are overlapped with each other at the backside of the neck 34 to be retained with the magnetic force.

That is, as shown in FIG. 12, the wearer 33 grasps the one end side 36 and other end side 37 of the personal ornament 24, and raises the personal ornament 24 from the front side lower portion to the upper portion of the neck 34, and turns both ends of the personal ornament 24 at the backside of the neck 34 by way of the upper portion of the shoulder. Then the one end side 36 of the personal ornament 24 is caused to pass through the one through part 45 of the S-shaped retainer 41 as shown in a left-pointing arrow. Further, the one end side 37 of the personal ornament 24 is caused to pass through the other through part 46 of the retainer 41 as shown in right-pointing arrow.

Figure 13:
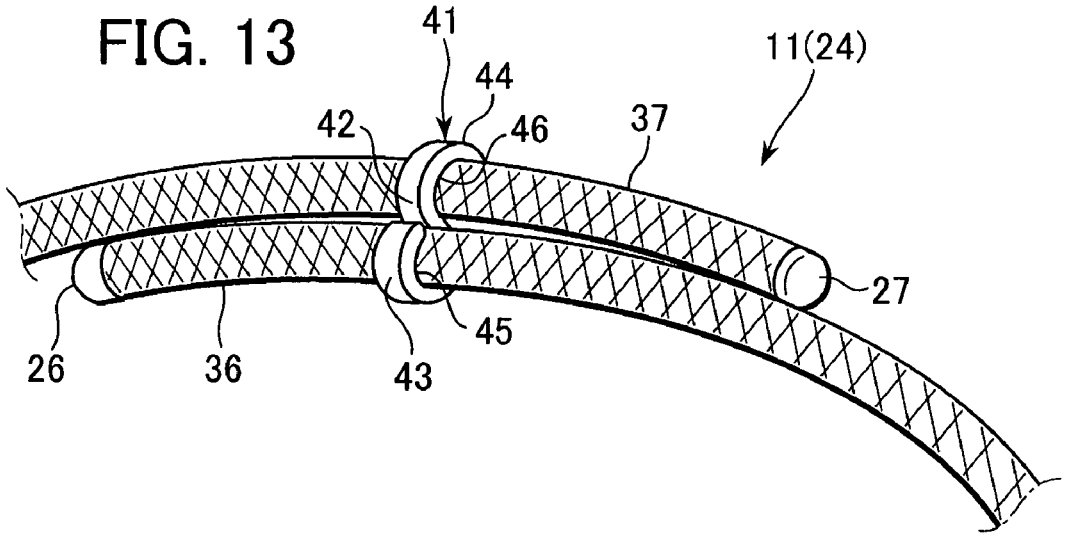
FIG. 13 is an enlarged view showing an example of a wearing state using the retainer shown in FIG. 11.

FIG. 13 is an enlarged view showing an example of a wearing state of the personal ornament 24 using the retainer 41 subsequently to the state shown in FIG. 12. As shown in FIG. 13, the one end side 36 of the personal ornament 24 passed through the one through part 45 of the Retainer 41 is held from the periphery by the linear central part 42 of the retainer 41 and the tip end of the one end part 43. Accordingly, the one end side 36 of the personal ornament 24 is not transversely come off.

The other end side 37 of the personal ornament 24 passed through the other through part 46 of the Retainer 41 is held from the periphery by the central part 42 of the retainer 41 and the tip end of the other end part 44. Accordingly, the other end side 37 of the personal ornament 24 is not transversely come off.

As mentioned above, the personal ornament 24 retained by the Retainer 41 is rendered in an adhesion state with the magnetic attraction force of the magnets while it is prevented from being come off more reliably in a peripheral direction with a holding force of the retainer 41. Accordingly, there is no fear of losing the personal ornament 24 caused by sudden dropping-off and so forth and it is not come off by tearing the personal ornament 24 from the outside of the wearer, so that theft and so forth can be prevented with assurance. Meanwhile, when the wearer removes the personal ornament personal ornament 24 from the body, it can be removed with ease by merely drawing out the one end side 36 or other end side 37 of the personal ornament 24 from the through parts 45 and 46 of the retainer 41 in an axial direction.

Figure 14:
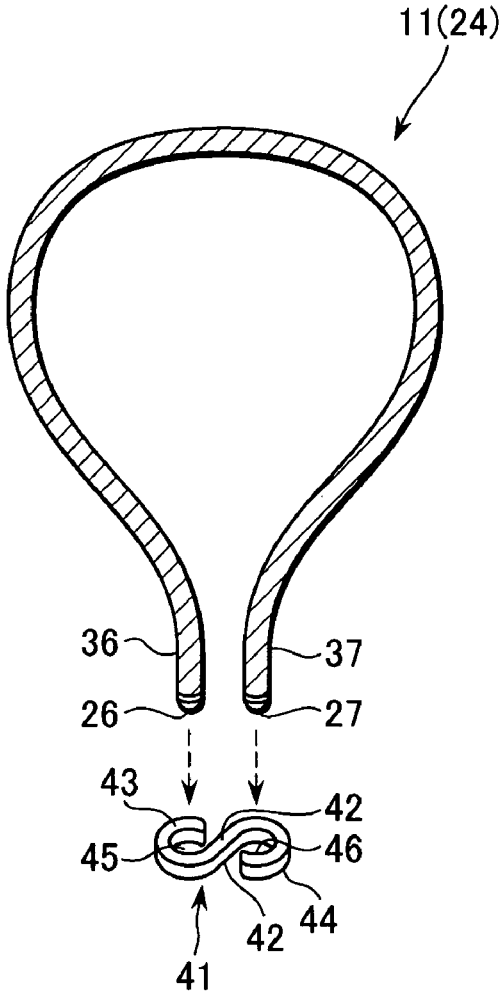
FIG. 14 is a view for explaining another example of a wearing process using the retainer shown in FIG. 11.

FIG. 14 is a view for explaining of another example of the wearing process using the retainer 41 shown in FIG. 11. According to the wearing process, the personal ornament 24 can be retained around the neck with more assurance using the retainer 41 in the wearing process shown in FIG. 9, that is, the personal ornament 24 is worn in the manner that the personal ornament 24 is turned from the back side of the neck 34 of the wearer 33 toward the front of the neck 34 while the one end side 36 and other end side 37 of the personal ornament 24 are rendered in a vertical state in front of the neck 34 to be overlapped with each other from the right and left so as to be retained by magnets.

That is, as shown in FIG. 14, the wearer grasps the one end side 36 and other end side 37 of the personal ornament 24, turns the personal ornament 24 from the backside of the neck to both sides, then turns it to the front of the neck by way of the upper portion of the shoulder. Then, the one end side 36 of the personal ornament 24 is caused to pass through the one through part 45 of the Retainer 41 while it is laterally directed as shown in a down-pointing arrow in FIG. 14. Further, the other end side 37 of the personal ornament 24 is caused to pass through the other through part 46 of the laterally directed Retainer 41 as shown in the down-pointing arrow.

Figure 15:
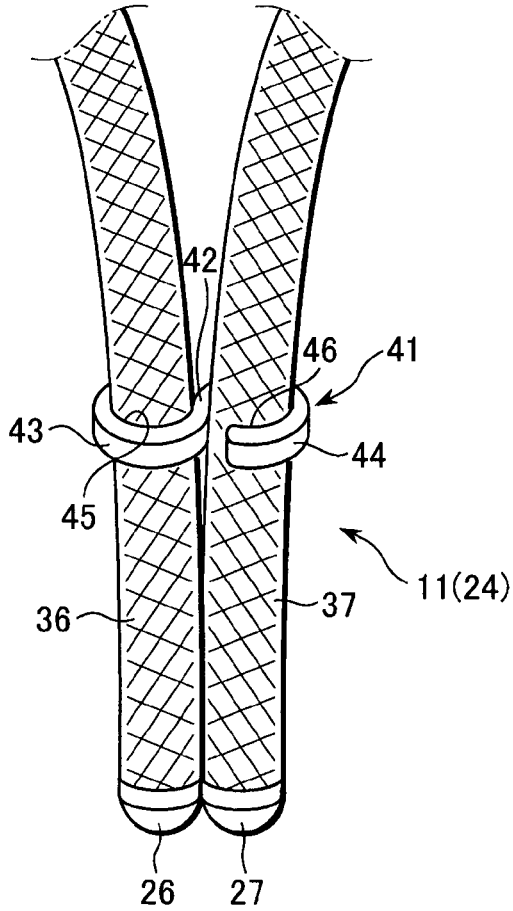
FIG. 15 is an enlarged view showing another example of a wearing state using the retainer shown in FIG. 11.

FIG. 15 is an enlarged view showing an example of a wearing state using the retainer 41 followed by the operation shown in FIG. 14. As shown in FIG. 15, the one end side 36 of the personal ornament 24 which passed through the one through part 45 of the laterally directed retainer 41 from above is held from the periphery by the central part 42 of the retainer 41 and the tip end of the one end part 43. Accordingly, the one end side 36 of the personal ornament 24 is not transversely come off.

The other end side 37 of the personal ornament 24 which is passed through the other through part 46 of the laterally directed Retainer 41 from above is held from the periphery by the central part 42 of the retainer 41 and the tip end of the other end part 44. Accordingly, the other end side 37 of the personal ornament 24 is not transversely come off.

Even in this example, the personal ornament 24 retained by S-shaped retainer 41 is rendered in an adhesion state by the magnetic attraction force of the magnets while it is prevented from being come off more reliably in a peripheral direction with a holding force of the retainer 41.

Accordingly, there is no fear of losing the personal ornament 24 caused by sudden dropping-off and so forth and it is not come off by tearing the personal ornament 24 from the outside of the wearer, so that theft and so forth can be prevented with assurance. Meanwhile, when the wearer removes the personal ornament personal ornament 24 from the body, it can be removed with ease by merely pulling out the one end side 36 or other end side 37 of the personal ornament 24 from the through parts 45 and 46 of the retainer 41 in the upward direction.

Figure 16:
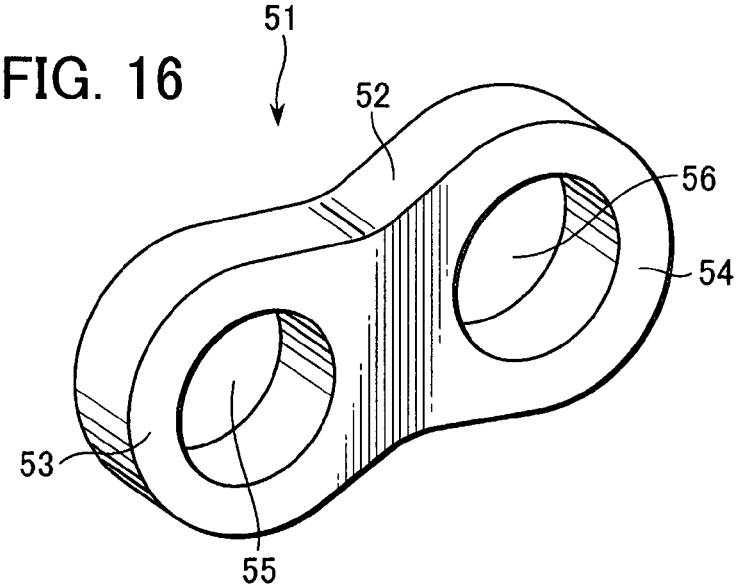
FIG. 16 is a perspective view showing another example of a retainer of the personal ornament according to the first embodiment of the invention.

FIG. 16 is a perspective view showing another example of the retainer of the personal ornament 24 according to the first embodiment of the invention. As shown in FIG. 16, a retainer 51 is molded out of a material such as a metal or a resin and so forth. The retainer 51 is formed substantially in the shape of eyeglasses as viewed from the side surface. That is, a frame body 52 of the retainer 51 is in the shape of the number "8", and one end side frame portion 53 has an inner diameter which is slightly larger than the outer diameter of the personal ornament 24, and is formed in a circular shape. As a result, the circular space portion inside the one end side frame portion 53 of the retainer 51 serves as one through part 55 through which the tip end of the personal ornament 24 can pass.

Further, other end side frame portion 54 of the retainer 51 is formed in a circular shape like the one end side frame portion 53, and an inner diameter of the other end side frame portion 54 is slightly larger than the outer diameter of the personal ornament 24. As a result, the circular space portion inside the curved other end side frame portion 54 of the retainer 51 serves as one through part 56 through which the tip end of the personal ornament 24 can pass.

Figure 17:
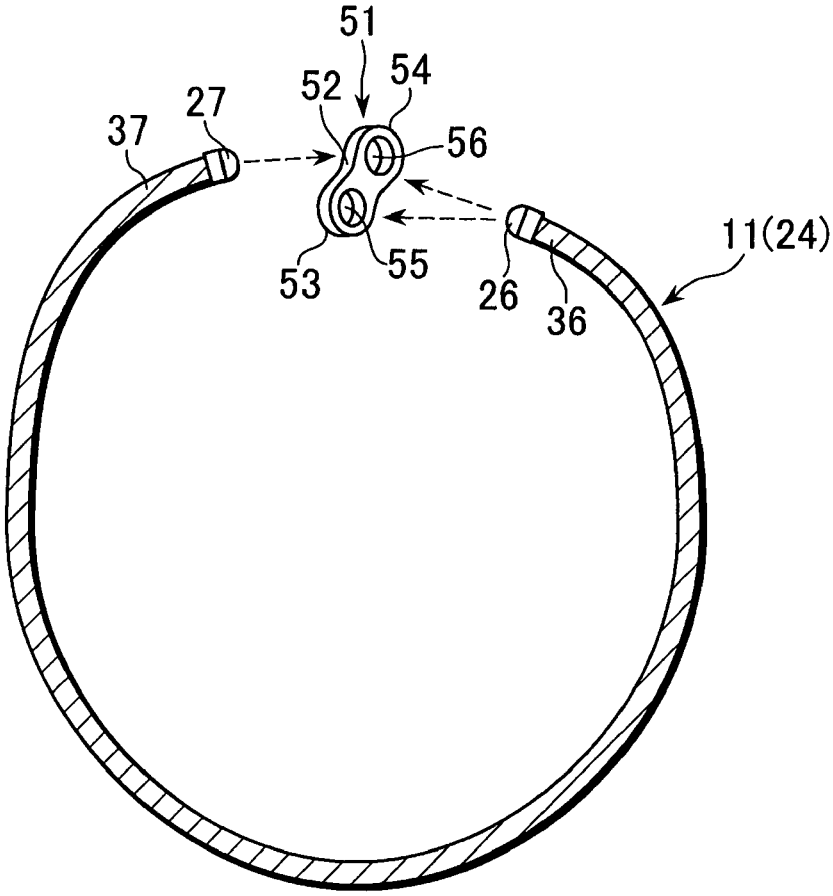
FIG. 17 is a view for explaining an example of a wearing process using the retainer shown in FIG. 16.

FIG. 17 is a view for explaining an example of a wearing process using the retainer 51 shown in FIG. 16. This wearing process is an improvement of the wearing process shown in FIG. 7 wherein the personal ornament 24 is worn around the neck 34 of the wearer 33 while the one end side 36 and other end side 37 of the personal ornament 24 are overlapped with each other at the backside of the neck 34 to be retained with the magnetic force, namely, the personal ornament 24 can be retained around the neck by use of the retainer 51 with more assurance.

That is, as shown in FIG. 17, the wearer grasps the one end side 36 and other end side 37 of the personal ornament 24 and raises the personal ornament 24 from the front lower portion of the neck 34 in the upward direction, and turns both ends of the personal ornament 24 at the backside of the neck 34 from the upper portion of the shoulder 35. Then, the one end side 36 of the personal ornament 24 is caused to pass through the one through part 55 of the retainer 51 while the other end side 37 of the personal ornament 24 is caused to pass through the other through part 56 of the retainer 51 as shown in right-pointing arrow.

Figure 18:
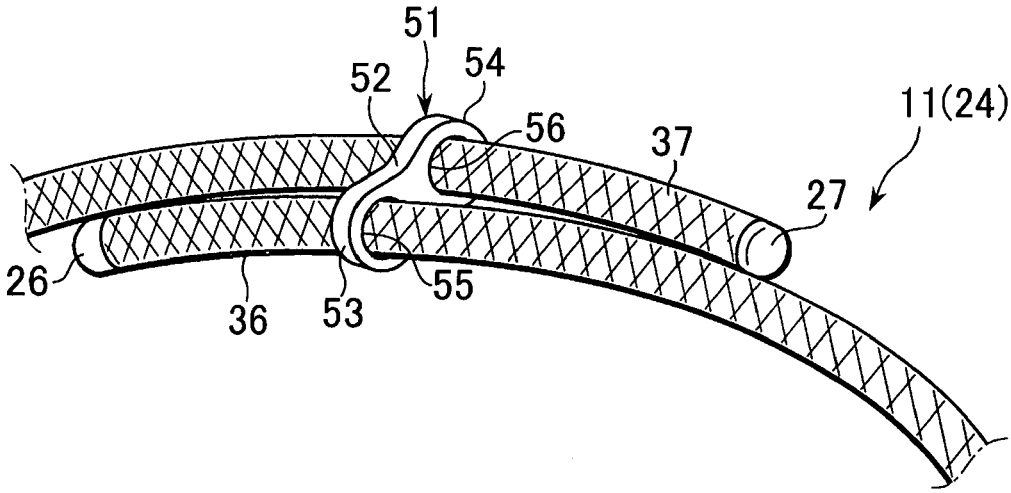
FIG. 18 is an enlarged view showing an example of a wearing state using the retainer shown in FIG. 16.

FIG. 18 is an enlarged view showing an example of a wearing state using the retainer 51 followed by the operation shown in FIG. 17. As shown in FIG. 18, the one end side 36 of the personal ornament 24 passed through the one through portion 55 of the retainer 51 is held by the one through portion 55 of the retainer 51 from the periphery thereof. Accordingly, the one end side 36 of the personal ornament 24 is not transversely come off.

Further, the other end side 37 of the personal ornament 24 passed through the 56 of the retainer 51 is held by the 56 of the frame body 52 of the retainer 51 from the periphery thereof. Accordingly, the other end side 37 of the personal ornament 24 is not transversely come off.

As described above, the personal ornament 24 retained by the retainer 51 is rendered in an adhesion state by the magnetic attraction force of the magnets while it is prevented from being come off more reliably in a peripheral direction with a holding force of the retainer 51 compared with the case of using the retainer 41 as shown in FIG. 11. Accordingly, there is no fear of losing the personal ornament 24 caused by sudden dropping-off and so forth and it is not come off by tearing the personal ornament 24 from the outside of the wearer, so that theft and so forth can be prevented with more assurance. Meanwhile, when the wearer removes the personal ornament personal ornament 24 from the his or her body, it can be removed with ease by merely pulling out the one end side 36 or other end side 37 of the personal ornament 24 from the through parts 55 and 66 of the retainer 51 in the axial direction.

Figure 19:
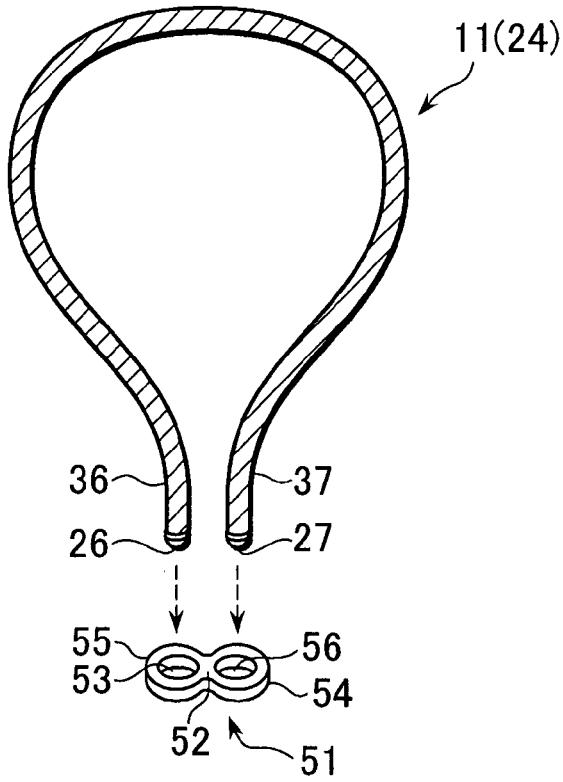
FIG. 19 is a view for explaining another example of a wearing process using the retainer shown in FIG. 16.

FIG. 19 is a view for explaining of another example of the wearing process using the retainer 51 shown in FIG. 16. This wearing process is an improvement of the wearing process shown in FIG. 9 wherein the personal ornament 24 is worn in the manner that the personal ornament 24 is turned from the back side of the neck 34 of the wearer 33 toward the front of the neck 34 to hang while the one end side 36 and other end side 37 of the personal ornament 24 are rendered in a vertical state in front of the neck 34 to be overlapped with each other from the right and left so as to be retained by a magnetic force, namely, the personal ornament 24 can be retained around the neck by use of the retainer 51 with more assurance.

That is, as shown in FIG. 19, the wearer grasps the one end side 36 and other end side 37 of the personal ornament 24, turns the personal ornament 24 from the backside of the neck to both sides, then turns it to the front of the neck by way of the upper portion of the shoulder. Then, the one end side 36 of the personal ornament 24 is caused to pass through the one through part 55 of the retainer 51 while it is laterally directed as shown in a down-pointing arrow in FIG. 19. Further, the other end side 37 of the personal ornament 24 is caused to pass through the other through part 56 of the laterally directed retainer 51 as shown in the down-pointing arrow.

Figure 20:
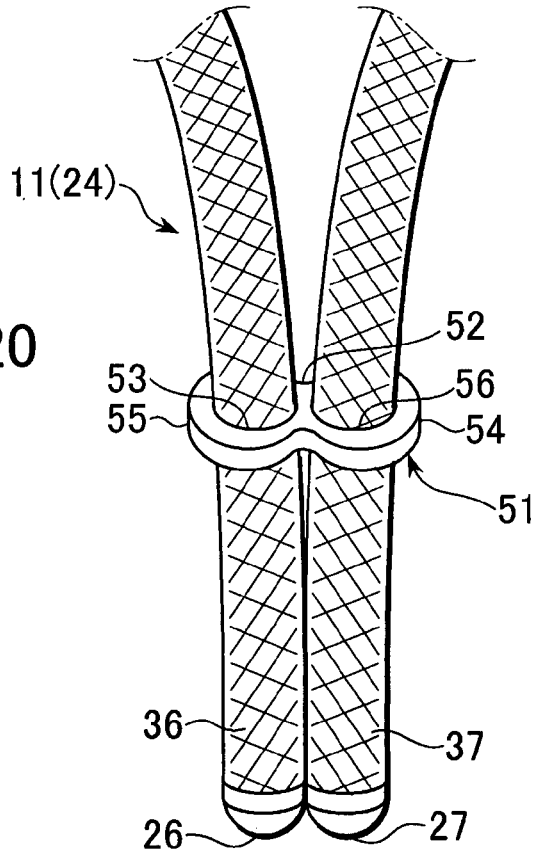
FIG. 20 is an enlarged view showing another example of a wearing state using the retainer shown in FIG. 16.

FIG. 20 is an enlarged view showing an example of a wearing state using the retainer 51 followed by the operation shown in FIG. 19. As shown in FIG. 15, the one end side 36 of the personal ornament 24 which is passed through the one through part 45 of the laterally directed Retainer 41 from above is held from the periphery by the central part 42 of the retainer 41 and the tip end of the one end part 43. Accordingly, the one end side 36 of the personal ornament 24 is not transversely come off.

The other end side 37 of the personal ornament 24 which is passed through the other through part 56 of the laterally directed retainer 51 from above is held by the other through part 56 of the laterally directed retainer 51 from the periphery thereby. Accordingly, the other end side 37 of the personal ornament 24 is not transversely come off.

Even in this example, the personal ornament 24 retained by the retainer 51 having the shape of the eyeglasses is rendered in an adhesion state by the magnetic attraction force of the magnets while it is prevented from being come off more reliably in a peripheral direction with a holding force of the retainer 51. Accordingly, there is no fear of losing the personal ornament 24 caused by sudden dropping-off and so forth and it is not come off by tearing the personal ornament 24 from the outside of the wearer, so that theft and so forth can be prevented with more assurance. Meanwhile, when the wearer removes the personal ornament personal ornament 24 from the his or her body, it can be removed with ease by merely pulling out the one end side 36 or other end side 37 of the personal ornament 24 from the through parts 55 and 66 of the retainer 51 in the upward direction.

Although the outer covering 25 is configured to be independent from the tube 12 in the first embodiment, it can be integrally structured by processing the surface portion of the tube 12 or by being embedded in or adhered onto the surface portion of the tube 12.

Figure 21:
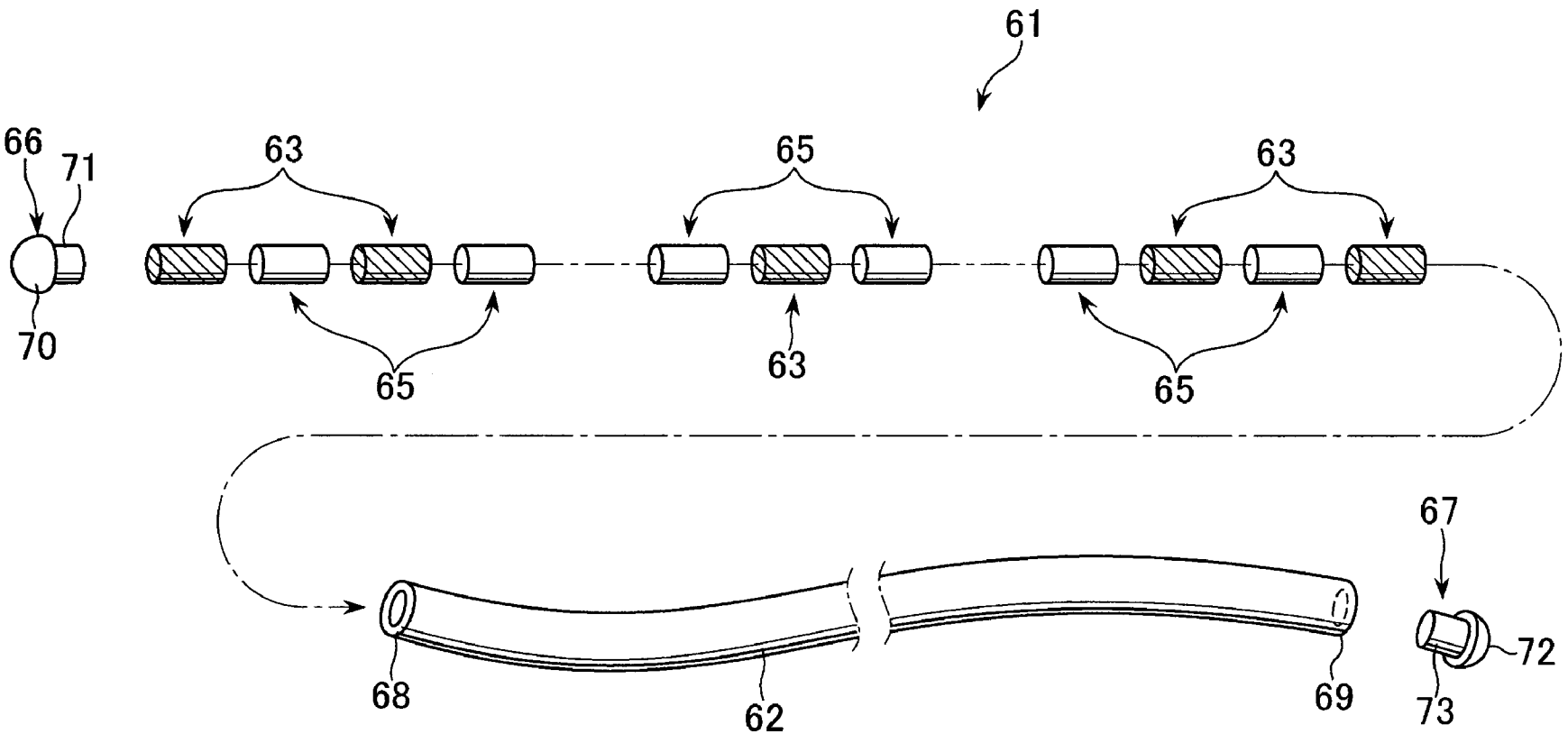
FIG. 21 is an exploded perspective view showing a personal ornament body according to a second embodiment of the invention.
Figure 22:
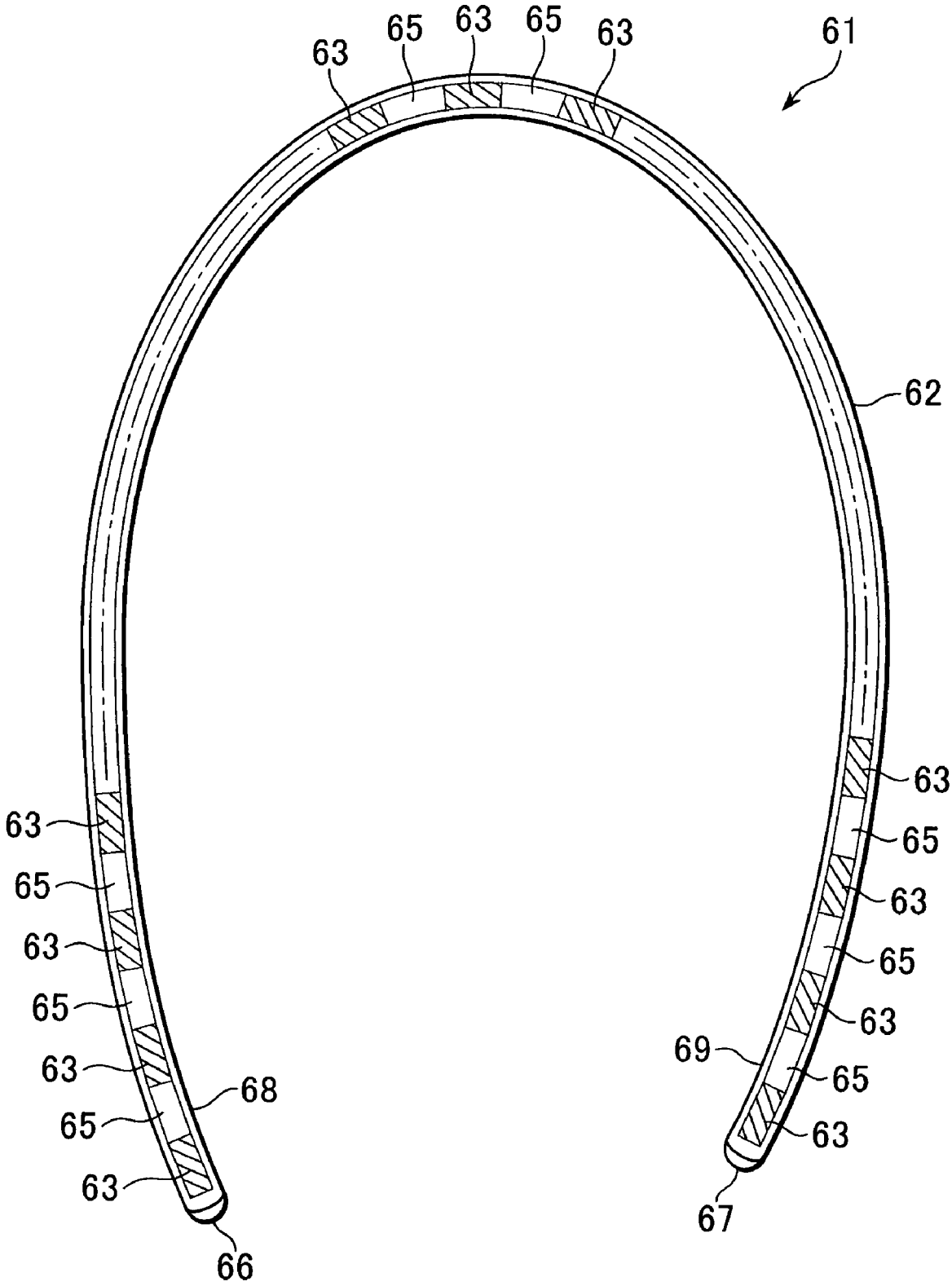
FIG. 22 is an entire sectional view showing the personal ornament body according to the second embodiment of the invention.

Second Embodiment (FIG. 21 and FIG. 22)

FIG. 21 is an exploded perspective view showing configuration of components of a personal ornament body according to the second embodiment of the invention. As shown in FIG. 21, a personal ornament body 61 according to the second embodiment comprises one string-shaped tube 62 which is opened at both ends, a plurality of magnets 63 . . . which are inserted in the tube 62, a plurality of spacers 65 . . . which are alternately inserted into the tube 62 together with the magnets 63 . . . , one end side cap 66 for closing one end side opening 68 of the tube 12, and other end side cap 67 for closing other end side opening 69 of the tube 62.

The tube 62 is set at a given length capable of being worn around a neck of a user who wears a personal ornament body 61, and is structured in a circular tube by a flexible material such as a flexible synthetic resin, rubber and so forth. With such a configuration, the tube 62 can be easily twisted not less than 180 degrees relatively about the center of axis between both ends thereof along the longitudinal direction, and also easily bent by being wound around the neck of the user and also it can be ring-shaped. A tensile strength of the tube 62 is preferable to an extent not to be easily ruptured by a human power. The tube 62 is also preferable to have various decorative effects such as a transparent body, a half-transparent body, or a colored body and so forth.

The magnets 63 . . . are configured to have the same diameter and length and are columnar in shape, and they are inserted into the tube 62 across the tube 62 in the longitudinal direction thereof. When the magnets 63 . . . , are inserted into the tube 62, the center of the tube 62 is rendered in a state to be aligned with the center of the magnets 63 . . . . Further, the magnets 63 . . . each are inserted into the tube 62 along the longitudinal direction of the tube 62, and tandemly arranged therein while they are opposed to each other in an axial direction.

The magnets 63 . . . are made of a metallic magnet, for example, a ferrite magnet having a strong magnetic attraction force (e.g. 2000 gauss). The magnets 63 . . . generate the magnetic attraction force mutually at the portion where the one end side opening 68 and other end side opening 69 of the tube 62 are overlapped or crossed with each other.

At the intermediate portion of the tube 62, and the magnets 63 . . . are used mainly around the neck of the user, and strong magnetic attraction force is not always needed in the case where they do not function as a retainer means of the tube 62.

The spacers 65 . . . are alternately inserted into the tube 62, e.g. together with the magnets 63 . . . , and the spacers 65 . . . have the same diameter and length and are columnar in shape and they are also inserted into the tube 62 along the longitudinal direction of the tube 62, and tandemly arranged therein while they are opposed to each other in an axial direction like the magnets 63 . . . .

The spacers 65 . . . are made of various materials such as a magnetic material, non-magnetic material and so forth. For example, as a material of the spacers 65 . . . , iron and other iron-based metal such as a stainless steel and so forth can be used. In this case, the line of magnetic force of the magnets 63 . . . pass well in the longitudinal direction. Further, as a material of the spacers 65 . . . , non-ferrous metal other than iron-based metal, e.g. titanium and so forth can be used.

As the spacers 65 . . . , precious metals such as gold, silver and so forth can be used. If these precious metals are used, gorgeousness and massiveness can be obtained. Further, precious stones such as hematite can be used for the spacer s 65 . . . . If the precious stones are used, sense of use can be enhanced.

The one end side cap 66 comprises a hemispherical cap main body 70 having a diameter same as the outer diameter of the tube 62, and a columnar insertion part 71 having a diameter same as a diameter of a hole of the tube 62 and protruding from a flat surface of the cap main body 70. When the columnar insertion part 71 of the one end side cap 66 is inserted into the one end side opening 68 of the tube 62, the one end side opening 68 can be closed by the cap main body 70.

Likewise, the other end side cap 67 comprises a hemispherical cap main body 72 having a diameter same as the outer diameter of the tube 62, and a columnar insertion part 63 having a diameter same as the diameter of the hole of the tube 62 and protruding from a flat surface of the cap main body 72. When the columnar insertion part 73 of the other end side cap 67 is inserted into the other end side opening 69 of the tube 62, the other end side opening 69 can be closed by the cap main body 72.

FIG. 22 is an entire sectional view showing a state where components shown in FIG. 21 are assembled as the personal ornament body 61. In FIG. 22, the personal ornament body 61 is shown in an inverted U-shaped curved state. As shown in FIG. 22, a plurality of one end side magnets 63 . . . and spacers 65 . . . are inserted into the other end side opening 68 of the tube 62 while tandemly and alternately arranged one by one, and a plurality of other end side magnets . . . 63 and spacers 65 . . . are inserted into the other end side opening 69 of the tube 62 while tandemly arranged. A plurality of intermediate magnets 63 . . . and spacers 65 . . . are inserted into the portion other than the one end side opening 68 and other end side opening 69 into which the one end side magnets 63 . . . and spacers 65 . . . are inserted, i.e., into the intermediate portion of the tube 62 while tandemly and alternately arranged one by one. In such a manner, the one end side magnets 63 . . . and spacers 65 . . . are tandemly arranged in the entire range of the tube 62 in the longitudinally direction thereof. Whereupon, the one end side magnets 63 . . . and spacers 65 . . . are not always tandemly and alternately arranged one by one, e.g. two one end side magnets 63 . . . and one spacer 65 are tandemly and alternately arranged or they are arranged for every arbitrary number.

Meanwhile, when the one end side magnets 63 . . . , other end side magnets 63 . . . and intermediate magnets 63 . . . are inserted into the tube 62 in a state where the end surfaces thereof in an axial direction are pressed to contact each other, there is no space for these end surfaces to be inclined, causing the tube 62 not to be bent. Accordingly, there are secured given gaps between the one end side magnets 63 . . . , between the other end side magnets 63 . . . , between the one end side magnets 63 . . . , other end side magnets 63 . . . and the intermediate magnets 63 . . . , and between the intermediate magnets 63 . . . , whereby the one end side magnets 63 . . . , other end side magnets 63 . . . and intermediate magnets 63 . . . can be inclined respectively, causing the tube 62 to be bent.

The one end side opening 68 and other end side opening 69 of the tube 62 are closed by the one end side cap 66 and other end side cap 67, respectively, and they are fixed by adhesion, a screw structure and so forth. As a result, the one end side magnets 63 . . . , other end side magnets 63 . . . and so forth are prevented from being come off the one end side cap 66 and other end side cap 67 of the tube 62.

According to the second embodiment of the invention, it is configured that the spacers 65 . . . and magnets 63 . . . are alternately inserted into the tube 62 so that various functions can be obtained. That is, as described above, as a material of the spacers 65 . . . , if iron and other iron-based metal such as a stainless steel and so forth is used, the line of magnetic force of the magnets 63 . . . passes well in the longitudinal direction thereof. Further, if non-ferrous metals other than iron-based metal, e.g. titanium and so forth are used as the material of the spacers 65 . . . , high quality can be obtained. If precious metals such as gold, silver and so forth are used as the spacers 65 . . . , gorgeousness and massiveness can be obtained. Still further, if precious stones such as hematite are used as the spacers 65 . . . , sense of use can be enhanced.

Figure 23:
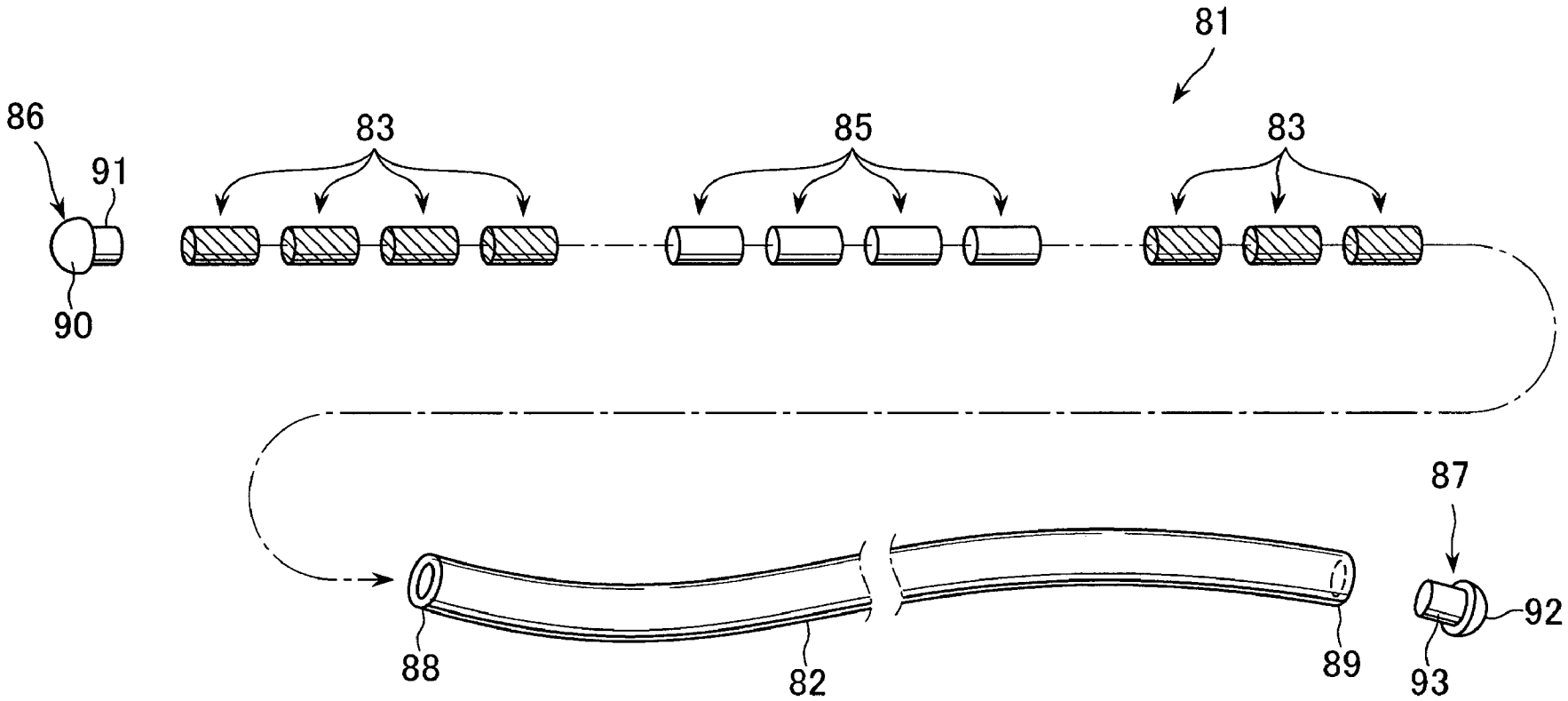
FIG. 23 is an exploded perspective view showing a personal ornament body according to a third embodiment of the invention.
Figure 24:
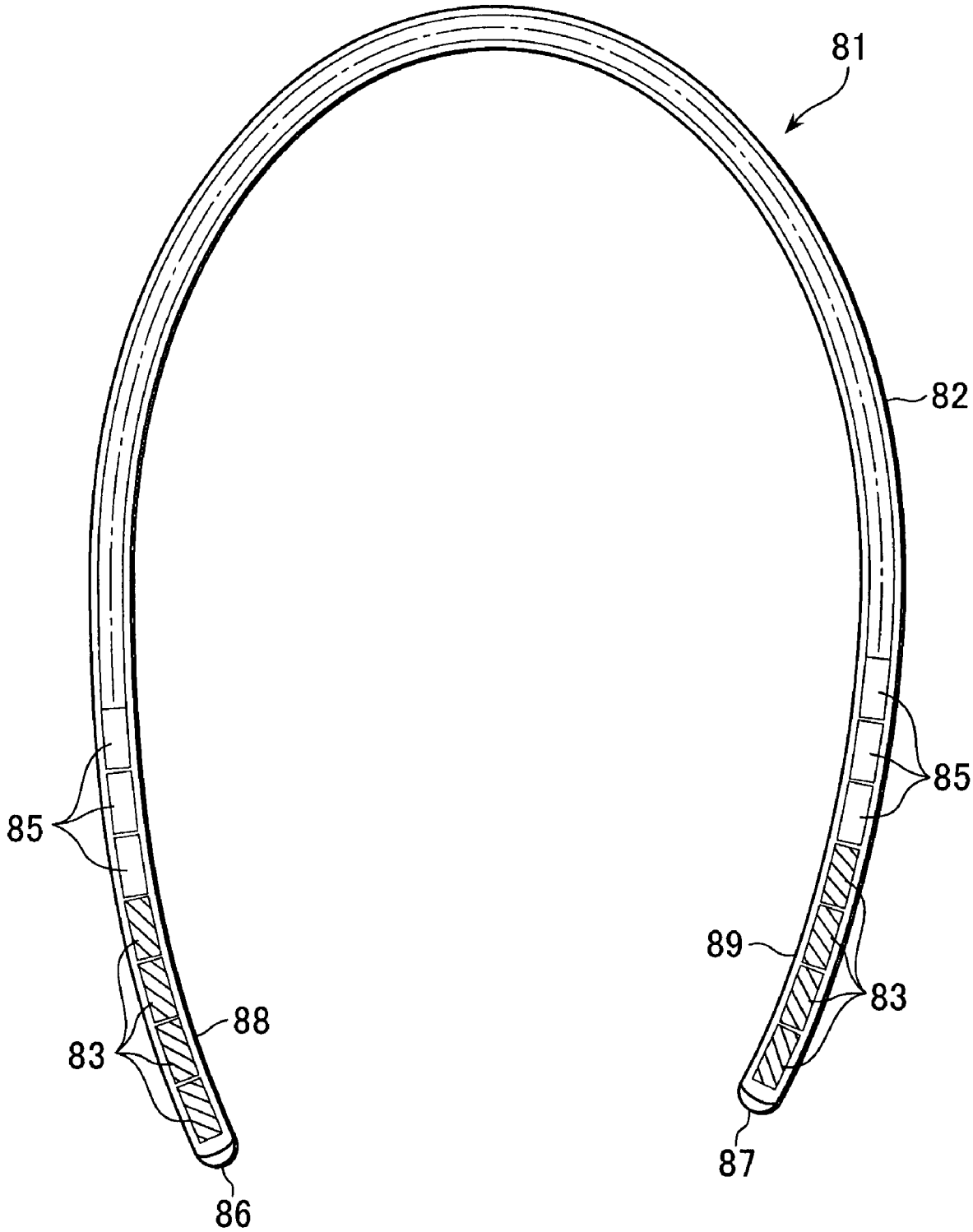
FIG. 24 is an entire sectional view showing the personal ornament body according to the third embodiment of the invention.

Third Embodiment (FIG. 23 and FIG. 24)

FIG. 23 is an exploded perspective view showing a configuration of components of a personal ornament according to the third embodiment of the invention. As shown in FIG. 23, a personal ornament body 81 according to the third embodiment comprises one string-shaped tube 82 which is opened at both ends, a plurality of magnets 83 . . . which are inserted into one end side and other end side of the tube 82, a plurality of spacers 85 . . . which are inserted into the intermediate portion other than the one end side and other end side of the tube 82, one end side cap 86 for closing one end side opening 88 of the tube 82, and other end side cap 87 for closing other end side opening 89 of the tube 82.

The tube 82 is set at a given length capable of being worn around a neck of a user who wears a personal ornament body 81, and is structured in a circular tube by a flexible material such as a flexible synthetic resin, rubber and so forth. With such a configuration, the tube 82 can be easily twisted not less than 180 degrees relatively about the center of axis between both ends thereof along the longitudinal direction, and also easily bent by being wound around the neck of the user and also it can be ring-shaped. A tensile strength of the tube 82 is preferable to an extent not to be easily ruptured by a human power. The tube 82 is also preferable to have various decorative effects such as a transparent body, a half-transparent body, or a colored body and so forth.

The magnets 83 . . . are configured to have the same diameter and length and are columnar in shape, and they are arranged at one end side and other end side of the tube 82 in the longitudinal direction thereof by a predetermined number while they are adjacent to each other. When the magnets 83 . . . are inserted into the tube 82, the center of the tube 82 is rendered in a state to be aligned with the center of the magnets 83 . . . . Further, the magnets 83 . . . each are inserted into the tube 82 along the longitudinal direction of the tube 82, and tandemly arranged therein while they are opposed to each other in an axial direction in a state where the tube 82 is wound around the neck of the user.

The magnets 83 . . . are made of a metallic magnet, for example, a ferrite magnet having a strong magnetic attraction force (e.g. 2000 gauss). The magnets 83 . . . generate the magnetic attraction force mutually at the portion where the one end side opening 88 and other end side opening 89 of the tube 82 are overlapped or a crossed with each other.

The spacers 85 . . . are arranged at the portion other than the portion where the magnets 83 . . . are arranged in the tube 82, i.e. an intermediate portion of the tube 82 other than the one end side and other end side of the tube 82. The spacers 85 . . . have the same diameter and length and are columnar in shape and they are also inserted into the tube 82 along the longitudinal direction of the tube 82, and tandemly arranged therein while they are opposed to each other in an axial direction like the magnets 83 . . .

The spacers 85 . . . are made of various materials such as a magnetic material, non-magnetic material and so forth. For example, as a material of the spacers 85 . . . , iron and other iron-based metal such as a stainless steel and so forth can be used. In this case, the line of magnetic force of the magnets 83 . . . passes well in the longitudinal direction. Further, as a material of the spacers 85 . . . , non-ferrous metal other than iron-based metal, e.g. titanium and so forth can be used.

As the spacers 85 . . . , precious metals such as gold, silver and so forth can be used. If these precious metals are used, gorgeousness and massiveness can be obtained. Further, precious stones such as hematite can be used for the spacers 85 . . . If the precious stones are used, sense of use can be enhanced.

The one end side cap 86 comprises a hemispherical cap main body 90 having a diameter same as the outer diameter of the tube 82, and a columnar insertion part 91 having a diameter same as a diameter of a hole of the tube 82 and protruding from a flat surface of the cap main body 90. When the columnar insertion part 91 of the one end side cap 86 is inserted into the one end side opening 88 of the tube 82, the one end side opening 88 can be closed by the cap main body 90.

Likewise, the other end side cap 87 comprises a hemispherical cap main body 92 having a diameter same as the outer diameter of the tube 82, and a columnar insertion part 93 having a diameter same as the diameter of the hole of the tube 82 and protruding from a flat surface of the cap main body 92. When the columnar insertion part 93 of the other end side cap 87 is inserted into the other end side opening 89 of the tube 82, the other end side opening 89 can be closed by the cap main body 92.

FIG. 24 is an entire sectional view showing a state where components shown in FIG. 21 are assembled as the personal ornament body 81. In FIG. 24, the personal ornament body 81 is shown in an inverted U-shaped curved state. As shown in FIG. 24, a plurality of one end side magnets 83 . . . are inserted into the other end side opening 88 of the tube 82 while tandemly arranged, and a plurality of the other end side magnets . . . 83 are inserted into the other end side opening 89 of the tube 82 while tandemly arranged. A plurality of spacers 85 . . . are inserted into the portion other than the one end side opening 88 and other end side opening 89 into which the magnets 83 . . . are inserted, i.e., into the intermediate portion of the tube 82 while tandemly arranged.

Meanwhile, when the one end side magnets 83 . . . , other end side magnets 83 . . . and intermediate side spacers 85 . . . are inserted into the tube 82 in a state where the end surfaces thereof in an axial direction are pressed to contact each other, there is no space for these end surfaces to be inclined, causing the tube 82 not to be bent. Accordingly, there are secured given gaps between the one end side magnets 83 . . . , between the other end side magnets 83 . . . , between the one end side magnets 83 . . . , other end side magnets 83 . . . and the spacers 85 . . . , and between the spacers 85 . . . , whereby the one end side magnets 83 . . . , other end side magnets 83 . . . and spacers 85 . . . can be inclined respectively, causing the tube 82 to be bent.

The one end side opening 88 and other end side opening 89 of the tube 82 are closed by the one end side cap 86 and other end side cap 87, respectively, and they are fixed by adhesion, a screw structure and so forth. As a result, the one end side magnets 83 . . . , other end side magnets 83 . . . and so forth are prevented from being come off the one end side cap 86 and other end side cap 87 of the tube 82.

According to the third embodiment of the invention, since the magnets 83 . . . having a prescribed number are arranged at the one end side and other end side of the tube 82, end portions of the tube 82 themselves can be magnetically and mutually adhered.

Since the third embodiment is configured that the spacers 85 . . . are inserted into the intermediate portion of the tube 82, various functions as the personal ornament body 81 can be obtained. That is, as a material of the spacers 85 . . . , if iron and other iron-based metal such as a stainless steel and so forth is used, the line of magnetic force of the magnets 83 . . . passes well in the longitudinal direction thereof. Further, if non-ferrous metals other than iron-based metal, e.g. titanium and so forth are used as the material of the spacers 85 . . . , high quality can be obtained. If precious metals such as gold, silver and so forth are used as the spacers 85 . . . , gorgeousness and massiveness can be obtained. Still further, if precious stones such as hematite are used as the spacers 85 . . . , sense of use can be enhanced.

Figure 25:
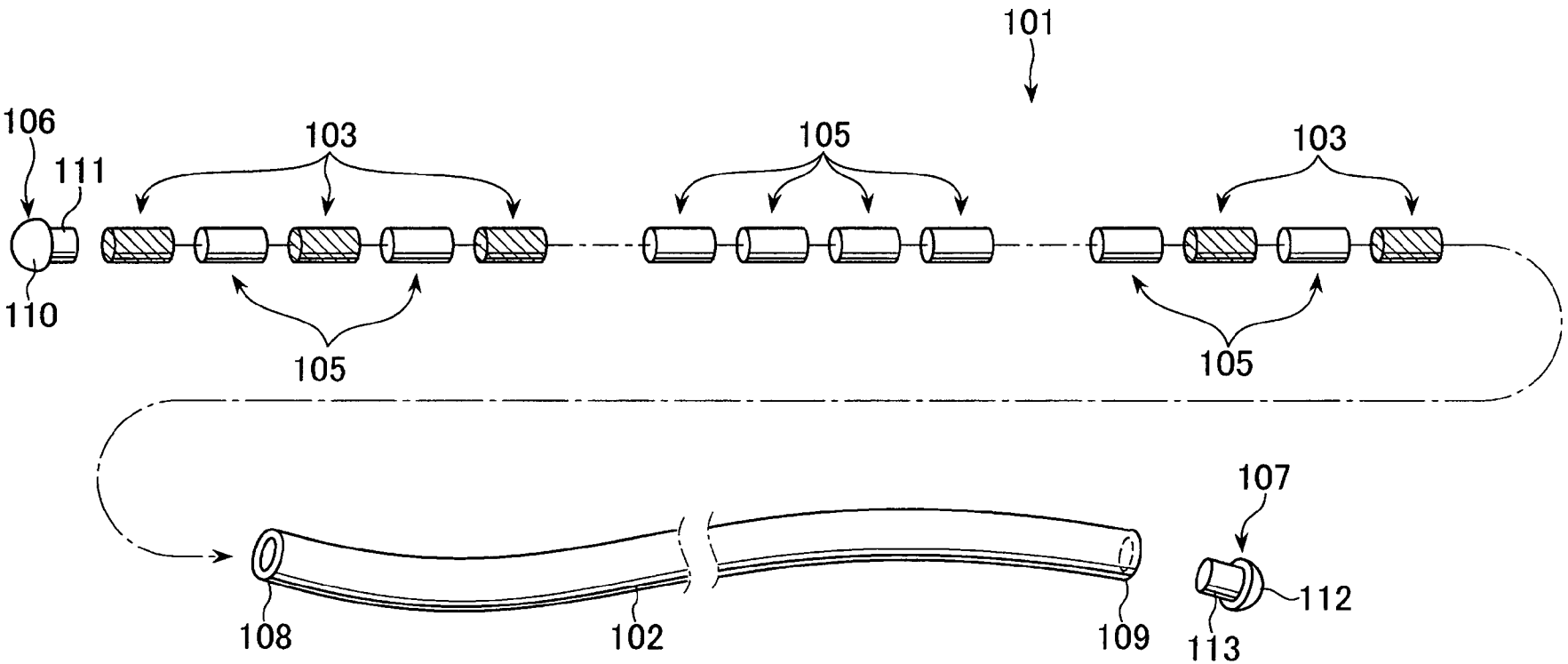
FIG. 25 is an exploded perspective view showing a personal ornament body according to a fourth embodiment of the invention.
Figure 26:
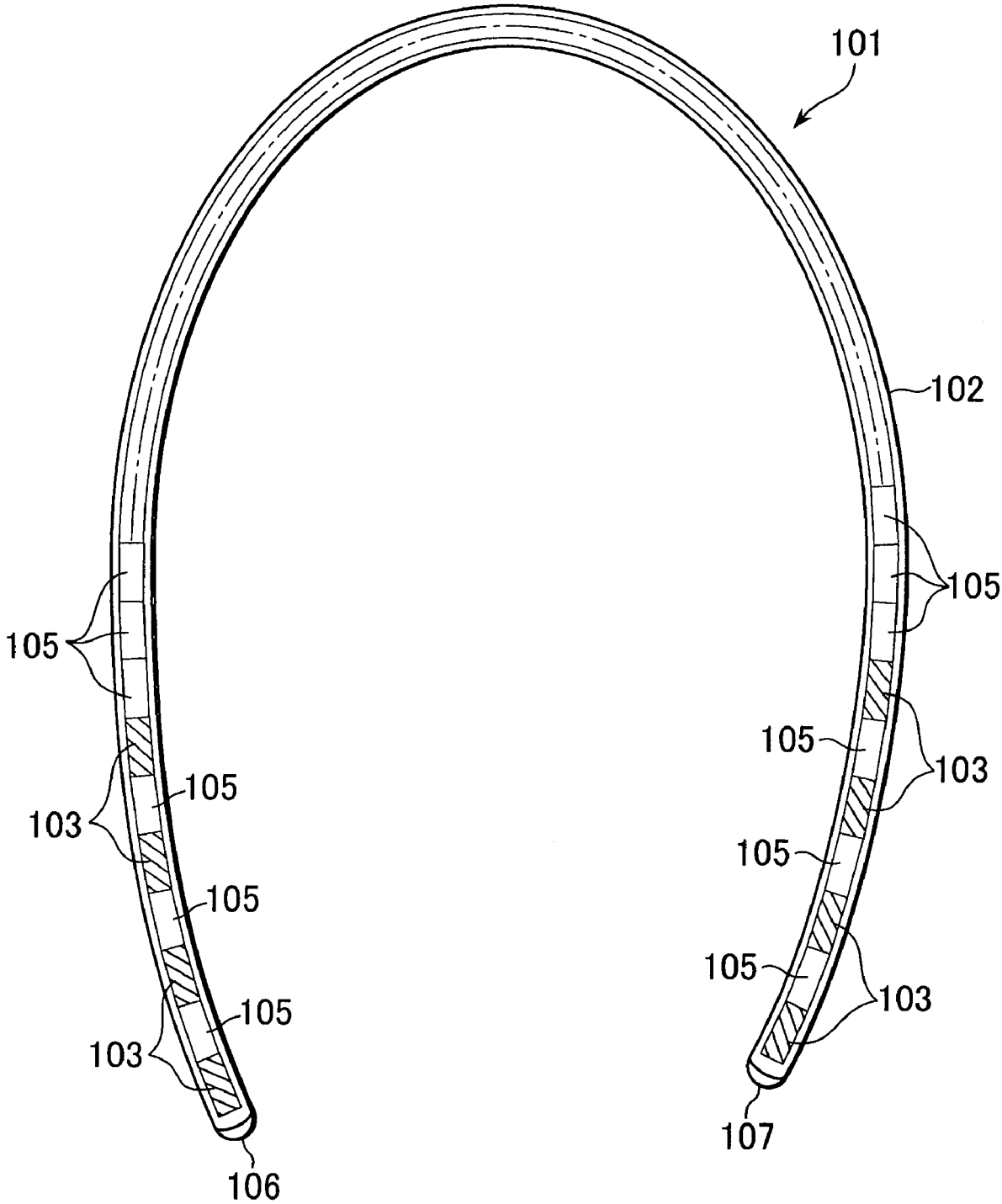
FIG. 26 is an entire sectional view showing the personal ornament body according to the fourth embodiment of the invention.

Fourth Embodiment (FIG. 25 and FIG. 26)

FIG. 25 is an exploded perspective view showing the configuration of components of a personal ornament body according to the fourth embodiment of the invention. As shown in FIG. 25, a personal ornament body 101 according to the fourth embodiment comprises one string-shaped tube 102 which is opened at both ends, a plurality of magnets 103 . . . which are inserted into one end side and other end side of the tube 102, a plurality of spacers 105 . . . which are alternately arranged between the magnets 103 . . . , a plurality of spacers 105 . . . which are inserted into the intermediate portion other than the one end side and other end side of the tube 102, one end side cap 106 for closing one end side opening 108 of the tube 102, and other end side cap 107 for closing other end side opening 109 of the tube 102.

The tube 102 is set at a given length capable of being worn around a neck of a user who wears a personal ornament body 101, and is structured in a circular tube by a flexible material such as a flexible synthetic resin, rubber and so forth. With such a configuration, the tube 102 can be easily twisted not less than 180 degrees relatively about the center of axis between both ends thereof along the longitudinal direction, and also easily bent by being wound around the neck of the user and also it can be ring-shaped. A tensile strength of the tube 102 is preferable to an extent not to be easily ruptured by a human power. The tube 102 is also preferable to have various decorative effects such as a transparent body, a half-transparent body, or a colored body and so forth.

The magnets 103 . . . are configured to have the same diameter and length and are columnar in shape, and they are arranged in the tube 102 at one end side and other end side of the tube 102 in the longitudinal direction thereof by a predetermined number. When the spacers 105 . . . are alternated arranged one by one between the magnets 103 . . . . When the magnets 103 . . . and spacers 105 are inserted into the tube 102, the tubular center of the tube 102 is rendered in a state to be aligned with the center of the magnets 103 and the spacers 105 . . . Further, the magnets 103 . . . and the spacers 105 . . . are inserted into the tube 102 along the longitudinal direction of the tube 102, and tandemly arranged therein while they are opposed to each other in an axial direction.

The magnets 103 . . . are made of a metallic magnet, for example, a ferrite magnet having a strong magnetic attraction force (e.g. 2000 gauss). The magnets 103 . . . generate the magnetic attraction force mutually at the portion where the one end side opening 108 and other end side opening 109 of the tube 102 are overlapped or crossed with each other.

The spacers 105 . . . are arranged at the portion other than the portion where the magnets 103 . . . are arranged in the tube 102, i.e. an intermediate portion of the tube 102 other than the one end side and other end side of the tube 102. The spacers 105 . . . have the same diameter and length and are columnar in shape and they are also inserted into the tube 102 along the longitudinal direction of the tube 102, and tandemly arranged therein while they are opposed to each other in an axial direction like the magnets 103 . . . .

The spacers 105 . . . are made of various materials such as a magnetic material, non-magnetic material and so forth. For example, as a material of the spacers 105 . . . , iron and other iron-based metal such as a stainless steel and so forth can be used. In this case, the line of magnetic force of the magnets 103 . . . passes well in the longitudinal direction. Further, as a material of the spacers 105 . . . , non-ferrous metal other than iron-based metal, e.g. titanium and so forth can be used.

As the spacers 105 . . . , precious metals such as gold, silver and so forth can be used. If these precious metals are used, gorgeousness and massiveness can be obtained. Further, precious stones such as hematite can be used for the spacers 105 . . . . If the precious stones are used, sense of use can be enhanced.

The one end side cap 106 comprises a hemispherical cap main body 110 having a diameter same as the outer diameter of the tube 102, and a columnar insertion part 111 having a diameter same as a diameter of a hole of the tube 102 and protruding from a flat surface of the cap main body 110. When the columnar insertion part 111 of the one end side cap 106 is inserted into the one end side opening 108 of the tube 102, the one end side opening 108 can be closed by the cap main body 110.

Likewise, the other end side cap 107 comprises a hemispherical cap main body 112 having a diameter same as the outer diameter of the tube 102, and a columnar insertion part 113 having a diameter same as the diameter of the hole of the tube 102 and protruding from a flat surface of the cap main body 112. When the columnar insertion part 113 of the other end side cap 107 is inserted into the other end side opening 109 of the tube 102, the other end side opening 109 can be closed by the cap main body 112.

FIG. 26 is an entire sectional view showing a state where components shown in FIG. 25 are assembled as the personal ornament body 101. In FIG. 26, the personal ornament body 101 is shown in an inverted U-shaped curved state. As shown in FIG. 26, a plurality of one end side magnets 103 . . . and the spacers 105 . . . are inserted into the one end side opening 108 of the tube 102 while alternately and tandemly arranged one by one, and a plurality of the other end side magnets . . . 103 and the spacers 105 . . . are inserted into the other end side opening 109 of the tube 102 while alternately and tandemly arranged one by one. A plurality of spacers 105 . . . are inserted into the portion other than the one end side opening 108 and other end side opening 109 into which the magnets 103 . . . and the spacers 105 . . . are inserted, i.e., into the intermediate portion of the tube 102 while tandemly arranged.

Meanwhile, when the magnets 103 . . . and spacers 105 . . . are inserted into the tube 102 in a state where the end surfaces thereof in an axial direction are pressed to contact each other, there is no space for these end surfaces to be inclined, causing the tube 102 not to be bent. Accordingly, there are secured given gaps between the one end side magnets 103 . . . and the spacers 105 . . . , between the other end side magnets 103 . . . and the spacers 105 . . . , between the one end side magnets 103 . . . , other end side magnets 103 . . . and the spacers 105 . . . , and between the spacers 105 . . . , whereby the one end side magnets 103 . . . , other end side magnets 103 . . . and spacers 105 . . . can be inclined respectively, causing the tube 102 to be bent.

The one end side opening 108 and other end side opening 109 of the tube 102 are closed by the one end side cap 106 and other end side cap 107, respectively, and they are fixed by adhesion, a screw structure and so forth. As a result, the one end side magnets 103 . . . and spacers 105 . . . , and the other end side magnets 103 . . . and spacers 105 . . . are prevented from being come off the one end side opening 108 and other end side opening 109 of the tube 102.

According to the fourth embodiment of the invention, since the magnets 103 . . . and spacers 105 . . . having a prescribed number are alternately arranged at the one end side and other end side of the tube 102, end portions of the tube 102 themselves can be magnetically and mutually adhered, and various functions can be obtained owing to the spacers 105 . . . . Since the tube 102 has a configuration wherein the spacers 105 . . . can be inserted into the intermediate portion of the tube 102, various functions as the personal ornament body 101 can be obtained.

That is, as a material of the spacers 105 . . . , if iron and other iron-based metal such as a stainless steel and so forth is used, the line of magnetic force of the magnets 103 . . . passes well in the longitudinal direction thereof. Further, if non-ferrous metals other than iron-based metal, e.g. titanium and so forth are used as the material of the spacers 105 . . . , high quality can be obtained. If precious metals such as gold, silver and so forth are used as the spacers 105 . . . , gorgeousness and massiveness can be obtained. Still further, if precious stones such as hematite are used as the spacers 105 . . . , sense of use can be enhanced.

Figure 27:
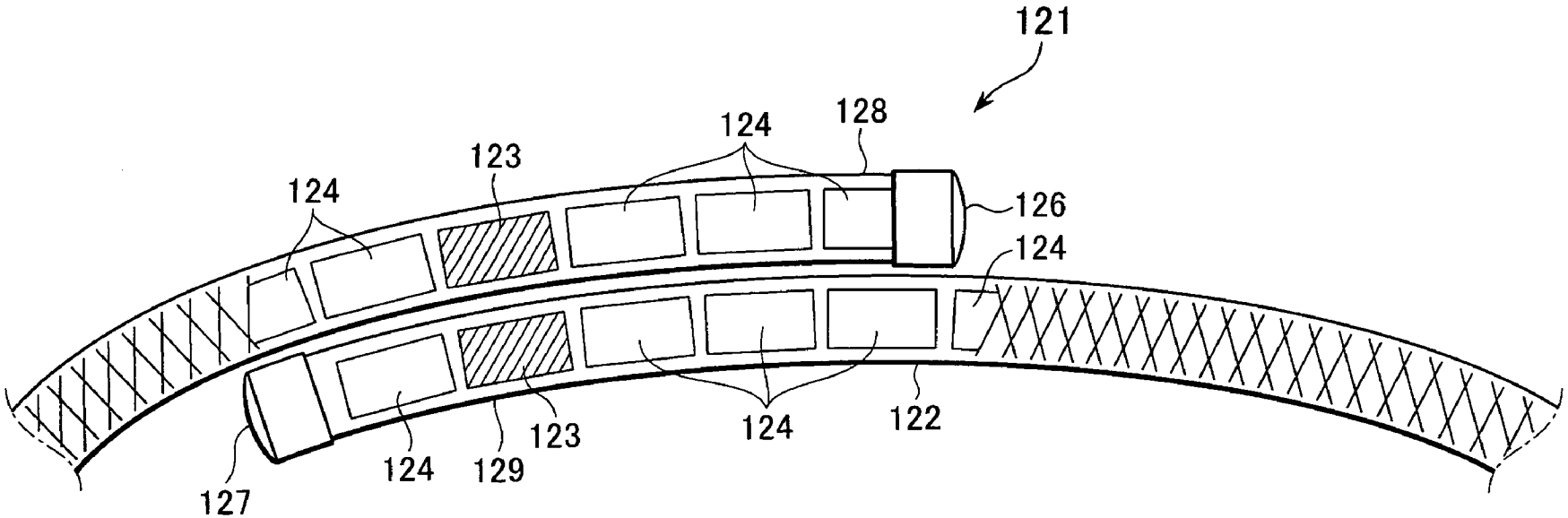
FIG. 27 is an enlarged sectional view showing a personal ornament according to a fifth embodiment of the invention.

Fifth Embodiment (FIG. 27)

FIG. 27 is an enlarged sectional view of a personal ornament according to the fifth embodiment of the invention.

As shown in FIG. 27, a personal ornament 121 of the fifth embodiment have a plurality of magnets 124 which are arranged in the tube 122 at the overlapped portion between one end side 128 and other end side 129.

A plurality of magnets 124 having a prescribed magnetic attraction force and one magnet 123 having a magnetic attraction force which is stronger than that of the magnets 124 are tandemly arranged at one end side 128 of the tube 122. More in detail, the magnets positioned at the first to third from one end side outer cap 126 forms the magnets 124 each having a prescribed magnetic attraction force while one magnet positioned at the fourth from one end side outer cap 126 forms magnet 123 having a stronger magnetic attraction force. The magnet positioned at the fifth from the one end side outer cap 126 forms the magnet magnets 124 having a prescribed magnetic attraction force. In such a manner, the magnets are arranged in the tube 122 in the manner that one magnet 123 having a stronger magnetic attraction force is intervened between a plurality of magnets 124.

Further, a plurality of magnets 124 having a prescribed magnetic attraction force and one magnet 123 having a magnetic attraction force which is stronger than that of the magnets 124 are also tandemly arranged at other end side 129 of the tube 122. More in detail, the magnet positioned at the first from other end side outer cap 127 forms the magnet 124 having a prescribed magnetic attraction force while one magnet positioned at the second of the other end side outer cap 127 forms the magnet 123 having a stronger magnetic attraction force. The magnet positioned at the third from the other end side outer cap 127 forms the magnet 124. In such a manner, the magnets are arranged in the tube 122 in the manner that one magnet 123 having a stronger magnetic attraction force is intervened between a plurality of magnets 124. However, the configuration shown in FIG. 27 is one example, the number and the arrangement and so forth of the magnet 123 having a stronger magnetic attraction force can be variously changed. Further, the magnetic attraction force can be divided into several stages.

With such a configuration, the specific portion of the personal ornament 121 can be adhesively fitted with a strong magnetic attraction force, as occasion demands. Accordingly, it is possible to provide the personal ornament having an arbitrary adhesive strength depending on the object, application and so forth.

Figure 28:
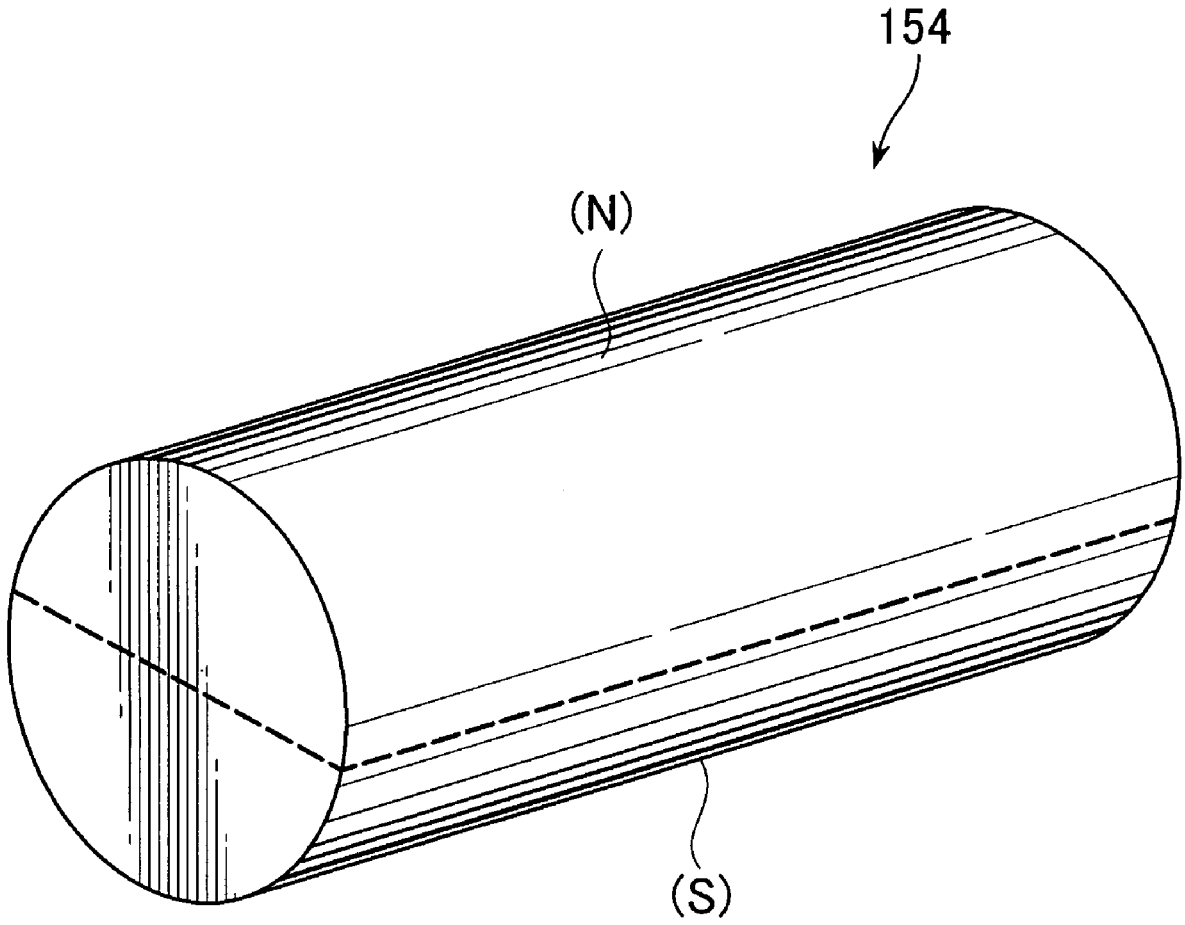
FIG. 28 is an enlarged perspective view showing a configuration of magnets which are applied to the embodiments described above.
Figure 29:
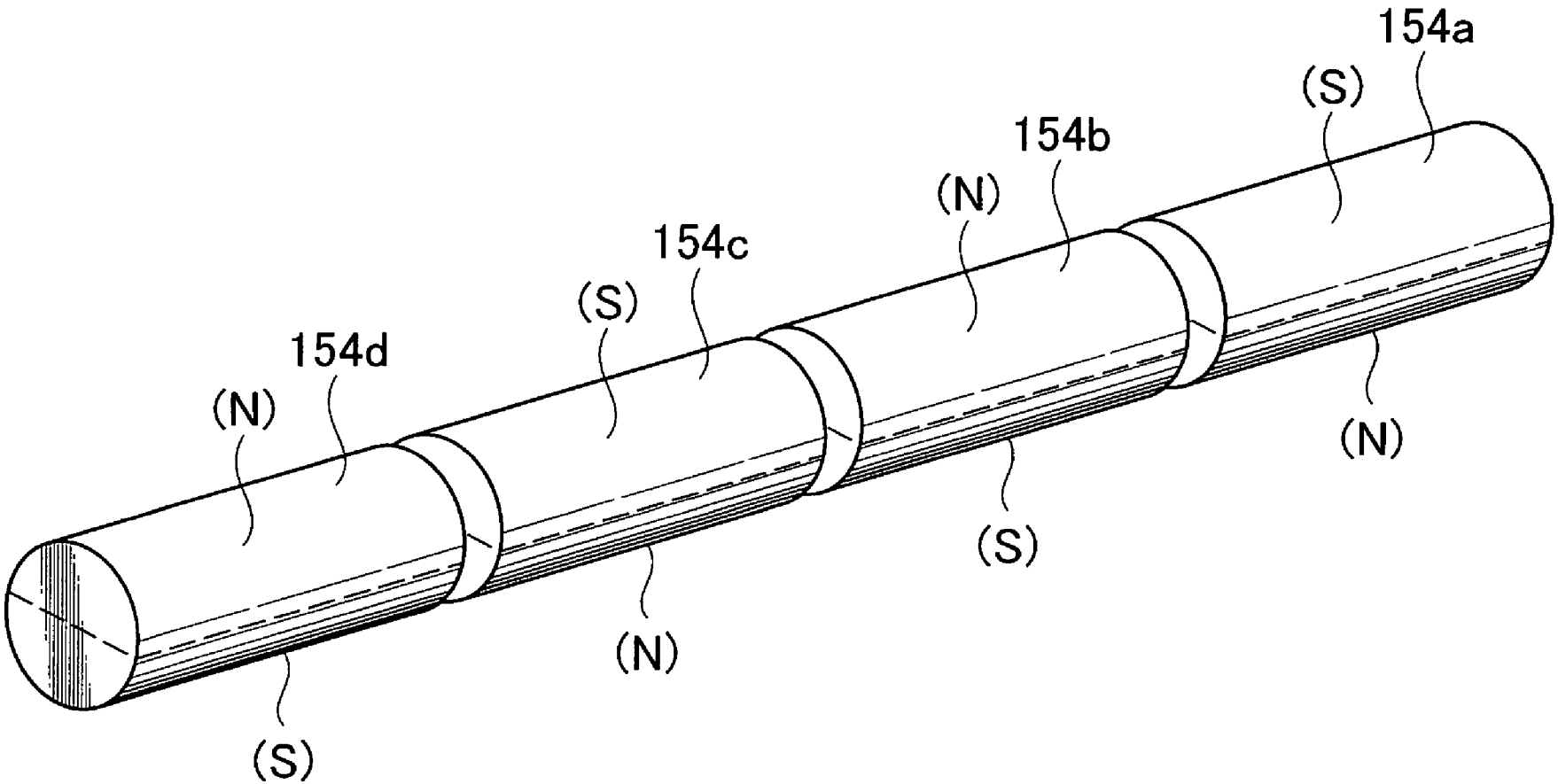
FIG. 29 is a view for explaining a state of arrangement of a plurality of magnets shown in FIG. 28 which are tandemly arranged.
Figure 30:
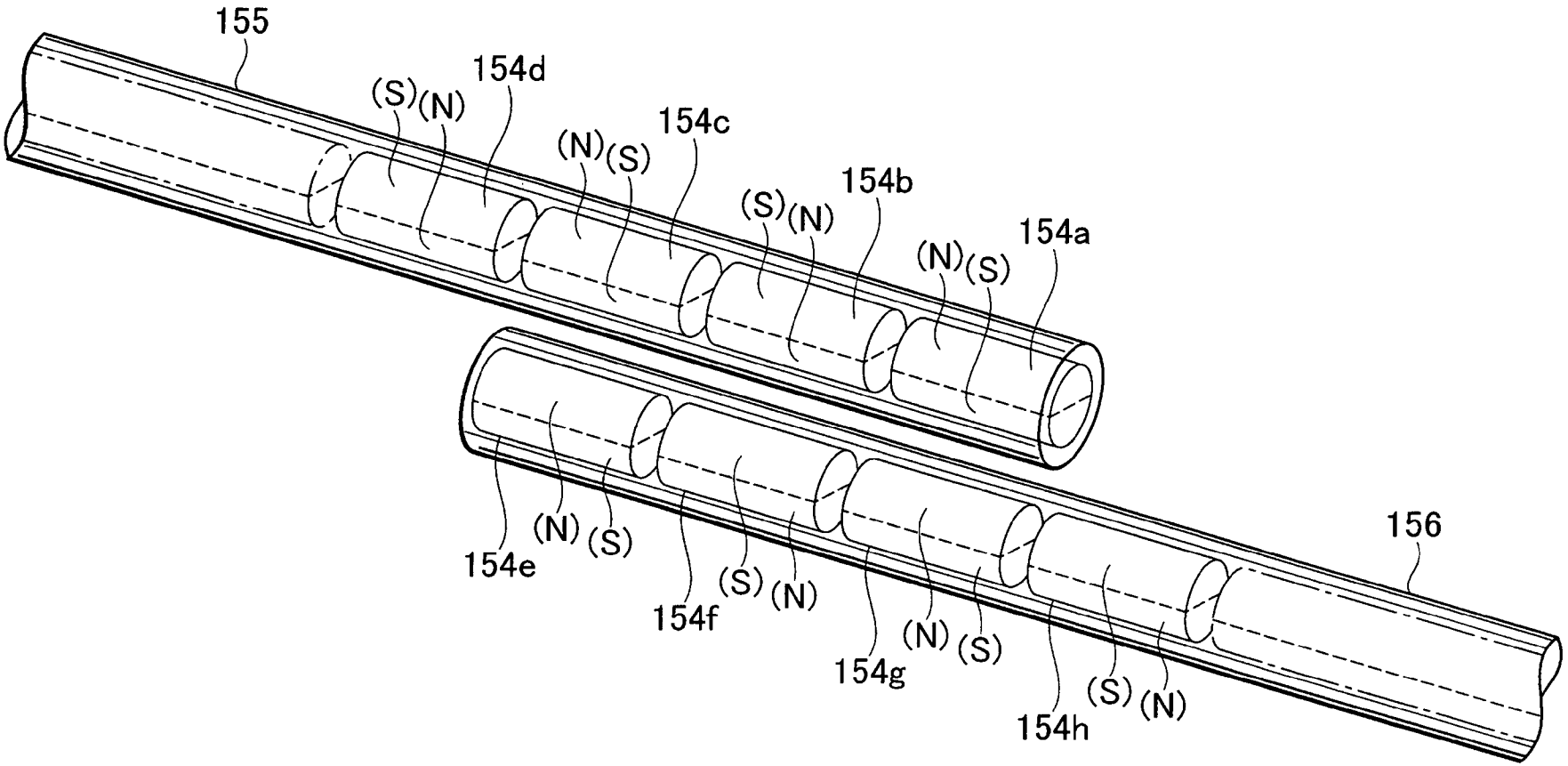
FIG. 30 is a view for explaining a state of magnetic attraction of magnets which are applied to the embodiments described above.

Embodiment of Magnetic Operation
(FIGS. 28 to 30)

FIG. 28 is an enlarged perspective view showing the configuration of the magnet applied to the foregoing first to fifth embodiments of the invention. As shown in FIG. 28, a magnet 154 is configured to be columnar, respectively, and N-pole (N) and S-pole (S) are arranged on the opposite side outer peripheral surfaces of the columnar magnet 154.

FIG. 29 is a view for explaining a state of arrangement of the magnets 154 which are plural and arranged tandemly. In the example of FIG. 28, a plurality of columnar magnets 154, namely, a first magnet 154*a*, a second magnet 154*b*, a third magnet 154*c* and a fourth magnet 154*d* are tandemly arranged horizontally in a line while they are opposed to each other in an axial direction.

The N-pole (N) of the first magnet 154*a* is directed downward, and the S-pole (S) thereof is directed upward. Then, the N-pole (N) of the second magnet 154*b* adjacent to the first magnet 154*a* is directed upward, and the S-pole (S) thereof is directed downward. Further, the N-pole (N) of the third magnet 154*c* adjacent to the second magnet 154*b* is directed downward, and the S-pole (S) thereof is directed upward, opposite to the second magnet 154*b*. Still further, the N-pole (N) of the fourth magnet 154*d* adjacent to the third magnet 154*c* is directed upward, and the S-pole (S) thereof is directed downward, opposite to the third magnet 154*c*.

FIG. 30 is a view for explaining the state before the personal ornament is attracted by the magnets wherein the magnets 154*a* to 154*d*, which are arranged as shown in FIG. 29, are inserted into one end side 155 of the tube, and magnets 154*e* to 154*h*, which are arranged in the same manner, are inserted into other end side 156 of the tube.

As shown in FIG. 30, in the case where the one end side 155 of the tube is disposed at the upper side and the other end side 156 of the tube is disposed at the under side, and peripheral surfaces of the magnets 154*a* to 154*d* and those of the magnets 154*e* to 154*h* are rendered adjacent to each other so as to be opposed to each other, the N-pole (N) and S-pole (S) of the magnets 154*a* to 154*d* and the S-pole (S) and N-pole (N) of the magnets 154*e* to 154*h* are opposed to each other, namely, different magnetic poles are opposed to each other to exhibit the magnetic attraction force. As a result, the magnetic operation of magnets is implemented as described in the forgoing each embodiment, thereby adhering both ends of the personal ornament.

On the other hand, in the case where the magnets arranged in the manner as described above are inserted into one tube and the tube is curved in the ring shape, the different poles of the magnets arranged at both ends of the tube are not always rendered in state where they are directly opposed to each other as shown in FIG. 30.

Figure 31:
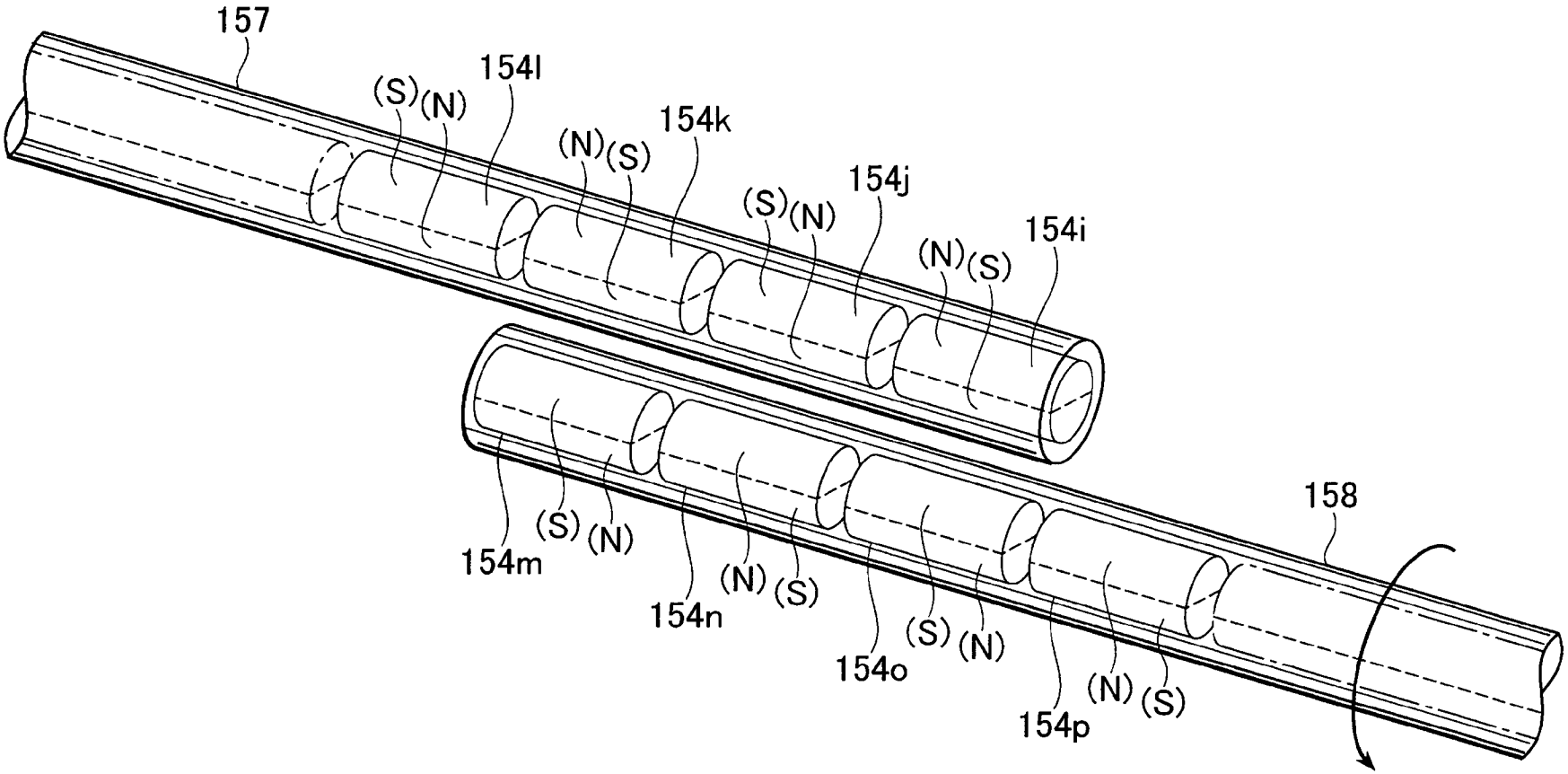
FIG. 31 is a view showing a state prior to magnetic attraction of the magnets shown in FIG. 29.

FIG. 31 shows a case where the different poles of the magnets at both ends of the tube are rendered in a state where they do not be directly opposed to each other but the same poles are directly opposed to each other.

That is, as shown in FIG. 31, for example in the case where the tube is curved in the ring shape and both ends of the tube are rendered in an overlapped state, there is a case where the N-pole (N) and S-pole (S) of magnets 154*i*, 154*j*, 154*k*, 154*l* which are inserted into one end side 157 of the tube while arranged in the same manner described above and N-pole (N) and S-pole (S) of magnets 154*m*, 154*n*, 154*o*, 154*p* which are inserted into other end side 158 of the tube while arranged in the same manner described above are rendered in a state where the same poles are opposed to each other.

Even in such a case, in the configurations of each embodiment of the invention described above, the magnets are formed of metallic magnets, and the tube is structured in a circular tube by a flexible material such as a flexible synthetic resin, rubber and so forth. With such a configuration, since the tube can be easily twisted not less than 180 degrees relatively about the center of axis between both ends thereof along the longitudinal direction, N-pole (N) and S-pole (S) of magnets 154*i*, 154*j*, 154*k*, 154*l* at the one end side 157 and N-pole (N) and S-pole (S) of magnets 154*m*, 154*n*, 154*o*, 154*p* at the other end side 158 attract each other in different poles so that the tube is turned as shown in the arrow of rotation in FIG. 31. As a result, the different poles of the respective magnets are opposed to each other as shown in FIG. 30, so that the both end sides 157, 158 of the tube are strongly adhered to each other, causing the tube to become ring-shaped with assurance.

As a result, according to the respective embodiments of the invention described above, since the personal ornament is configured such that a plurality of columnar metallic magnets are inserted into the string-shaped tube, which is flexible and capable of being twisted and bent, along the longitudinal direction thereof and tandemly arranged therein wherein the N poles and S poles of the respective magnets are arranged on opposite peripheral surfaces of the magnets, so that the personal ornament can be reliably retained with a strong magnetic attraction force of the metallic magnets, said magnetic attraction force being not less than a given value, and hence it enhances a safety relative to theft and so forth, and also it is excellent in wearing relative to a wearer, and excellent in wearing and removal by the wearer himself or herself.

Sixth Embodiment (FIG. 32 to 38)

A personal ornament of the sixth embodiment of the invention is now described with reference FIG. 32 to 38.

A personal ornament body 24 to be described hereinafter with reference to sixth to twenty-fourth embodiments of the invention is the same as the personal ornament body 11 and the combination of the personal ornament body 11 and the outer covering 25 as described in the foregoing first to fifth embodiments of the invention.

Figure 32:
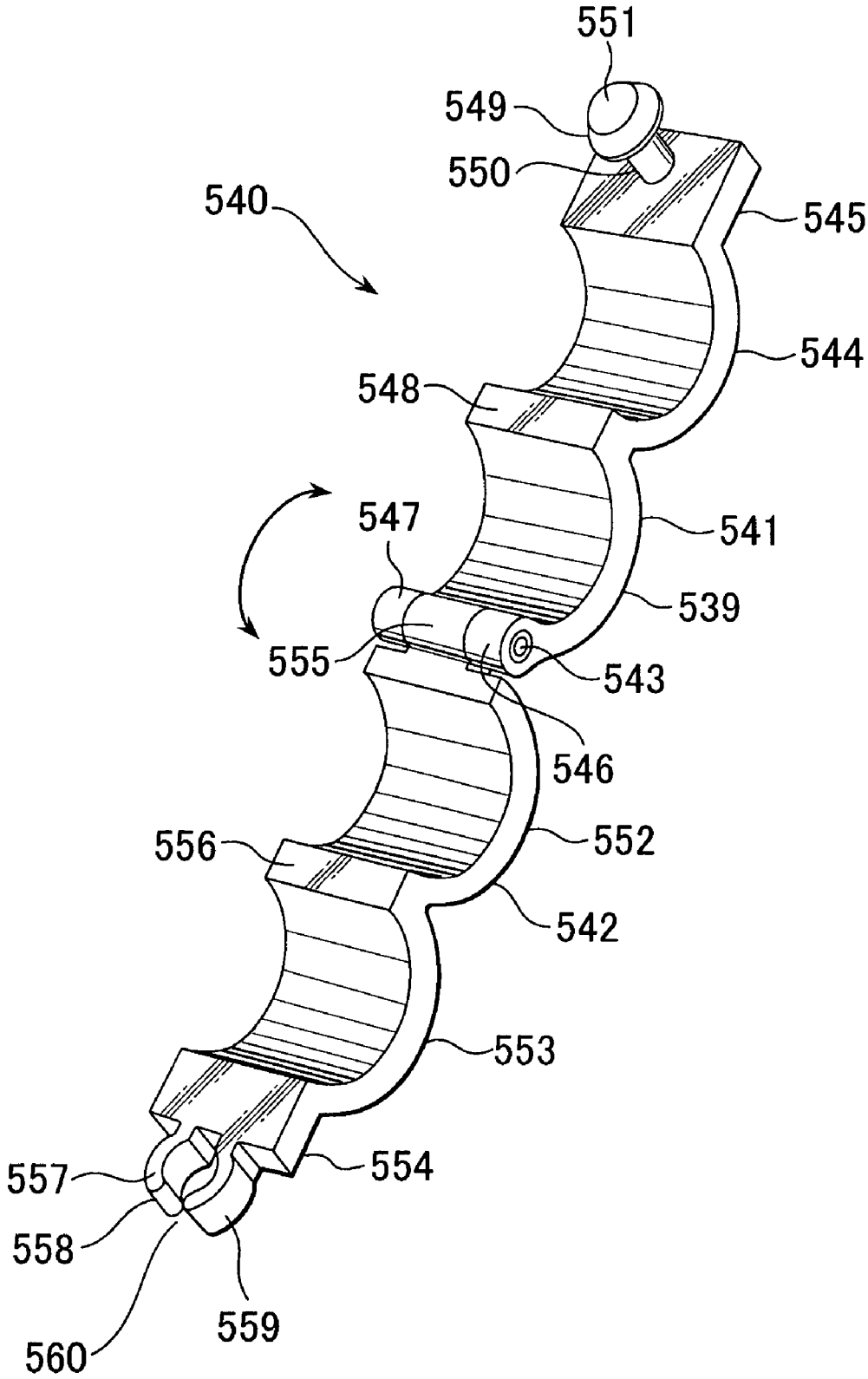
FIG. 32 is a perspective view showing a retainer of a personal ornament according to a sixth embodiment of the invention.

FIG. 32 is a perspective view showing a retainer 540 according to the sixth embodiment of the invention. The retainer 540 is a detachable retainer capable of fixing both end sides of the personal ornament body in a state where one end side and other end side of the personal ornament 24 shown in the first to fifth embodiments of the invention are aligned in parallel with each other.

That is, as shown in FIG. 32, the retainer 540 has the shape of an alligator clip. The retainer 540 is configured to connect a pair of clipping pieces 541 and 542 by a hinge shaft 543 so as to be openable and closable. One clipping piece 541 is made of a curved piece having a given width, and it comprises one end side retaining part 539 having a semi-circular arc plate-shape for pressing and retaining substantially a half of the outer peripheral surface of the personal ornament body 24 at its one end side from the outside, and the other side retaining part 544 having a semi-circular arc plate for pressing and retaining a half of the outer peripheral surface of the personal ornament body 24 at its other end side from the outside, wherein the one end side retaining part 539 and other side retaining part 544 are adjacent to each other to integrally form a curved plate. A hinge cylinder 546 in which a through hole is formed in a direction of width of the plate is integrally provided at one side of the outer end portion of the one end side retaining part 539, while other hinge cylinder 547 in which a through hole is formed in a direction of width of the plate is integrally provided at the other side of the outer end portion of the one end side retaining part 539, wherein the other hinge cylinder 547 and hinge cylinder 546 are provided on the same shaft while spaced at regular intervals. There is formed a flat surface shaped intermediate closing part 548 between the concave surface side of the one end side retaining part 539 and that of the other side retaining part 544. A flat-shaped openable and closable side end part 545 is integrally formed at the outer side end portion of the other side retaining part 544. A pin shaft 550 protrudes from the openable and closable side end part 545, and a large diameter head part 551 is formed on the tip end of the pin shaft 550.

The other clipping piece 542 has substantially the same shape as the one clipping piece 541 and is made of a curved piece having a given width. The other clipping piece 542 comprises one end side retaining part 552 having a semi-circular arc plate-shape for pressing and retaining substantially a half of the outer peripheral surface of the personal ornament body 24 at its one end side from the outside, and the other side retaining part 553 having a semi-circular arc plate-shape for pressing and retaining substantially a half of the outer peripheral surface of the personal ornament body 24 at its other end side from the outside, wherein the one end side retaining part 552 and other side retaining part 553 are adjacent to each other to integrally form a curved plate. A hinge cylinder 555 in which a through hole is formed in a direction of a width of the plate is integrally provided at one side of the outer end part of the other retaining part 552, and the hinge cylinder 555 is disposed coaxially between the hinge cylinder 546 and other hinge cylinder 547 of the one clipping piece 541. A hinge shaft 543 passes through these hinge cylinder 546, hinge cylinder 555 and other hinge cylinder 547, and the one clipping piece 541 and other clipping piece 542 can be turned about the hinge cylinder 543.

There is also formed at the other clipping piece 542 a flat surface shaped intermediate closing part 556 between the concave surface side of the other retaining part 552 and that of the other side retaining part 553, like the one clipping piece 541. A flat-shaped openable and closable side end part 554 is integrally formed at the outer side end portion of the other side retaining part 553. A pin receiver 557 which is engageable with the pin shaft 550 protrudes from the openable and closable side end part 554. The pin receiver 557 has a circular arc shaped one pin shaft holding piece 558 and a circular arc shaped other pin shaft holding piece 559 which are opposed to each other, and an opening 560 is formed between the tip end of the one pin shaft holding piece 558 and that of the other pin shaft holding piece 559. Both the one pin shaft holding piece 558 and other pin shaft holding piece 559 have elasticity, and the large diameter head part 551 of the tip end of the pin shaft 550 can be inserted into the opening 560 and engaged therein when the one clipping piece 541 and other clipping piece 542 are turned about the hinge shaft 543 so as to close themselves, so that both the one clipping piece 541 and other clipping piece 542 are kept in an engaged state by the engagement between the one clipping piece 541, other clipping piece 542 and pin shaft 550. Unless a tearing force having not less than a given value is applied thereto, both the one clipping piece 541 and barrel part 652 can be kept in the engaged state.

Figure 33:
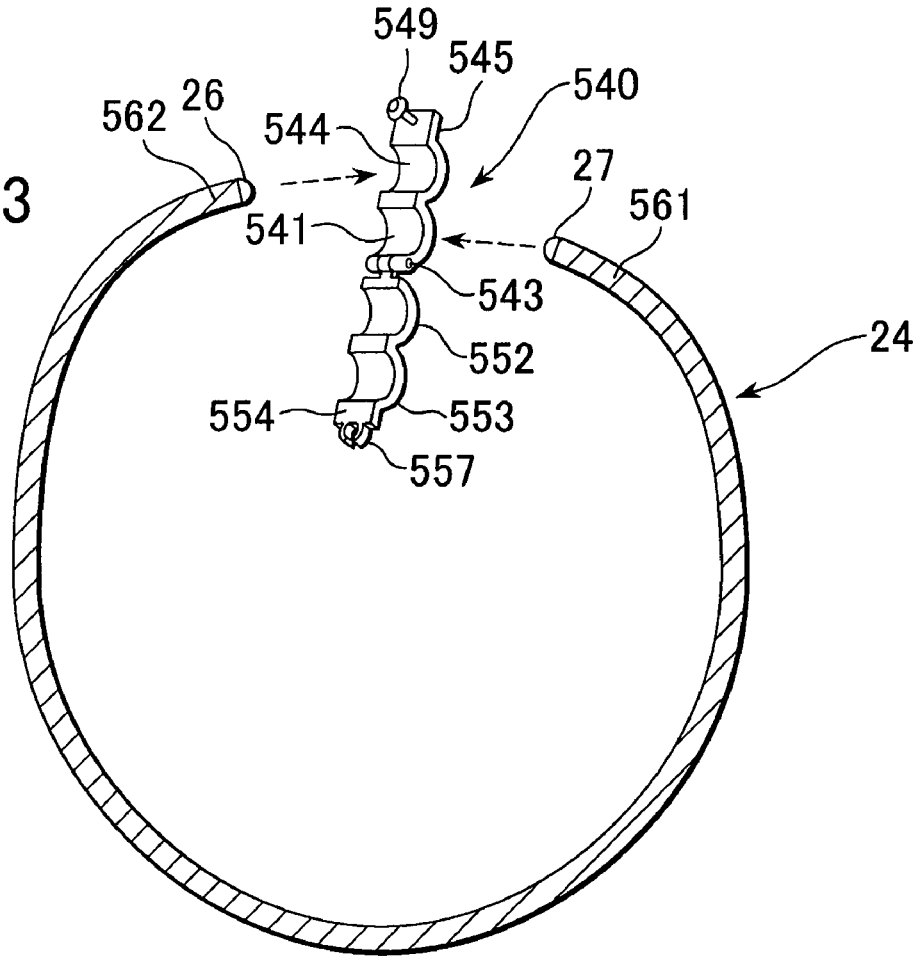
FIG. 33 is a view showing a state of use of the retainer of the personal ornament according to the sixth embodiment of the invention.

FIG. 33 is a view for explaining a using state in the case where the personal ornament body 24 is retained by the retainer 540. As shown in FIG. 33, the personal ornament body 24 is caused to be curved in U-shape, and one end side 561 and the other end side 562 of the personal ornament body 24 are caused to approach each other relative to the retainer 540. An outer cap 27 is provided at the tip end of the one end side 561 of the personal ornament body 24 while an outer cap 26 is provided at the tip end of the other end side 562 of the personal ornament body 24. The one end side 561 and the other end side outer cap 27 of the personal ornament body 24 are caused to pass through the concave surface side of the one clipping piece 541 of the retainer 540. The other end side 562 and outer cap 26 of the personal ornament body 24 are caused to pass through the concave surface side of the other side retaining part 544 of the retainer 540. Then, the openable and closable side end part 554 side is turned about the hinge shaft 543 toward the openable and closable side end part 545 while the retaining pin 549 is engaged in the pin receiver 557.

Figure 34:
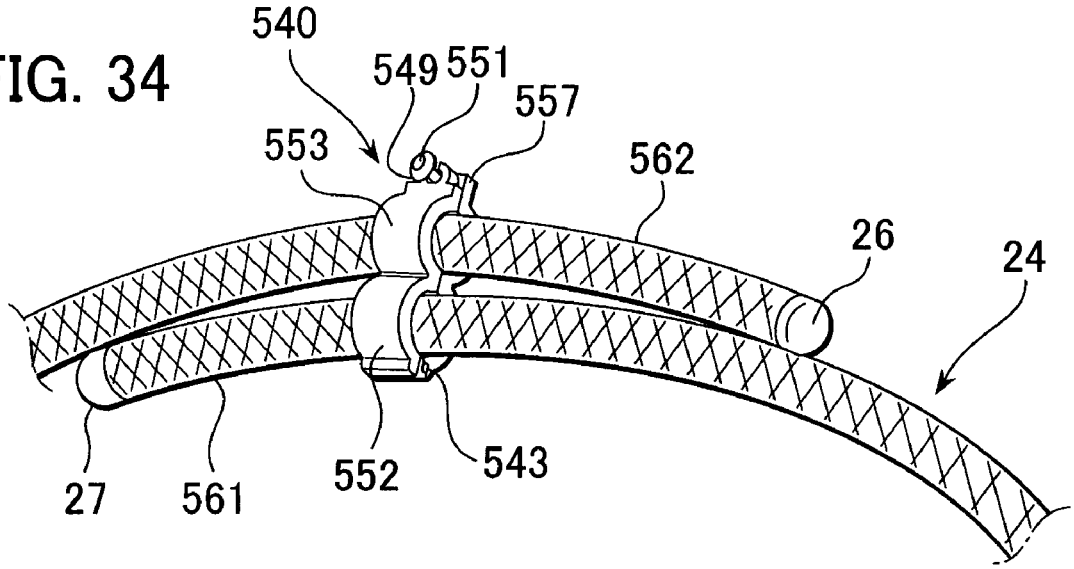
FIG. 34 is a view for explaining a state of retaining the personal ornament according to the sixth embodiment of the invention.

FIG. 34 is a view for explaining a retaining state of the personal ornament body 24 which is enlarged. As shown in FIG. 34, the outer cap 27 of the one end side 561 of the personal ornament body 24 and outer cap 26 of the other end side 562 thereof are caused to approach each other in a state where they are aligned in parallel with each other in an alternate direction to be overlapped with each other. The retainer 540 is turned about the hinge shaft 543 so that the openable and closable side end parts 545, 554 are closed so that the retaining pin 549 and pin receiver 557 are connected to each other to be retained by the large diameter head part 551. The one end side 561 and other end side 562 of the personal ornament body 24 are fixed and held by the other retaining part 552 and other side retaining part 553, respectively.

Figure 35:
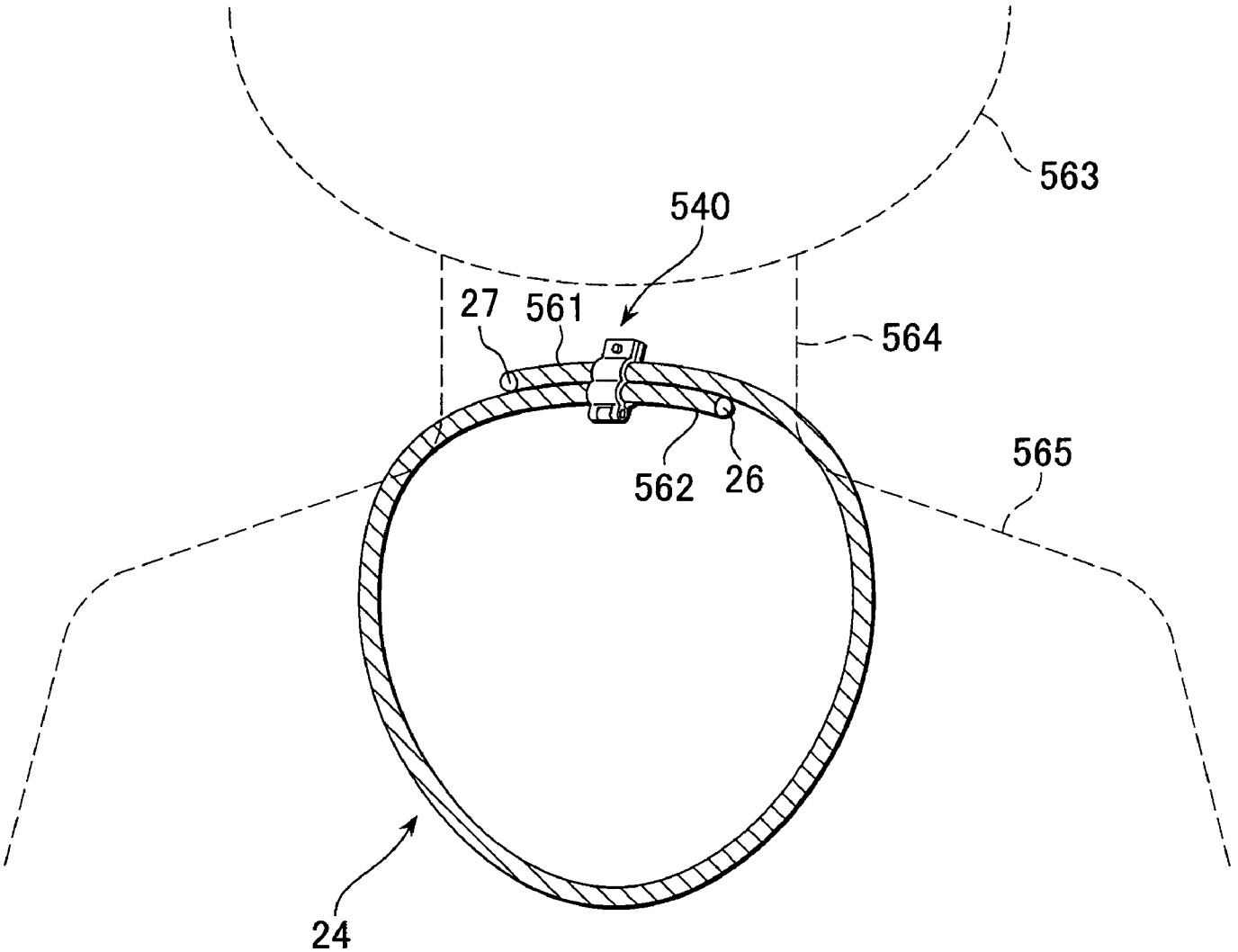
FIG. 35 is a view showing an example of a state of wearing of the personal ornament according to the sixth embodiment of the invention.

FIG. 35 is a view for explaining a using state of the retainer of the personal ornament body 24 according to the sixth embodiment of the invention. In the example of FIG. 35, the personal ornament body 24 is worn around a neck 564 of a wearer 563, and the one end side 561 and other end side 562 of the personal ornament body 24 are overlapped with each other at the back side of the neck 564 and the personal ornament body 24 is retained with the magnetic force, and the wearing method is explained in a state to be seen from the front of the wearer 563.

In the case of using the wearing method, the wearer 563 grasps one end side 561 of the personal ornament body 24 with one hand (right hand) and also grasps the other end side 562 of the personal ornament body 24 at the other hand (left hand) The wearer 563 gradually raises the personal ornament body 24 from the front lower portion of neck 564 (under the chin) in the upward direction, and both ends of the personal ornament body 24 are turned at the backside of the neck 564 from the upper portion of a shoulder 565. Thereafter, the one end side 561 and other end side 562 are overlapped with each other.

Then, once the one end side 561 and other end side 562 of the personal ornament body 24 are moved to approach each other for a given distance, they are immediately rendered in an adhesion state by the magnetic attraction forces. That is, even the wearer 563 merely approaches the one end side 561 toward the other end side 562 at the front of and below the neck 564, the one end side 561 and other end side 562 can be easily and quickly fitted and fixed to each other with the strong magnetic attraction force.

In this state, the one end side 561 and other end side 562 of the personal ornament body 24 are fixed by the retainer 540, as shown in FIGS. 33 and 34. Accordingly, the personal ornament body 24 can be easily fitted and fixed by the detachable retainer 540 so that the fitting state becomes firm and there is no likelihood of coming-off by being torn.

Figure 36:
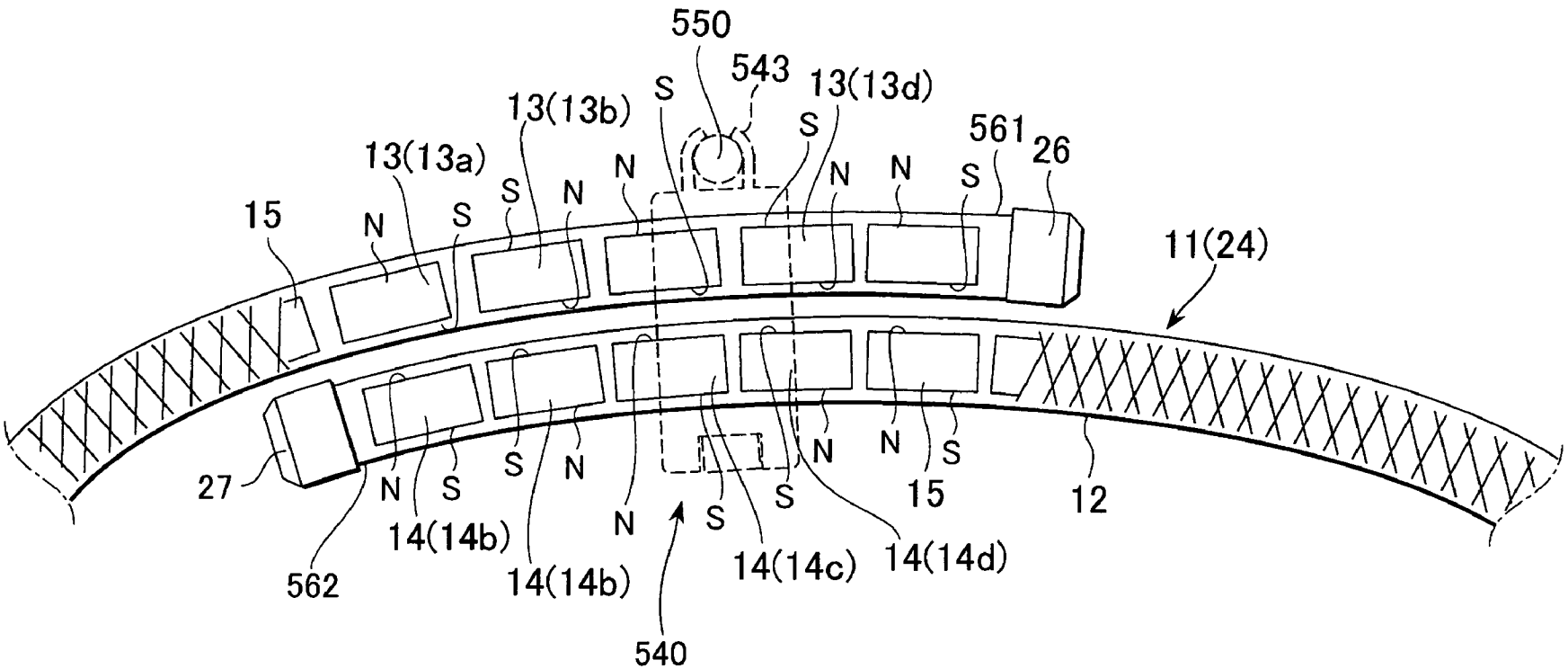
FIG. 36 is an enlarged sectional view showing a retaining structure of the personal ornament according to the sixth embodiment of the invention.

FIG. 36 is a partial sectional view in which an overlapped portion of the one end side 561 and other end side 562 of the personal ornament body 24 at the backside of the neck 564 is enlarged, and which shows a magnet structure inside the magnet built-in personal ornament body 11 at the one end side 561 and other end side 562 of the personal ornament body 24, and the magnetic attraction operation. As shown in FIG. 36, at the overlapped portion of the one end side 561 and other end side 562 of the personal ornament body 24, for example, four one end side magnets 13 (13*a*, 13*b*, 13*c* 13*d*) are tandemly arranged in the magnet built-in personal ornament body 11 of the one end side 561 from the outer cap 26 side. The one end side magnets 13 (13*a*, 13*b*, 13*c* 13*d*) are configured to be columnar, respectively, as described above, and N-poles (N) and S-poles (S) of the one end side magnets 13 (13*a*, 13*b*, 13*c* 13*d*) are arranged on the opposite side outer peripheral surfaces of the columnar magnets. Then, the N-poles (N) and S-poles (S) of the one end side magnets 13 (13*a*, 13*b*, 13*c* 13*d*) which are adjacent to each other are arranged in an alternate direction. More in detail, the N-pole (N) of the one end side magnet 13*a* arranged at the end side closest to the outer cap 26 side of the personal ornament body 24 is directed downward, the S-pole (S) thereof is directed upward. Then, the N-pole (N) of the one end side magnet 13*b* arranged at the second from the end side adjacent to the one end side magnet 13*a* is directed upward, and the S-pole (S) is directed downward. Further, the N-pole (N) of the one end side magnet 13*c* arranged at the third from the one end side adjacent to the one end side magnet 13*b* is directed downward, and the S-pole (S) is directed upward, opposite to the second one end side magnet 13*b*. Still further, the N-pole (N) of the one end side magnet 13*d* arranged at the fourth from the end side adjacent to the one end side magnet 13*c* is directed upward, and the S-pole (S) is directed downward, opposite to the third one end side magnet 13*c*. The N-poles (N) and S-poles (S) of the intermediate magnets 15 . . . subsequent to the one end side magnets 13 . . . are arranged in an alternate direction.

On the other hand, at the overlapped portion of the one end side 561 and other end side 562 of the personal ornament body 24, for example, four other end side magnets 14 (14*a*, 14*b*, 14*c* 14*d*) are tandemly arranged in the magnet built-in personal ornament body 11 of the other end side 562 from the outer cap 27 side. The other end side magnets 14 (14*a*, 14*b*, 14*c* 14*d*) are configured to be columnar, respectively, as described above, and N-poles (N) and S-poles (S) of the other end side magnets 14 (14*a*, 14*b*, 14*c* 14*d*) are arranged on the opposite side outer peripheral surfaces of the columnar magnets. Then, the N-poles (N) and S-poles (S) of the other end side magnets 14 (14*a*, 14*b*, 14*c* 14*d*) which are adjacent to each other are arranged in an alternate direction.

More in detail, the N-pole (N) of the other end side magnet 14*a* arranged at the end side closest to the outer cap 27 side of the personal ornament body 24 is directed upward, the S-pole (S) thereof is directed downward. Then, the N-pole (N) of the other end side magnet 14*b* arranged at the second from the end side adjacent to the other end side magnet 14*a* is directed downward, and the S-pole (S) is directed upward opposite to the first other end side magnet 14*a*. Further, the N-pole (N) of the other end side magnet 14*c* arranged at the third from the one end side adjacent to the other end side magnet 14*b* is directed upward, and the S-pole (S) is directed downward, opposite to the second other end side magnet 14*b*. Still further, the N-pole (N) of the other end side magnet 14*d* arranged at the fourth from the end side adjacent to the other end side magnet 14*c* is directed downward, and the S-pole (S) is directed upward, opposite to the third other end side magnet 14*c*. The N-poles (N) and S-poles (S) of the intermediate magnets 15 . . . subsequent to the other end side magnets 14 . . . are arranged in an alternate direction, in the same manner described above.

Accordingly, at the overlapped portion of the one end side 561 and other end side 562 of the personal ornament body 24, the N-poles (N) and S-poles (S) of the four one end side magnets 13 (13*a*, 13*b*, 13*c* 13*d*) and the S-poles (S) and N-poles (N) of the four other end side magnets (14*a*, 14*b*, 14*c* 14*d*) are opposed to each other so that they can be magnetically adhered to each other. Since the magnets are made of a metallic magnet, they can be strongly magnetically adhered to each other so that they can not be torn off each other.

Further, since the tube 12 of the magnet built-in personal ornament body 11 is configured to be easily twisted not less than 180 degrees relatively about the center of axis between both ends thereof along the longitudinal direction, even if the N-poles (N) themselves or S-poles (S) themselves are rendered in a state where they are opposed to each other immediately after the magnet built-in personal ornament body 11 is wound around the neck of the wearer, the N-poles (N) and S-poles (S) are rendered in a state where they are opposed to each other naturally owing to the magnetic attraction force thereof. Accordingly, it is not necessary for the wearer to artificially implement a rotary operation of the magnet built-in personal ornament body 11 so that the magnet built-in personal ornament body 11 can be easily worn.

Figure 37:
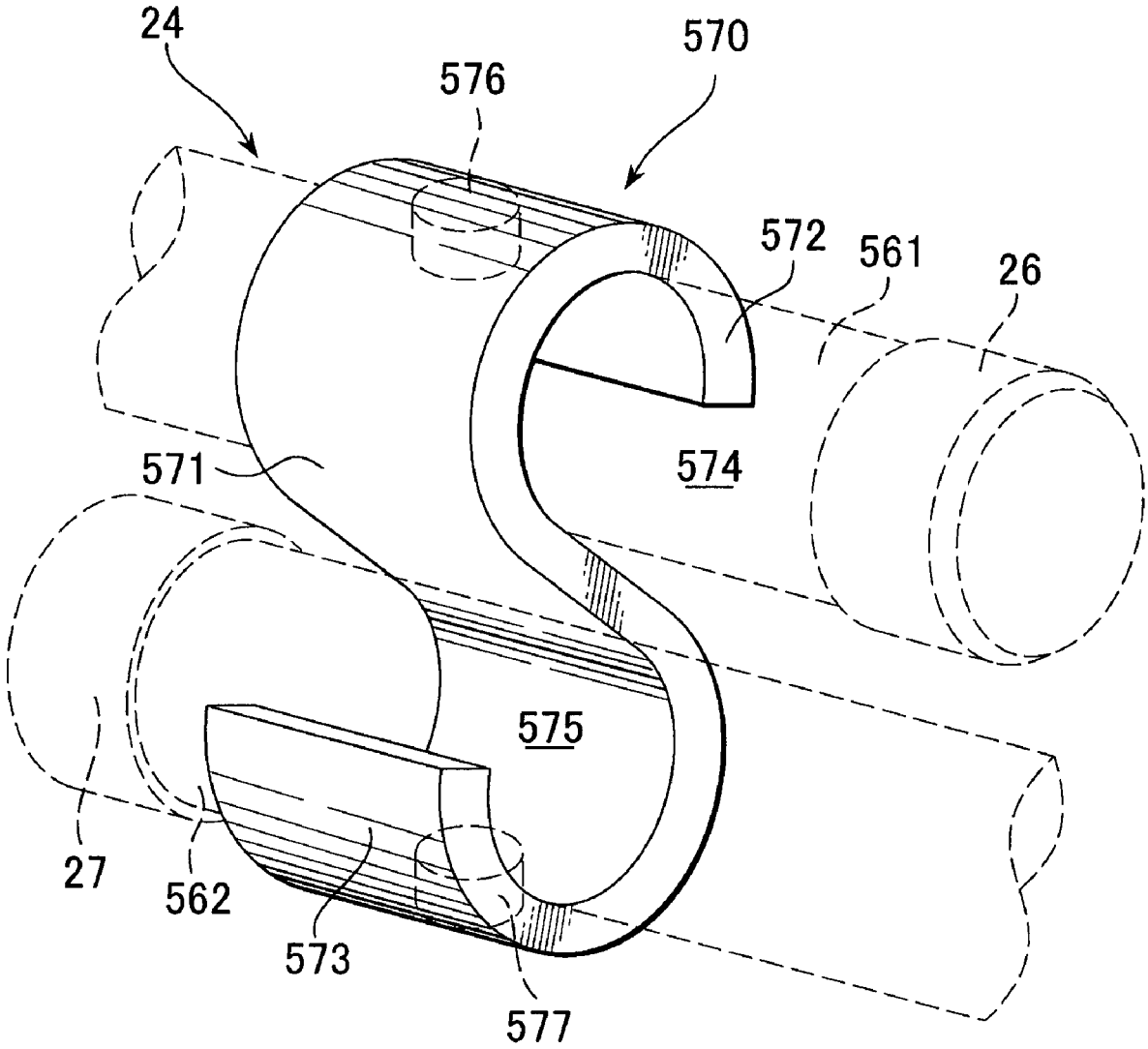
FIG. 37 is a perspective view showing a personal ornament according to a seventh embodiment of the invention.

Seventh Embodiment (FIG. 37)

FIG. 37 is a perspective view showing the personal ornament according to the second embodiment of the invention. As shown in FIG. 37, a retainer 570 is made of a metal, resin and so forth serving as a material thereof by molding or bending process and is formed substantially in S-shape as viewed from the side surface. That is, a central part 571 of the retainer 570 is substantially linear, and the one end part 572 thereof has an inner diameter which is slightly larger than an outer diameter of the personal ornament body 24 and is bent in a circular shape. A gap which is smaller than the outer diameter of the personal ornament body 24 is formed between the linear central part 571 and a tip end of the one end part 572. With the formation of the gap, a circular space portion inside the curved one end part 572 of the retainer 570 serves as one through part 574 through which the tip end of the personal ornament body 24 can pass.

The other end part 573 of the retainer 570 is bent circularly in the direction opposite to the one end part 572, and the inner diameter of the bent portion is slightly larger than the outer diameter of the personal ornament body 24. There is formed a gap which is smaller than the outer diameter of the personal ornament body 24 between the linear central part 571 of the retainer 570 and a tip end of the other end part 573. With the formation of the gap, a circular space portion inside the curved other end part 573 of the retainer 570 serves as the other through part 575 through which the tip end of the personal ornament body 24 can pass.

A magnet 576 is provided at the one end side 572 of the retainer 570, whereby the one end side 561 of the personal ornament body 24 can be magnetically adhered with the magnetic force of the magnet 576. Further, a magnet 577 is provided at the other end side 573 of the retainer 570, whereby the other end side 562 of the personal ornament body 24 can be magnetically adhered with the magnetic force of the magnet 577.

This wearing process using the retainer 570 is an improvement of the wearing process wherein the personal ornament 24 is worn around the neck 564 of the wearer 563 while the one end side 561 and other end side 562 of the personal ornament 24 are overlapped with each other at the backside of the neck 564 to be retained with the magnetic force, namely, the personal ornament 24 can be retained around the neck by use of the retainer 570 with more assurance.

That is, the wearer 563 grasps the one end side 561 and other end side 562 of the personal ornament body 24, and raises the personal ornament body 24 from the front side lower portion to the upper portion of the neck 564, and turns both ends of the personal ornament body 24 at the backside of the neck 564 by way of the upper portion of the shoulder. Then the one end side 561 of the personal ornament body 24 is caused to pass through the one through part 574 of the S-shaped retainer 570. Further, the one end side 562 of the personal ornament body 24 is caused to pass through the other through part 575 of the S-shaped retainer 570 as shown in right-pointing arrow.

As mentioned above, the one end side 561 of the personal ornament body 24 passed through the one through part 574 of the S-shaped retainer 570 is held from the periphery by the linear central part 571 of the retainer 570 and the tip end of the one end part 572. Accordingly, the one end side 561 of the personal ornament body 24 is not transversely come off.

The other end side 562 of the personal ornament body 24 passed through the other through part 575 of the S-shaped retainer 570 is held from the periphery by the central part 571 of the retainer 570 and the tip end of the other end part 573. Accordingly, the other end side 562 of the personal ornament body 24 is not transversely come off.

As mentioned above, the personal ornament body 24 retained by the S-shaped retainer 570 is rendered in an adhesion state by the magnetic attraction force of the magnets while it is prevented from being come off more reliably in a peripheral direction with a holding force of the retainer 570. Accordingly, there is no fear of losing the personal ornament body 24 caused by sudden dropping-off and so forth and it is not come off by tearing the personal ornament body 24 from the outside of the wearer, so that theft and so forth can be prevented with more assurance. Meanwhile, when the wearer removes the personal ornament personal ornament body 24 from the body, it can be removed with ease by merely drawing out the one end side 561 or other end side 562 of the personal ornament body 24 from the one through parts 574 and 575 of the retainer 570 in an axial direction.

Figure 38:
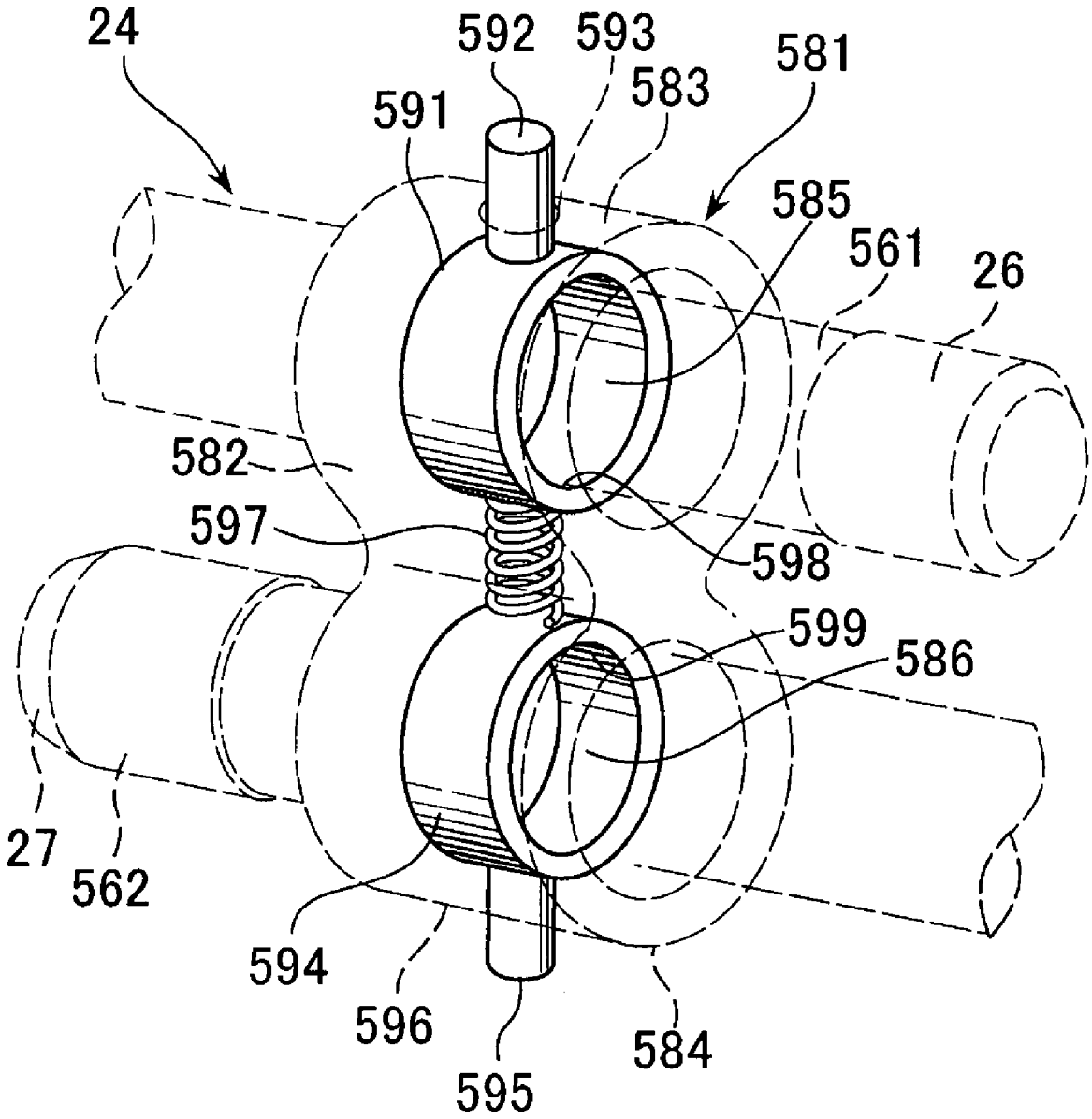
FIG. 38 is a perspective view of a personal ornament according to an eighth embodiment of the invention.
Figure 39:
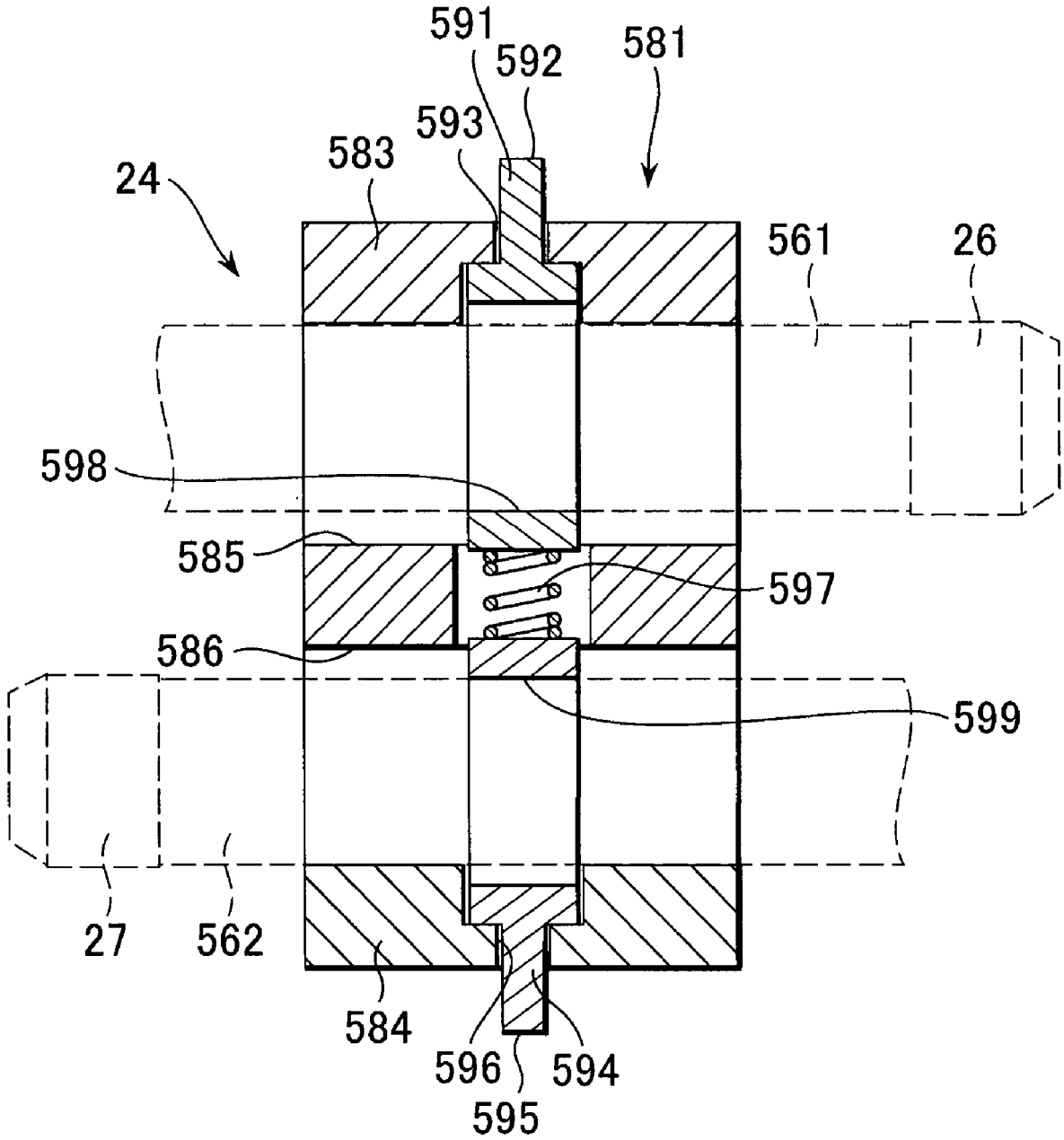
FIG. 39 is a longitudinal sectional view of the personal ornament according to the eighth embodiment of the invention.

Eighth Embodiment of the Invention (FIG. 38, FIG. 39)

FIG. 38 is a perspective view showing a personal ornament according to the eighth embodiment of the invention. As shown in FIG. 38, a retainer 581 of the eighth embodiment is molded out of a material such as a metal or a resin and so forth, and is formed substantially in the shape of eyeglasses (in the shape of the number "8")), as viewed from the side surface as a whole. That is, the retainer 581 comprises cylindrical one end part 583 and cylindrical other end part 584 and a barrel part 582, wherein the one end part 583 and other end part 584 are integrally connected to each other via the barrel part 582, thereby forming an outer frame in the shape of the eyeglasses.

One space (through part) 585 through which the one end side 561 and outer cap 26 of the personal ornament body 24 pass is formed inside the cylindrical one end part 583, and the diameter of the one space 585 is larger than the diameters of the one end side 561 and outer cap 26 of the personal ornament body 24. As a result, the one end side of the personal ornament body 24 can be freely inserted into or extracted from the one end part 583. Further, a space 586 of the other end part 584 has substantially the same diameter as the one end part 583.

An inner ring 591 is inserted into the one end part 583 of the retainer 581. The inner ring 591 is movable along a direction where the personal ornament bodies 24 are overlapped with each other inside one end part 583, and is movable by a push-on screw 592 inserted into a screw hole 593 provided at the one end part 583 in a direction where the personal ornament bodies 24 are overlapped with each other. Further, an inner ring 594 is inserted into the space 586 of the other end part 584. The inner ring 594 is movable along a direction where the personal ornament bodies 24 are overlapped with each other inside the other end part 584, and is movable by a push-on screw 595 inserted into a screw hole 596 provided at the other end part 584 in a direction where the personal ornament bodies 24 are overlapped with each other. A compression coil spring 597 is intervened between the inner rings 591 and 594, and the inner rings 591 and 594 are normally moved away from each other in the opposite directions by elasticity of the compression coil spring 597.

Inner surfaces 598 and 599 of the inner rings 591 and 594 serve as the press surfaces of the one end side 561, outer cap 26 and so forth of the personal ornament body 24. The diameter of the inner surfaces 598 and 599 of the inner rings 591 and 594 are larger than the diameters of the one end side 561, other end side 562 and outer cap 26, and outer cap 27 of the personal ornament body 24. As a result, one end side of the personal ornament body 24 can be freely inserted into or extracted from the inner rings 591 and 594.

FIG. 39 is a cross sectional view taken along a plane orthogonal to an axis of the retainer 581 shown in FIG. 38. As shown in FIG. 39, both the inner rings 591 and 594 are urged against each other outward (upward and downward in FIG. 39) by a resilient force of the compression coil spring 597, and the one end side 561 and other end side 562 of the personal ornament body 24 are pressed from the inner side toward the outside by the inner rings 591 and 594. The outer peripheral surfaces of the one end side 561 and other end side 562 of the personal ornament body 24 to be pressed by the inner ring 591 and other clipping piece 542 are pressed to contact the one end part 583 of the retainer 581 and the inner peripheral surface of the other end part 584. Accordingly, the one end side 561 and other end side 562 of the personal ornament body 24 are fixed to the interior of the retainer 581.

When releasing the fixation of the one end side 561 and other end side 562 from the retainer 581, an operation to push the push-on screws 592 and 595 in the direction for causing them to face each other is effected so that the intimate contact force of the one end side 561 and other end side 562 of the personal ornament body 24 relative to the inner surfaces of the one end part 583 and other end part 584 is reduced, thereby releasing the pressing force against the one end side 561 and other end side 562 of the personal ornament body 24. Accordingly, the one end side 561 and other end side 562 of the personal ornament body 24 can be inserted into or removed from the retainer 581.

As mentioned above, the personal ornament body 24 retained by use of the retainer 581 having the shape of eyeglasses is rendered in an adhesion state with the internal magnetic attraction force, and it can be prevented from being removed in the peripheral direction with assurance with a holding force of the retainer 581.

Accordingly, there is no fear of losing the personal ornament body 24 caused by sudden dropping-off and so forth and it is not come off by tearing the personal ornament body 24 from the outside of the wearer, so that theft and so forth can be prevented with more assurance. Meanwhile, when the wearer removes the personal ornament body 24 from his or her body, he or she can easily remove the personal ornament body 24 by merely extracting the one end side 561 or other end side 562 of the personal ornament body 24 from the inner surface of the retainer 581 while loosening the press-on screws 592 and 595.

Figure 40:
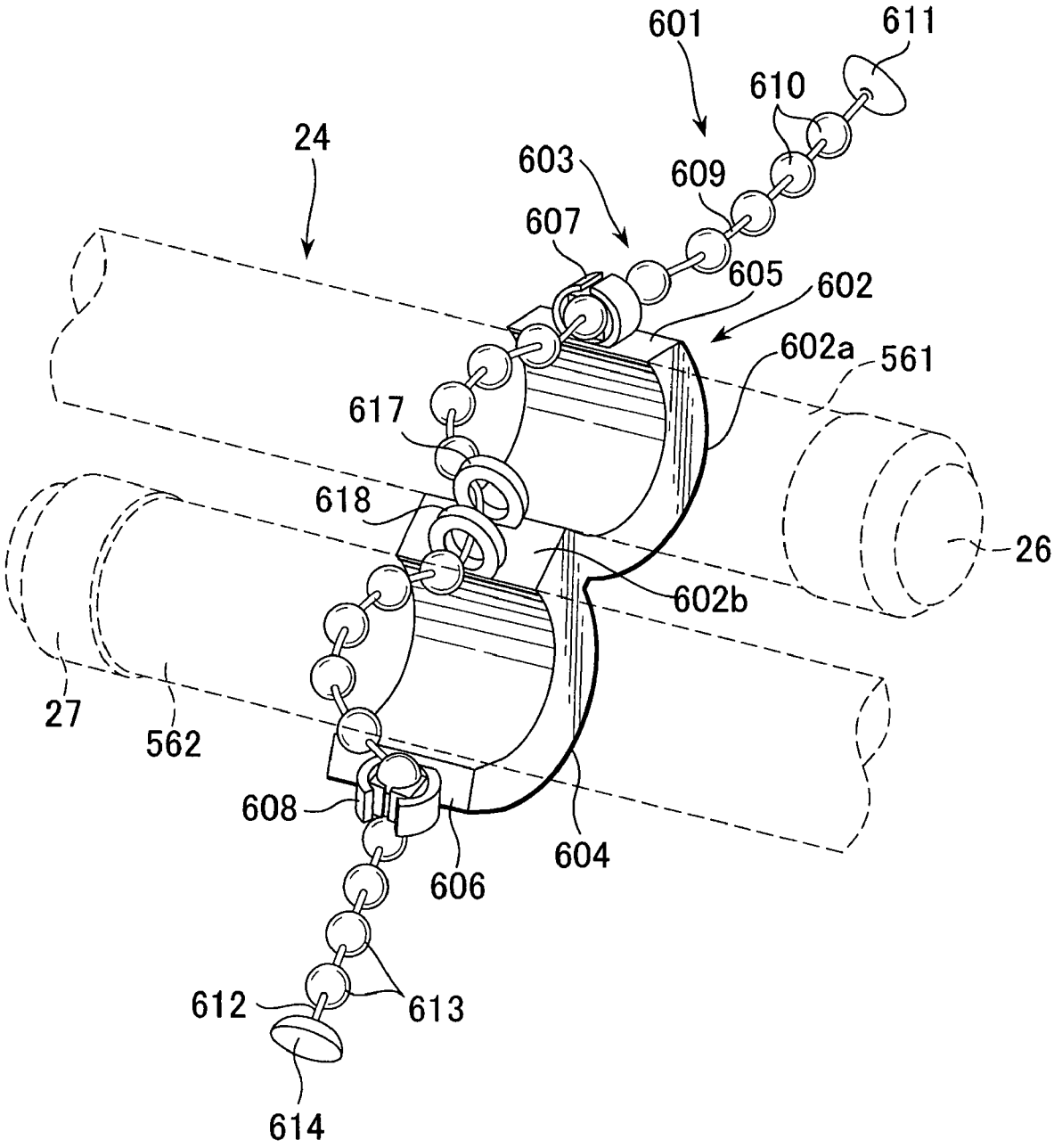
FIG. 40 is a perspective view showing a personal ornament according to a ninth embodiment of the invention.

Ninth Embodiment of the Invention (FIG. 40)

FIG. 40 is a perspective view showing a personal ornament according to the ninth embodiment of the invention. A shown in FIG. 40, a retainer 601 of the ninth embodiment is molded out of a material such as a metal or a resin and so forth, and it comprises a retainer main body 602 formed of a curved plate having two curved portions, and a bead-shaped string body 603 linked with the retainer main body 602.

The retainer main body 602 has a shape wherein two circular arc plate-shaped curved pieces 602*a* and 604 are integrally linked with each other by an intermediate closing part 602*b*, and a ring-shaped outer side retainer ring 607 is provided at one end part 605 of the retainer main body 602. Further, a ring-shaped outer side retainer ring 608 is provided at other end part 606 of the retainer main body 602. Still further, inner side retainer rings 617, 618 are provided on the intermediate closing part 602*b* of the curved pieces 602*a* and 604 at regular intervals. Inner diameters of the outer side retainer rings 607 and 608 are substantially the same as those of the inner side retainer rings 617 and 618.

The string body 603 has balls 610 at one end side of a flexible string 609 at regular intervals at one end side thereof, and balls 613 at one end side of a flexible string 612 at the other end side thereof. The balls 610, balls 613 are made of, e.g., elastic material and they have outer diameters substantially the same as the inner diameters of the outer side retainer rings 607, 608, and those of the inner side retainer rings 617, 618. The balls 610, balls 613 are configured such that when they are pulled with not less than a predetermined force, they can pass through the outer side retainer rings 607, 608 and the inner side retainer rings 617, 618 while when they are pulled with not more than a predetermined force, they are not come off the outer side retainer rings 607, 608 and inner side retainer rings 617, 618. An end plate 611 having a diameter which is larger than the inner diameters of the outer side retainer ring 607 and inner side retainer ring 617 is provided at one end of the string body 603, while an end plate 614 having a diameter which is larger than the inner diameters of the outer side retainer ring 608 and inner side retainer ring 618 is also provided at the other end of the string body 603. Intermediate portions of the flexible strings 609, 612 are caused to pass through the outer side retainer rings 607, 608 and the inner side retainer rings 617, 618, and the end plates 611, 614 provided at tip ends of the flexible strings 609, 612 are disposed outside the outer side retainer rings 607, 608. With such a configuration, the string body 603 is not come off the retainer main body 602.

With such a configuration, in the case where the retainer 601 is fitted to the personal ornament body 24, the portion of the string body 603 between the outer side retainer ring 607 and inner side retainer ring 617 and the portion between the outer side retainer ring 608 and inner side retainer ring 618 are curved so as to be opened larger than the outer diameter of the personal ornament body 24.

One end side 561 and one end side outer cap 26 of the personal ornament body 24 are caused to pass through the opening between the outer side retainer ring 607 and inner side retainer ring 617 while other end side 562 and other end side outer cap 27 are caused to pass through the opening between the outer side retainer ring 608 and inner side retainer ring 618. Thereafter the string body 603 is pulled toward the both ends thereof with a predetermined force to hold down the one end side 561 and other end side 562 of the personal ornament body 24 from the outer peripheral side.

To the contrary, in the cause where the one end side 561 and other end side 562 of the personal ornament body 24 are removed from the retainer main body 602, the portion of the string body 603 between the outer side retainer ring 607 and inner side retainer ring 617 and the portion between the outer side retainer ring 608 and inner side retainer ring 618 are curved so as to be opened larger than the outer diameter of the personal ornament body 24 so that the one end side 561 and other end side 562 of the personal ornament body 24 can be pulled out.

With such a configuration, the one end side 561 and other end side 562 of the personal ornament body 24 is easily fitted or removed by merely operating the string body 603. The personal ornament body 24 retained by the retainer 601 is rendered in an adhesion state by the magnetic attraction force of the internal magnets, and moreover it is prevented from being come off reliably in the peripheral direction with a holding force of the retainer 601 having the shape of the eyeglasses. Accordingly, there is no fear of losing the personal ornament body 24 caused by sudden dropping-off and so forth and it is not come off by tearing the personal ornament body 24 from the outside of the wearer, so that theft and so forth can be prevented with assurance.

Figure 41:
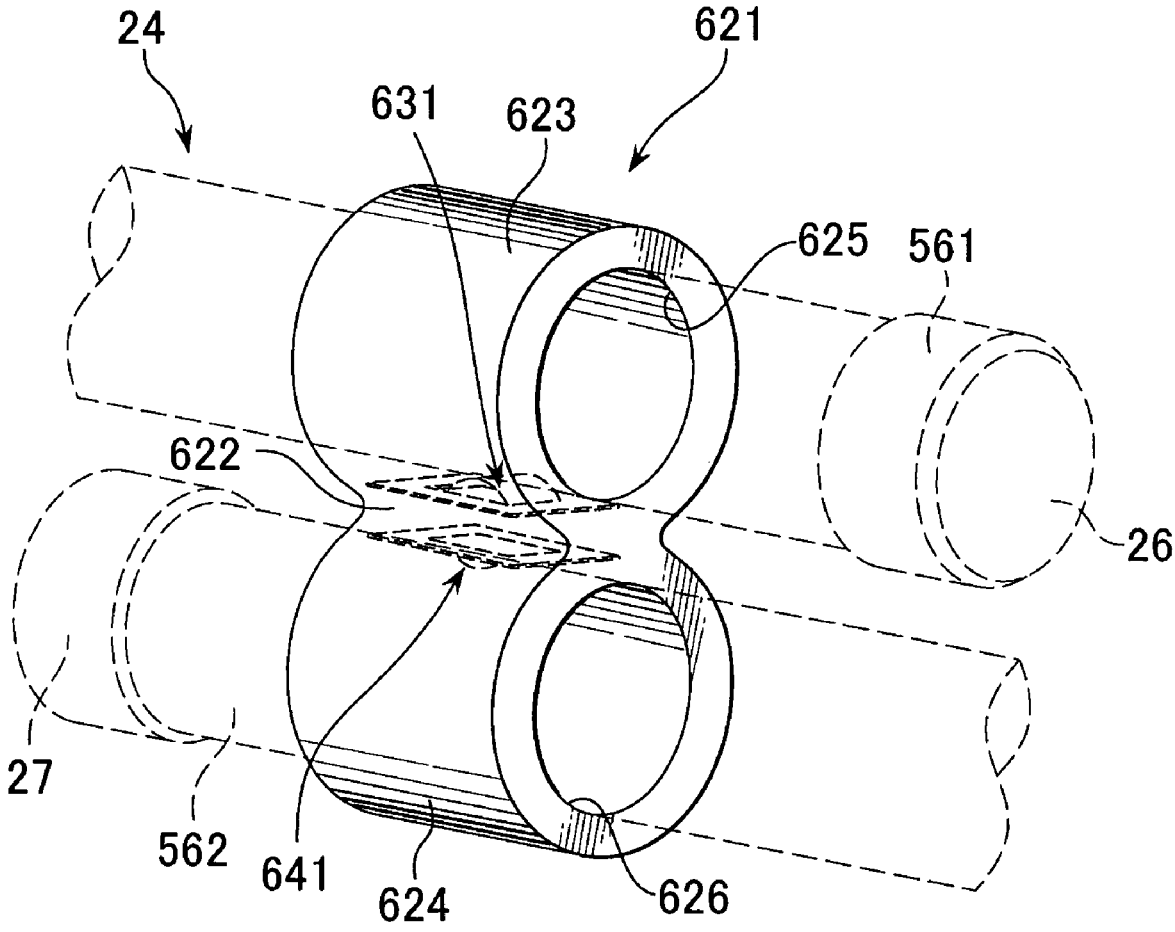
FIG. 41 is a perspective view showing a personal ornament according to a tenth embodiment of the invention.
Figure 42:
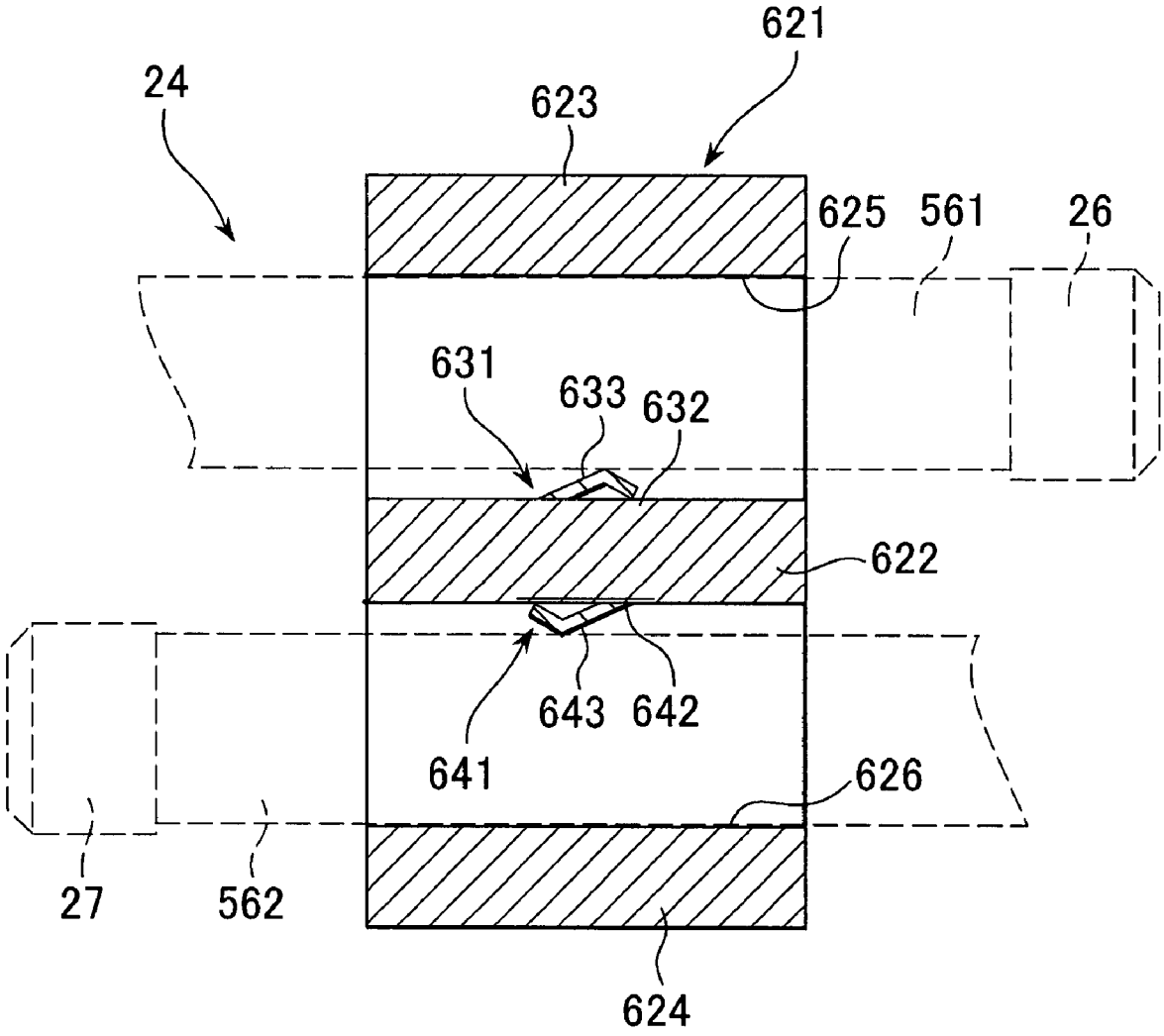
FIG. 42 is a longitudinal sectional view showing the personal ornament according to the tenth embodiment of the invention.

Tenth Embodiment (FIG. 41 and FIG. 42)

FIG. 41 is a perspective view showing a personal ornament according to the tenth embodiment of the invention. As shown in FIG. 41, a retainer 621 of the eighth embodiment is molded out of a material such as a metal or a resin and so forth, and is formed in substantially in eyeglasses (in the shape of the number "8")), as viewed from the side surface. One end side 561 of the personal ornament body 24 can detachably pass through a cylindrical one end part 623 while the other end side 562 of the personal ornament body 24 can detachably pass through the other end part 624.

One space (through part) 625 is formed in the one end part 623 and has a diameter which is larger than the one end side and an outer cap 26 of the personal ornament body 24. As a result, the one side of the personal ornament body 24 can be freely inserted into or extracted from the one end part 623. Meanwhile, other space 626 of the other end part 624 has substantially the same diameter as the one space 625 of the one end part 623, and the diameter of the other space 626 is substantially the same as the outer diameter of the other end side 562 of the personal ornament body 24.

The other end side 562 and outer cap 27 of the personal ornament body 24 can be detachably inserted into the other end part 624. That is, according to the retainer 621 of the tenth embodiment, the other end side 562 and outer cap 27 of the personal ornament body 24 can detachable pass through the other space 626 of the other end part 624 while the outer cap 26 of the personal ornament body 24 can detachably pass through the one space 625 of the one end part 623 in a state where the one end side outer cap 26 can to be inserted or extracted from the one space 625. A spring member 631 is housed inside the one end part 623, while a spring member 641 is likewise housed inside the other end part 624.

FIG. 42 is a sectional view taken along a plane orthogonal to an axis of the retainer 621 shown in FIG. 41. As shown in FIG. 42, the diameter of the cylindrical one end part 623 and that of the cylindrical other end part 624 are substantially the same with each other. The spring member 631 described above is housed in the inner peripheral surface of the one end part 623 of the retainer 621. The spring member 631 is configured to have a mount like shape spring member 633 in a flat plate part 632. Likewise a spring member 641 described above is housed in the inner peripheral surface of a one end part 624. The spring member 641 is configured to have a spring member 643 having the shape of chevron in a flat plate part 642.

In the case where one end side of the personal ornament body 24 is inserted into the one end part 623 by the spring member 631 having such a configuration, the one end side 561 of the personal ornament body 24 can be pressed into and held by the one end part 623 by an arbitrary length with an elastic force of the spring member 633. Further, in the case where the other end side 562 of the personal ornament body 24 is inserted into the other end part 624, the other end side 562 of the personal ornament body 24 can be pressed into and held by the other end part 624 by an arbitrary length with an elastic force of the spring member 643.

With such a configuration, the one end side 561 and other end side 562 of the personal ornament body 24 can be easily fitted and removed by merely detachably inserting the personal ornament body 24 into the retainer 621 without needing a specific operation. Further, the personal ornament body 24 retained by the retainer 621 is rendered in an adhesion state by the magnetic attraction force of the internal magnets while it is prevented from being come off reliably in the peripheral direction with a holding force of the retainer 621. Accordingly, there is no fear of losing the personal ornament body 24 caused by sudden dropping-off and so forth and it is not come off by tearing the personal ornament body 24 from the outside of the wearer, so that theft and so forth can be prevented with more assurance.

Figure 43:
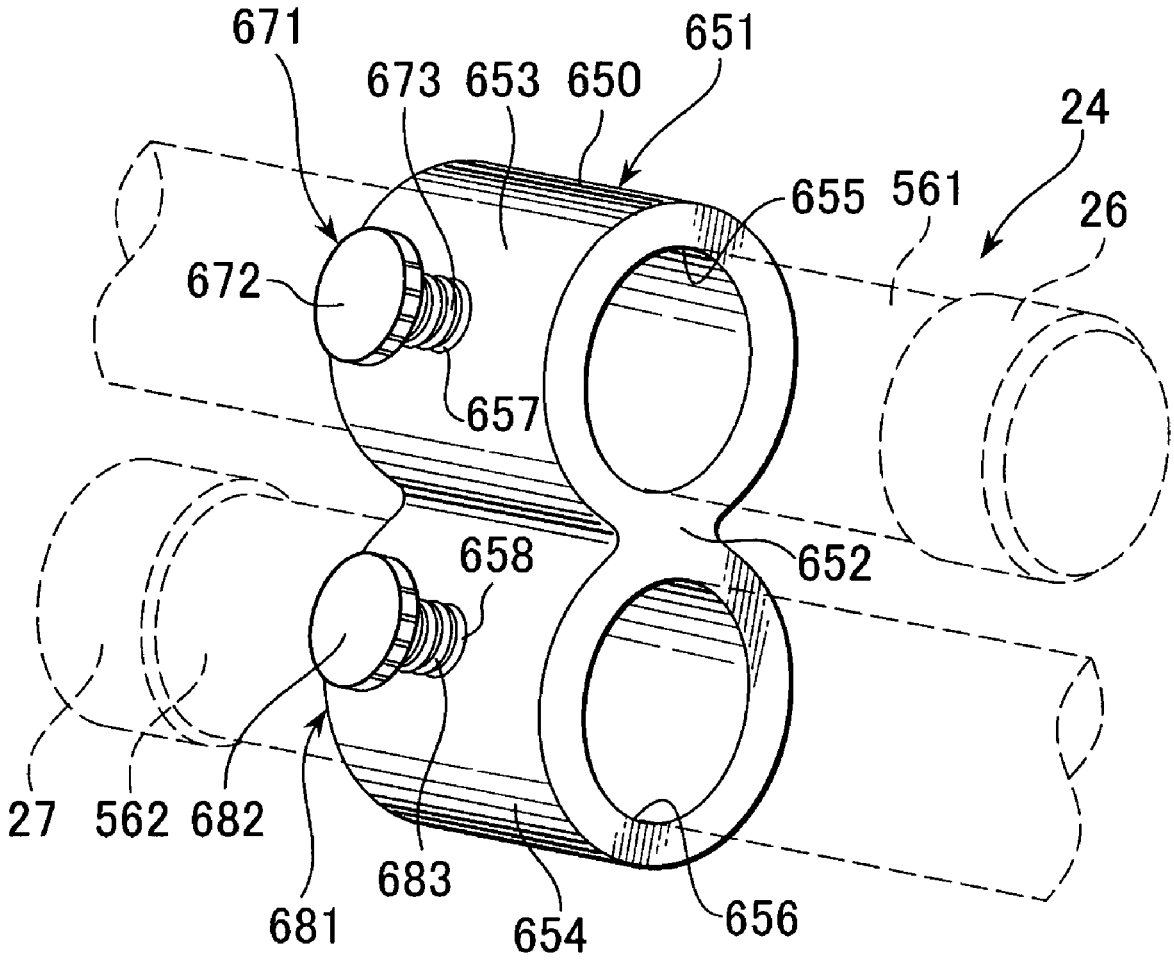
FIG. 43 is a perspective view showing a personal ornament according to an eleventh embodiment of the invention.
Figure 44:
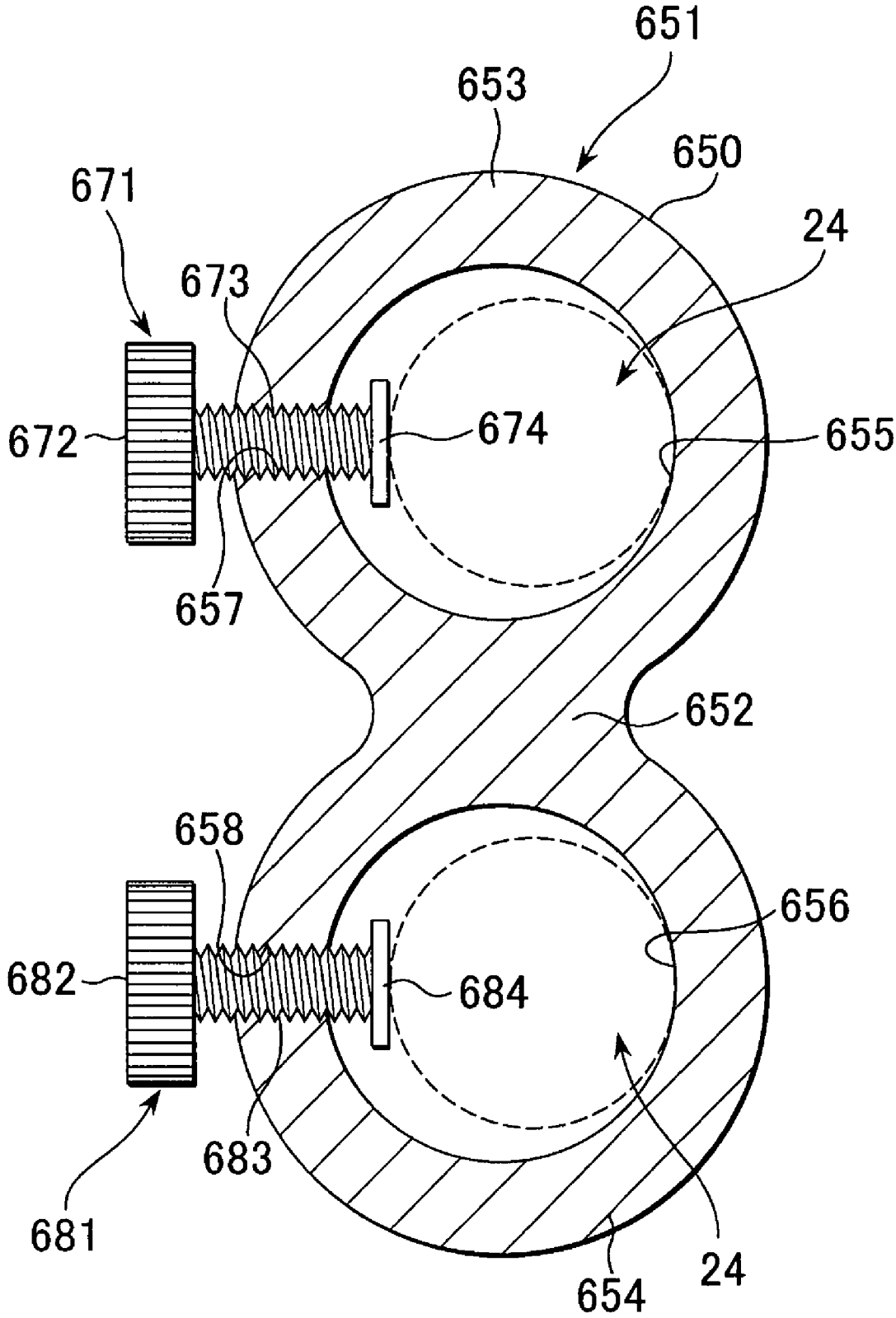
FIG. 44 is a longitudinal sectional view showing the personal ornament according to the eleventh embodiment of the invention.

Eleventh Embodiment of the Invention (FIG. 43, FIG. 44)

FIG. 43 is a perspective view showing a personal ornament according to the eleventh embodiment of the invention. As shown in FIG. 43, a retainer 651 of the eighth embodiment is molded out of a material such as a metal or a resin and so forth, and retainer 650 is formed substantially in the shape of eyeglasses (in the shape of the number "8")), as viewed from the side surface. The retainer 650 comprises a cylindrical one end part 653, a cylindrical other end part 654 which are connected parallel with each other via a barrel part 652. One end side 561 of a personal ornament body 24 can be detachably inserted into the one end part 653, and the diameter of the 656 is substantially the same as the outer diameter of the other end side 562.

One space (through part) 655 is formed inside the cylindrical one end part 653, and the diameter of the one space 655 is larger than the diameters of the one end side and outer cap 26 of the personal ornament body 24. As a result, the one end side of the personal ornament body 24 can be freely inserted into or extracted from the cylindrical one end part 653. Further, the other space 656 of the other end part 654 has substantially the same diameter as the one space 655 of the one end part 653, and the diameter of the other space 656 is substantially identical with the outer diameter of the other end side 562 of the personal ornament body 24.

The other end side 562 and outer cap 27 of the personal ornament body 24 can be detachably inserted into the other end part 654. That is, according to the retainer 651 of the present embodiment, the other end side 562 and outer cap 27 of the personal ornament body 24 can be inserted into the other space 656 of the other end part 654, while outer cap 26 can be detachably inserted into the one space 655 of the one end part 653 in the manner that the outer cap 26 can be inserted into or extracted from the one space 655 of the one end part 653. A screw hole 657 is bored in a sidewall of the one end part 653, and a screw hole 658 is also bored in a sidewall of the other end part 654 in parallel with the screw hole 657

With such a configuration, a fastening screw 671 is screwed into the screw hole 657 of the one end part 653 from the side. That is, the fastening screw 671 has a large diameter head part 672 and a screw part 673 protruding from the center of the head part 672 wherein when the head part 672 is manually operated, the fastening screw 671 can be inserted into or extracted from the screw hole 657. Further, a fastening screw 681 is screwed into the screw hole 658 of the one end part 654 from the side. That is, the fastening screw 681 has a large diameter head part 682 and a screw part 683 protruding from the center of the head part 682 wherein when the head part 682 is manually operated, the fastening screw 681 can be inserted into or extracted from the screw hole 658.

FIG. 44 is a sectional view taken along a plane orthogonal to an axis of the retainer 651. As shown in FIG. 44, the diameter of the one end part 653 is substantially the same as that of the other end part 654. The screw part 673 of the fastening screw 671 protrudes from the inner peripheral surface side of the one end part 653 of the retainer 651. A push-on plate 674 having a wide width is provided on the tip end of the screw part 673 of the fastening screw 671. The push-on plate 674 can be pressed to contact the inner surface of the retainer 650 by pushing the personal ornament body 24. The screw part 683 of the 681 protrudes from the inner surface side of the other end part 654 of the retainer 651. A push-on plate 684 having a wide width is provided on the tip end of the screw part 683 of the fastening screw 671. The push-on plate 684 can be pressed to contact the inner surface of the retainer 650 by pushing the personal ornament body 24.

With such a configuration, the one end side 561 and the other end side 562 of the personal ornament body 24 can be easily fitted to and removed from the retainer 651 by merely implementing turning operation of the fastening screw 671 and the 681 while detachably inserting the personal ornament body 24 into the retainer 651. The personal ornament body 24 retained by the retainer 651 is rendered in an adhesion state with the magnetic attraction force of the internal magnets, and is prevented from being come off reliably in a peripheral direction with a holding force of the retainer 651. Accordingly, there is no fear of losing the personal ornament body 24 caused by sudden dropping-off and so forth and it is not come off by tearing the personal ornament body 24 from the outside of the wearer, so that theft and so forth can be prevented with more assurance.

Figure 45:
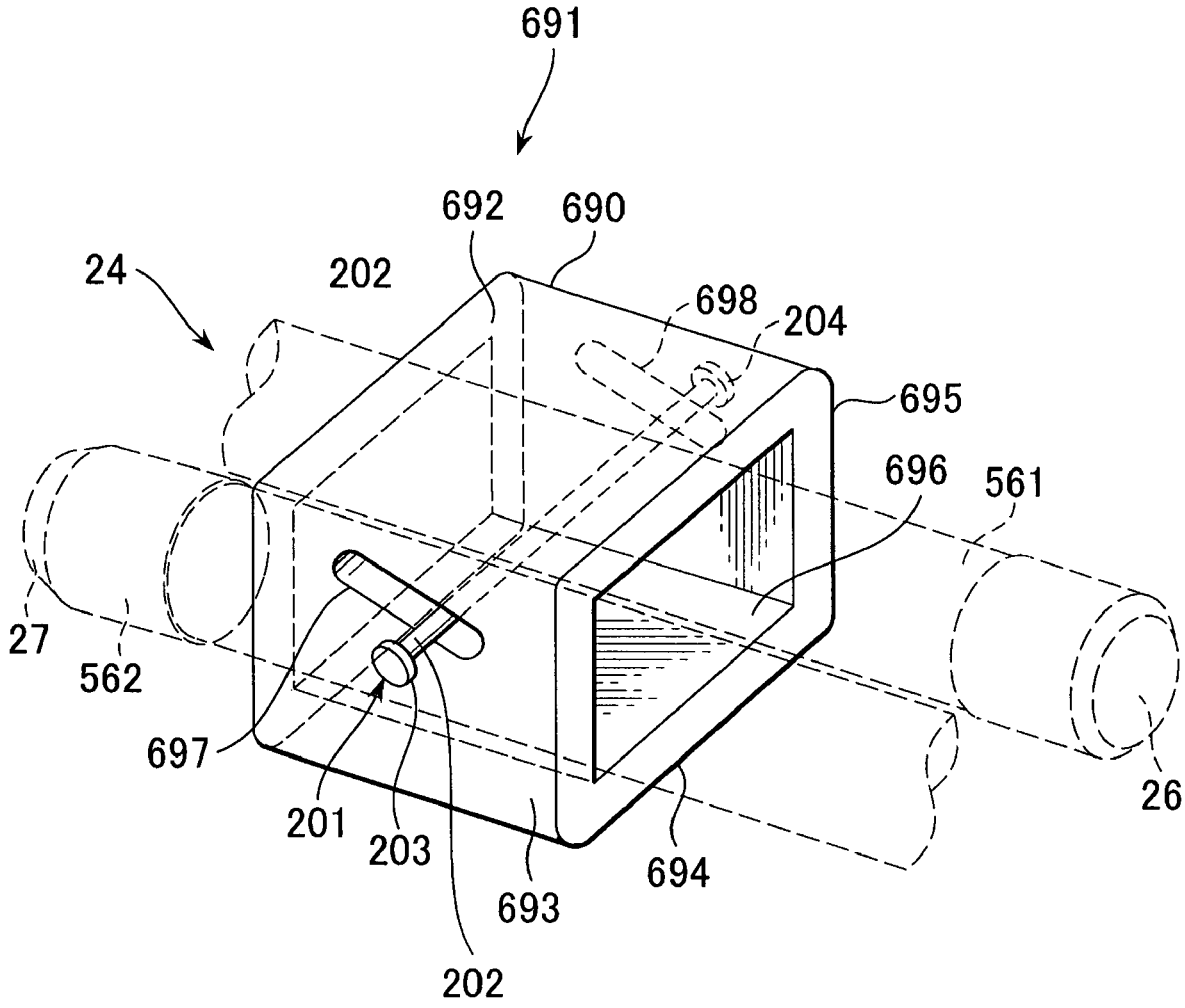
FIG. 45 is a perspective view showing a personal ornament according to a twelfth embodiment of the invention.
Figure 46:
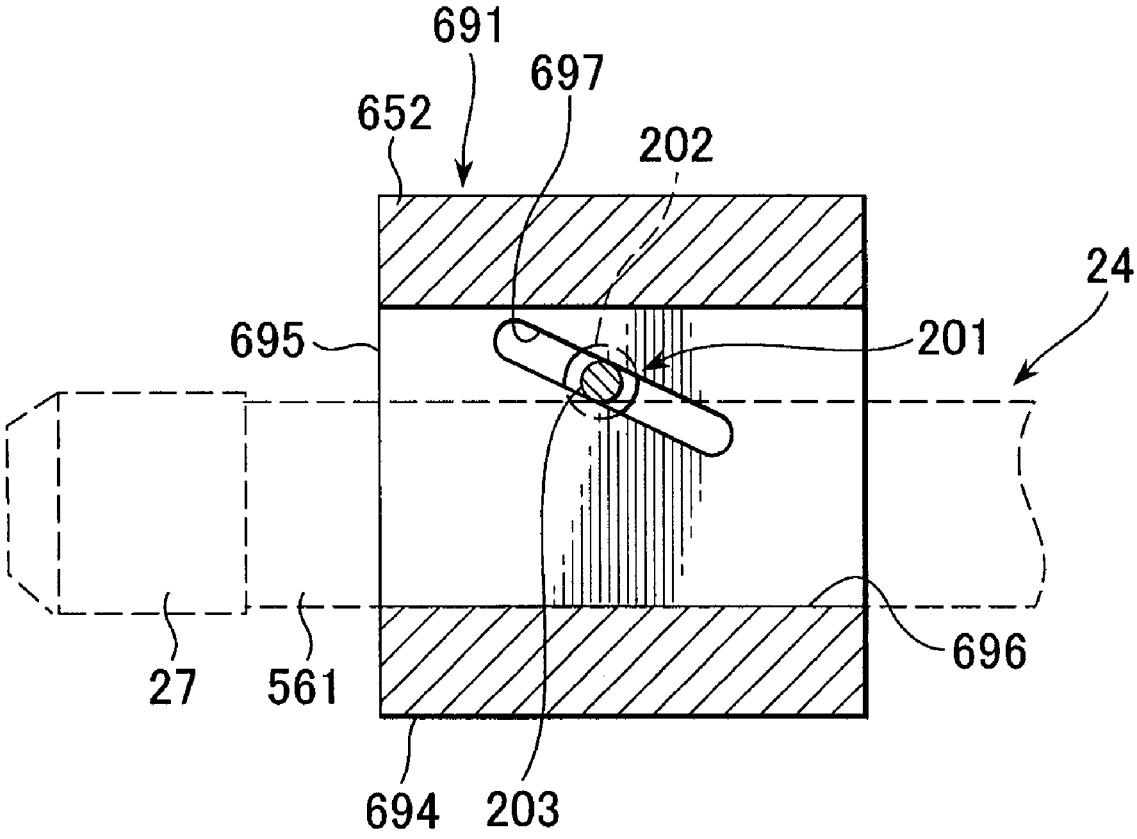
FIG. 46 is a longitudinal sectional view showing the personal ornament according to the twelfth embodiment of the invention.

Twelfth Embodiment (FIG. 45 and FIG. 46)

FIG. 45 is a perspective view showing a personal ornament according to the twelfth embodiment of the invention. As shown in FIG. 45, a retainer 691 of the invention is molded out of a material such as a metal or a resin and so forth, and it is formed in substantially a rectangular cylinder which is opened at both sides. A retainer body 690 of the retainer 691 has an upper piece 692, side piece (left side piece) 693, a lower piece 694 and a side piece (right side piece) 695. The interior of the retainer 691 forms a space (through part) 696, and one end side 561 and other end side 562 of the personal ornament body 24 can be detachably caused to pass through the though part 696 while the one end side 561 and other end side 562 are aligned in parallel with each other.

Inclined holes 697, 698 which are inclined at a predetermined angle, respectively, are bored in the opposite side piece (left side piece) 693 and side piece (right side piece) 695 of the retainer body 690. A retainer pin 201 is inserted into the inclined holes 697, 698. The retainer pin 201 has a shaft part 202 having a length to be inserted into the inclined holes 697, 698, and both tip ends of the shaft part 202 protrude outward the side piece (left side piece) 693 and side piece (right side piece) 695. Large diameter head parts 203, 204 are integrally provided on the both tip ends of the shaft part 202. The inclined holes 697, 698 are symmetrical long holes and have the same height, length and inclined angles.

FIG. 46 is a sectional view taken along a plane orthogonal to an axis of the retainer 691 shown in FIG. 45. As shown in FIG. 46, the height of the lower end portions of the inclined holes 697, 698 are set at a position lower than the top portions of the one end side 561 and other end side 562 of the personal ornament body 24. The heights of the higher end portions of the inclined holes 697, 698 are set at a position lower than the top portions of the one end side 561 and other end side 562 of the personal ornament body 24.

Accordingly, when using the personal ornament body personal ornament 24, as shown in FIG. 21, if the one end side 561 of the personal ornament 24 is inserted into the retainer body 690 from the lower portions of the inclined holes 697, 698 toward the higher portions thereof (leftward in FIG. 46), the large diameter head part 203 is pushed up and hence the one end side 561 can be smoothly inserted into the inclined holes 697, 698. Meanwhile, if the one end side 561 of the personal ornament 24 is pulled out from the higher portions of the inclined holes 697, 698 toward the lower portions thereof (rightward in FIG. 46), the large diameter head part 203 is interlocked with the pulling out of the one end side 561 toward the lower portions with a friction force, so that the large diameter head part 203 presses down the one end side 561 of the personal ornament body 24, thereby preventing the personal ornament body 24 from being come off.

According to the present embodiment, the one end side 561 and the other end side 562 of the personal ornament body 24 can be easily fitted to and removed from the retainer 691 by merely detachably inserting the 24 into the retainer 691. The personal ornament body 24 retained by the retainer 691 is rendered in an adhesion state with the magnetic attraction force of the internal magnets, and is prevented from being come off reliably in a peripheral direction with a holding force of the retainer 691. Accordingly, there is no fear of losing the personal ornament body 24 caused by sudden dropping-off and so forth and it is not come off by tearing the personal ornament body 24 from the outside of the wearer, so that theft and so forth can be prevented with more assurance.

Figure 47:
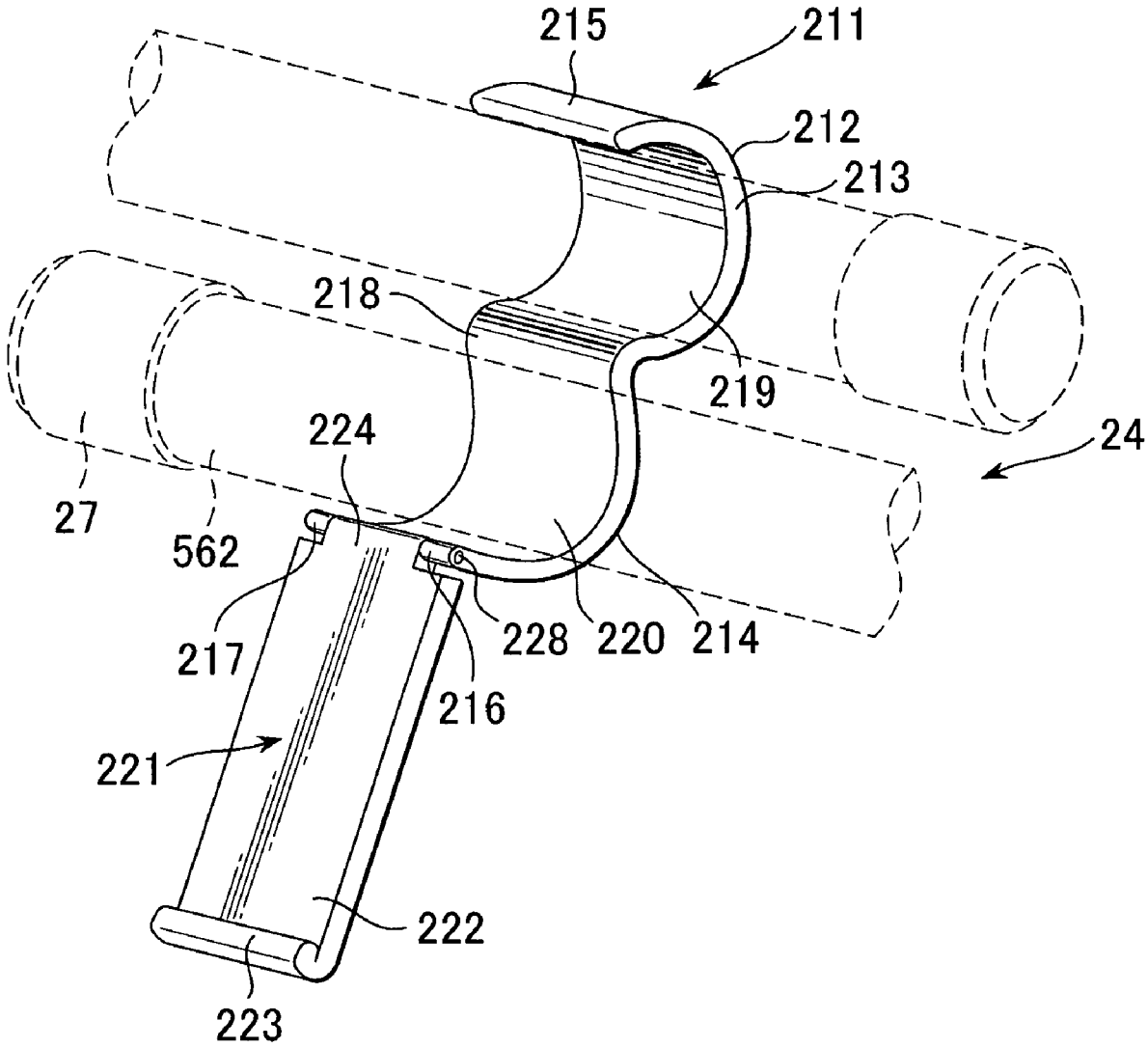
FIG. 47 is a perspective view showing a personal ornament according to a thirteenth embodiment of the invention.
Figure 48:
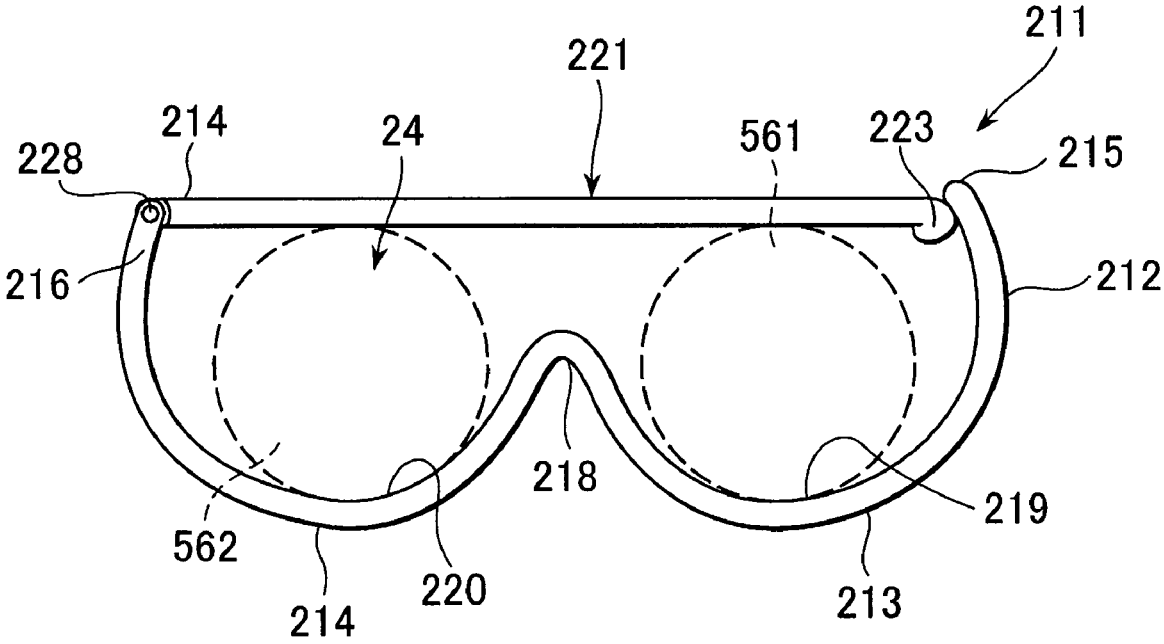
FIG. 48 is a side view showing the personal ornament according to the thirteenth embodiment of the invention.

Thirteenth Embodiment (FIG. 47 and FIG. 48)

FIG. 47 is a perspective view showing a personal ornament according to the thirteenth embodiment of the invention. As shown in FIG. 47, a retainer 211 has a shape of an alligator clip, and comprises a retainer body 212 forming a pair of pieces, a closing plate 221 which are openably and closably connected with each other via a hinge shaft 228.

The retainer body 212 is configured as a curved piece having a predetermined width and comprises a curved piece 213 having a semi-circular arc plate-shape for pressing and retaining substantially a half of an outer peripheral surface of one end side of a personal ornament body 24 from the outside, and a curved piece 214 having a semi-circular arc plate-shape for pressing and retaining substantially a half of an outer peripheral surface of other end side of the personal ornament body 24 from the outside, wherein the curved pieces 213 and 214 for an integrated curved plate while they are adjacent to each other. A hinge cylinder 216 having a through hole along the width of the plate is integrally formed at one side part of the outside end portion of the curved piece 213, and other hinge part 217 having a through hole along the width of the plate is formed at the other side part of the outside end portion of the curved piece 213 a regular interval, wherein the other hinge cylinder 217 and hinge cylinder are coaxially provided.

An intermediate closing part 218 having a flat surface shape is formed between a concave surface side of the curved piece 213 and that of the curved piece 214. One end part 215 of the curved piece 213 is formed to have a deep curvature serving as a holding part.

The closing plate 221 has a flat plate shape and has a width substantially the same width of the retainer 211. The closing plate 221 has a retainer claw 223 having a semi-circular arc plate-shape for pressing and retaining the substantially half of the outer peripheral surface of the one end side of the personal ornament body 24, and has a hinge cylinder 224 at the other end side. The hinge cylinder 224 is disposed co-axially between the hinge cylinder 216 and other hinge part 217 of the retainer body 212. A hinge shaft 228 is inserted into the hinge cylinder 216, other hinge part 217 and hinge cylinder 224, and the retainer body 212 and closing plate 221 can be tuned about the hinge shaft 228.

FIG. 48 is a side view showing the personal ornament according to the present embodiment. As shown in FIG. 48, when the closing plate 221 is turned about the hinge shaft 228 relative to the retainer 211 to render the retainer 211 to be in closed state, the retainer claw 223 of the closing plate 221 is elastically engaged with the one end part 215 of the retainer body 212. As a result, one end side 561 and the other end side 562 of the personal ornament body 24 can be pressed and held by the closing plate 221 and retainer body 212.

According to the present embodiment, the one end side 561 and other end side 562 of the personal ornament body 24 is easily fitted to or removed from the retainer 211 by merely detachably inserting the personal ornament body 24 into the retainer 211. Further, the personal ornament body 24 retained by the retainer 211 is rendered in an adhesion state with the magnetic attraction force of the internal magnets, and is prevented from being come off reliably in a peripheral direction with a holding force of the retainer 211. Accordingly, there is no fear of losing the personal ornament body 24 caused by sudden dropping-off and so forth and it is not come off by tearing the personal ornament body 24 from the outside of the wearer, so that theft and so forth can be prevented with more assurance.

Figure 49:
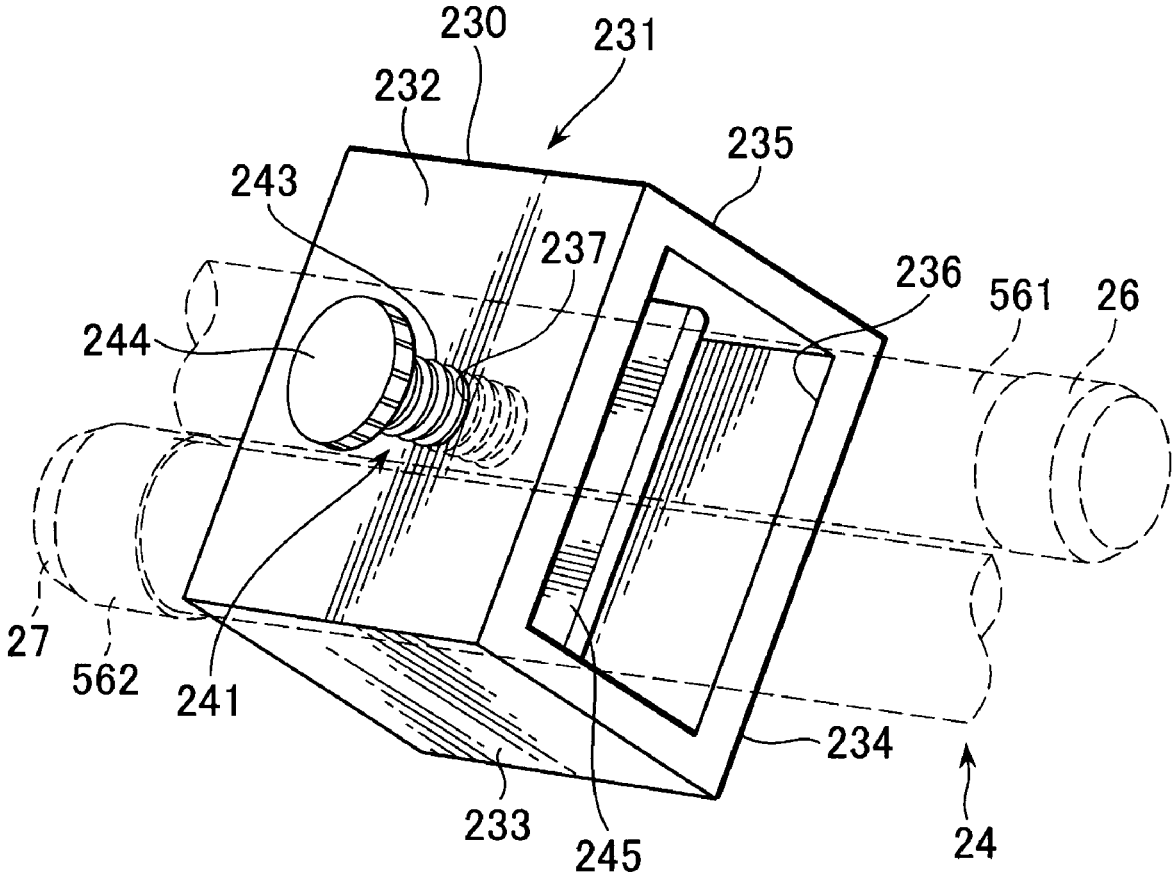
FIG. 49 is a perspective view showing a personal ornament according to a fourteenth embodiment of the invention.
Figure 50:
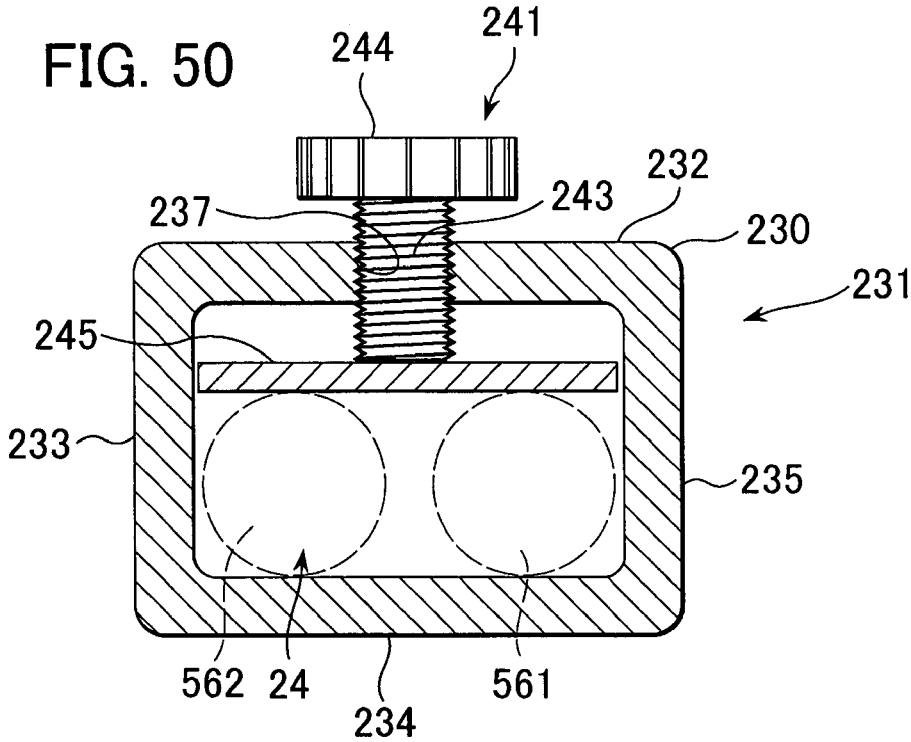
FIG. 50 is a longitudinal sectional view showing the personal ornament according to the fourteenth embodiment of the invention.

Fourteenth Embodiment (FIG. 49, FIG. 50)

FIG. 49 is a perspective view showing a personal ornament according to the twelfth embodiment of the invention. As shown in FIG. 49, a retainer 231 of the invention is molded out of a material such as a metal or a resin and so forth, and it is formed in substantially a rectangular cylinder which is opened at both sides. A retainer body 230 of the retainer 231 has an upper piece 232, side piece (left side piece) 233, a lower piece 234 and a side piece (right side piece) 235. The interior of the retainer 231 forms a space (through part) 236, and one end side 561 and other end side 562 of the personal ornament body 24 can be detachably caused to pass through the though part 236 while the one end side 561 and other end side 562 are aligned in parallel with each other.

With such a configuration, a fastening screw 241 is screwed into a screw hole 237 bored in the upper piece 232 from above. That is, the fastening screw 241 has a large diameter head part 244 and a screw part 243 protruding from the center of the large diameter head part 244. When the large diameter head part 244 is manually operated, the fastening screw 241 can be inserted into or extracted from the screw hole 237.

FIG. 50 is a sectional view taken along a plane orthogonal to an axis of the retainer 231. As shown in FIG. 50, a push-on plate 245 having a wide width is provided on the tip end of the screw part 243 of the fastening screw 241. The push-on plate 245 can be pressed to contact the inner surface of the retainer 230 by pushing the personal ornament body 24.

With such a configuration, the one end side 561 and other end side 562 of the personal ornament body 24 is easily fitted to or removed from the retainer 231 by merely detachably inserting the personal ornament body 24 into the retainer 231, and implementing turning operation of the fastening screw 241. Further, the personal ornament body 24 retained by the retainer 231 is rendered in an adhesion state with the magnetic attraction force of the internal magnets, and is prevented from being come off reliably in a peripheral direction with a holding force of the retainer 231. Accordingly, there is no fear of losing the personal ornament body 24 caused by sudden dropping-off and so forth and it is not come off by tearing the personal ornament body 24 from the outside of the wearer, so that theft and so forth can be prevented with more assurance.

Figure 51:
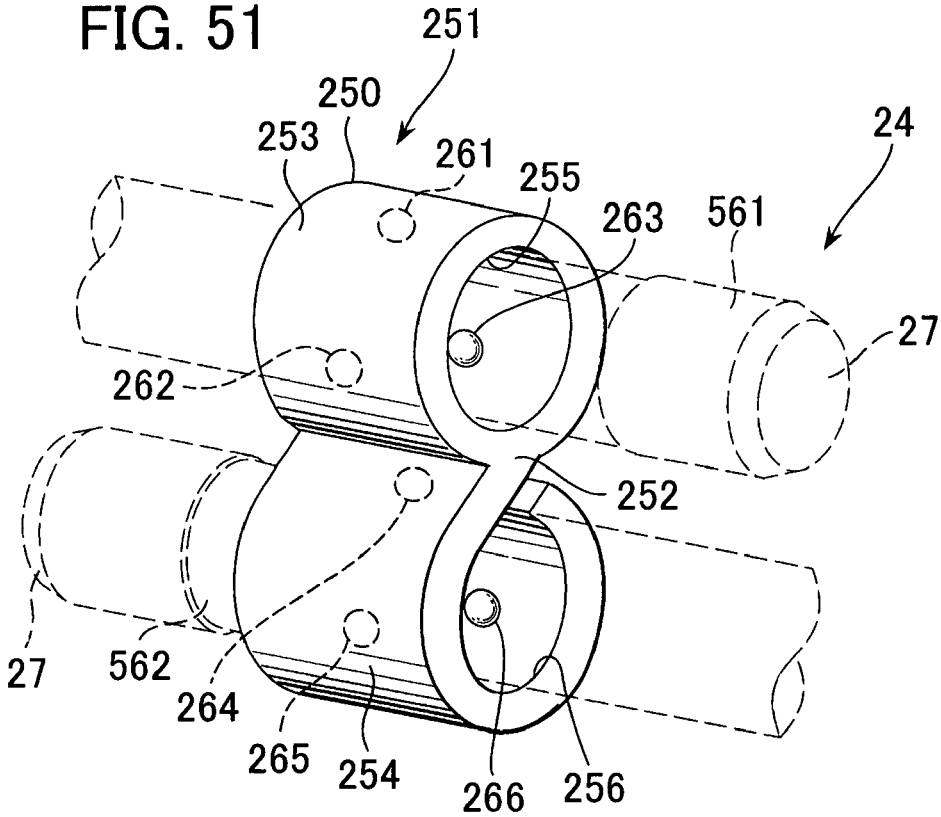
FIG. 51 is a perspective view showing a personal ornament according to a fifteenth embodiment of the invention.
Figure 52:
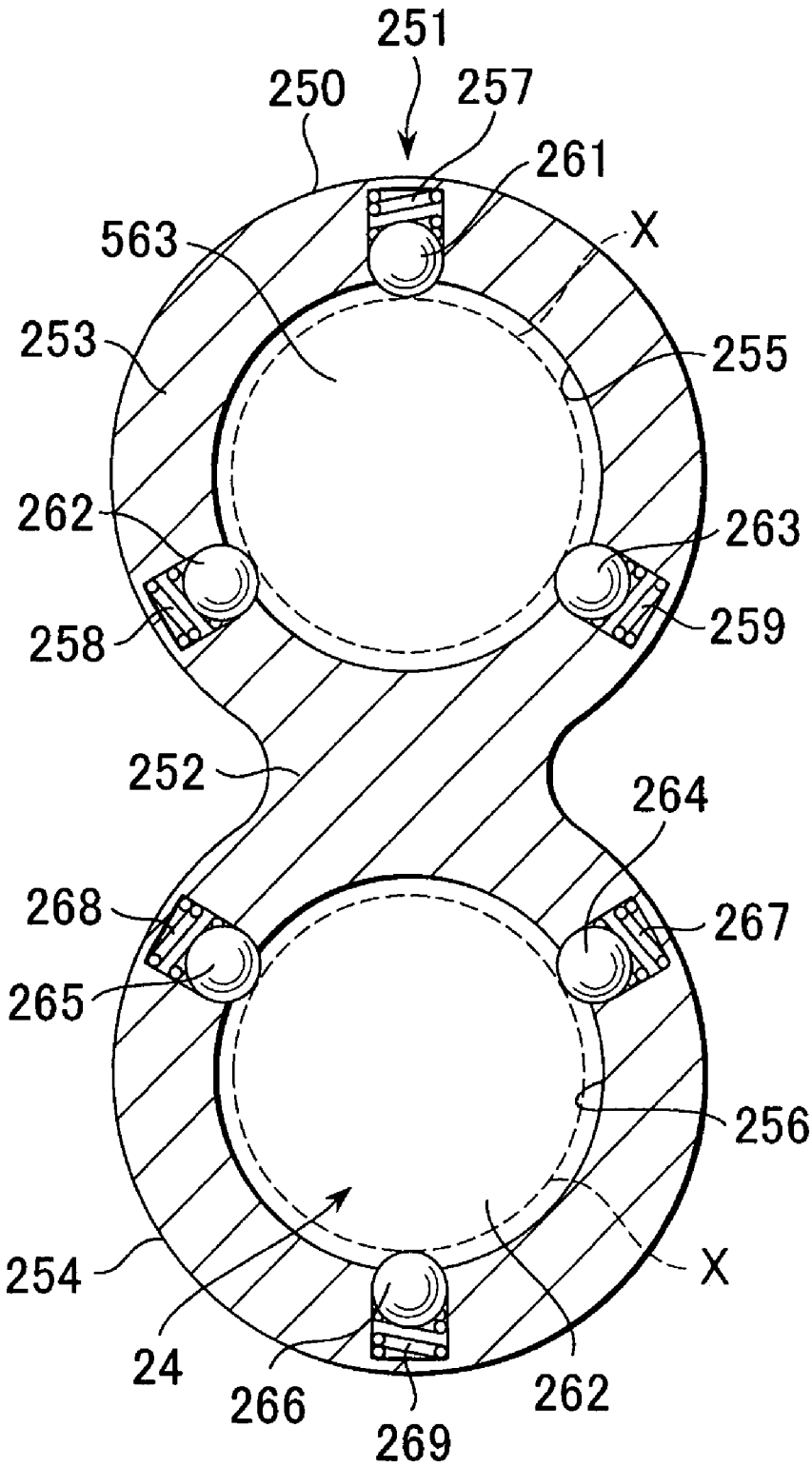
FIG. 52 is a longitudinal sectional view showing the personal ornament according to the fifteenth embodiment of the invention.

Fifteenth Embodiment (FIG. 51, FIG. 52)

FIG. 51 is a perspective view showing a personal ornament according to the fifteenth embodiment of the invention. As shown in FIG. 51, a retainer 251 of the fifteenth embodiment is molded out of a material such as a metal or a resin and so forth, and has a retainer body 250 formed in substantially in eyeglasses (in the shape of the number "8")), as viewed from the side surface. The retainer body 250 comprises a cylindrical one end part 253 through which one end side 561 of the personal ornament 24 can freely pass and a cylindrical other end part 254 through which other end side 562 of the personal ornament body 24 can freely pass, and the one end part 253 and other end part 254 are connected with each other via a barrel part 252, thereby forming a frame body having the shape of integrally structured eyeglasses.

One space (through part) 255 is formed in the one end part 253 and the diameter of the one space 255 is the one through which one end side 561 and outer cap 27 of the personal ornament body 24 can pass. As a result, the one end side of the personal ornament body 24 can be freely inserted into or retracted from the one end part 253. Meanwhile, the diameter of the other space 256 of the other end part 254 is the one through which the other end side 562 and outer cap 27 of the personal ornament body 24 can pass. Accordingly, the one end side of the personal ornament body 24 can be freely inserted into or extracted from the one end part 253.

According to the retainer 251 of this, the one end side 561 and outer cap 27 of the personal ornament body 24 can freely pass through the other space 256 of the other end part 254, and likewise the other end side 562 and outer cap 27 of the personal ornament body 24 can freely pass through the one space 255 in a state where the other end side 562 and outer cap 27 can be inserted into or extracted from the one space 255. Three balls i.e. balls 261, 262, 263 are housed in the one end part 253 in a peripheral direction at equal intervals. Three balls i.e. balls 264, 265, 266 are also housed in the other end part 254 in a peripheral direction thereof at equal intervals.

FIG. 52 is a sectional view taken along a plane orthogonal to an axis of the retainer 231. As shown in FIG. 52, the diameter of the one end part 253 is substantially the same as that the other end part 254. Three balls 261, 262, 263 are disposed on the inner peripheral surface of the one end part 253 in the peripheral direction thereof at equal intervals. The ball 261 is housed in a hole of the one end part 253 and is pressed toward the inner peripheral side of the one end part 253 by a spring (compression coil spring) 257 with resiliency. Meanwhile, the diameter of the inner end part of the hole of the one end part 253 is smaller than the diameter of the ball 261 so that the ball 261 is not dropped into the inside of the one end part 253. The holes inside the one end part 253 are closed at the outer peripheral sides, and the spring (compression coil spring) 257 is housed in the closed space so as to always press the ball 261 toward the inside of the one end part 253.

Likewise, the ball 262 is housed in a hole of the one end part 253 and is pressed toward the inner peripheral side of the one end part 253 by a spring (compression coil spring) 258 with resiliency. Meanwhile, the diameter of the inner end part of the hole of the one end part 253 is smaller than the diameter of the ball 262 so that the ball 262 is not dropped into the inside of the one end part 253. The hole inside the one end part 253 is closed at the outer peripheral side of the one end part 253, and the spring (compression coil spring) 258 is housed in the closed space so as to always press the ball 262 toward the inside of the one end part 253.

Further, the ball 263 is housed in a hole of the one end part 253 and is pressed toward the inner peripheral side of the one end part 253 by a spring (compression coil spring) 259 with resiliency. Meanwhile, the diameter of the inner end part of the hole of the one end part 253 is smaller than the diameter of the ball 263 so that the ball 263 is not dropped into the inside of the one end part 253. The hole inside the one end part 253 is closed at the outer peripheral side of the one end part 253, and the spring (compression coil spring) 259 is housed in the closed space so as to always press the ball 263 toward the inside of the one end part 253.

Still further, the ball 264 is housed in a hole of the other end part 254 and is pressed toward the inner peripheral side of the other end part 254 by a spring (compression coil spring) 267 with resiliency. Meanwhile, the diameter of the inner end part of the hole of the other end part 254 is smaller than the diameter of the ball 264 so that the ball 264 is not dropped into the inside of the other end part 254. The hole inside the other end part 254 is closed at the outer peripheral side of the other end part 254, and the spring (compression coil spring) 267 is housed in the closed space so as to always press the ball 264 toward the inside of the other end part 254.

Further, the ball 265 is housed in a hole of the other end part 254 and is pressed toward the inner peripheral side of the other end part 254 by a spring (compression coil spring) 268 with resiliency. Meanwhile, the diameter of the inner end part of the hole of the other end part 254 is smaller than the diameter of the ball 265 so that the ball 265 is not dropped into the other end part 254. The hole inside the other end part 254 is closed at the outer peripheral side of the other end part 254, and the spring (compression coil spring) 268 is housed in the closed space so as to always press the ball 265 toward the inside of the other end part 254.

Further, the ball 266 is housed in a hole of the other end part 254 and is pressed toward the inner peripheral side of the other end part 254 by a spring (compression coil spring) 269 with resiliency. Meanwhile, the diameter of the inner end part of the hole of the other end part 254 is smaller than the diameter of the ball 266 so that the ball 266 is not dropped into the other end part 254. The hole inside the one end part 253 is closed at the outer peripheral side of the other end part 254, and the spring (compression coil spring) 269 is housed in the closed space so as to always press the ball 266 toward the other end part 254.

In the case where one end side of the personal ornament body 250 is inserted into the one end part 253 by the balls 261, 262, 263 having such a configuration, the one end side of the personal ornament body 24 can pass through the one end part 253 by an arbitrary length with a resilient force of the springs (compression coil springs) 257, 258, 258.

Likewise, in the case where the other end side of the retainer body 250 is inserted into the other end part 254 by the balls 264, 265, 266, the other end side of the personal ornament body 24 can pass through the other end part 254 by an arbitrary length with resilient forces of the springs (compression coil springs) 267, 268, 269.

In such a manner, the personal ornament of the fifteen embodiment of the invention is configured to comprise a plurality of columnar metallic magnets which are inserted into the string-shaped tube, and which are made of a flexible material and capable of being twisted and bent, wherein the N poles and S poles of the respective magnets are arranged on columnar peripheral surfaces of the magnets, and the retainer capable of retaining the one end side and other end side of the personal ornament body which are fitted to each other in a state where the one end side and other end side of the personal ornament body are aligned in parallel with each other.

Accordingly, according to the present embodiment, the one end side and other end side of the personal ornament body 24 can be detachably fitted to the retainer. Further, the personal ornament body 24 retained by the retainer 251 is rendered in an adhesion state with the magnetic attraction force of the internal magnets, and is prevented from being come off reliably in a peripheral direction with a holding force of the retainer 251 having the shape of the eyeglasses. Accordingly, there is no fear of losing the personal ornament body 24 caused by sudden dropping-off and so forth and it is not come off by tearing the personal ornament body 24 from the outside of the wearer, so that theft and so forth can be prevented with more assurance.

Figure 53:
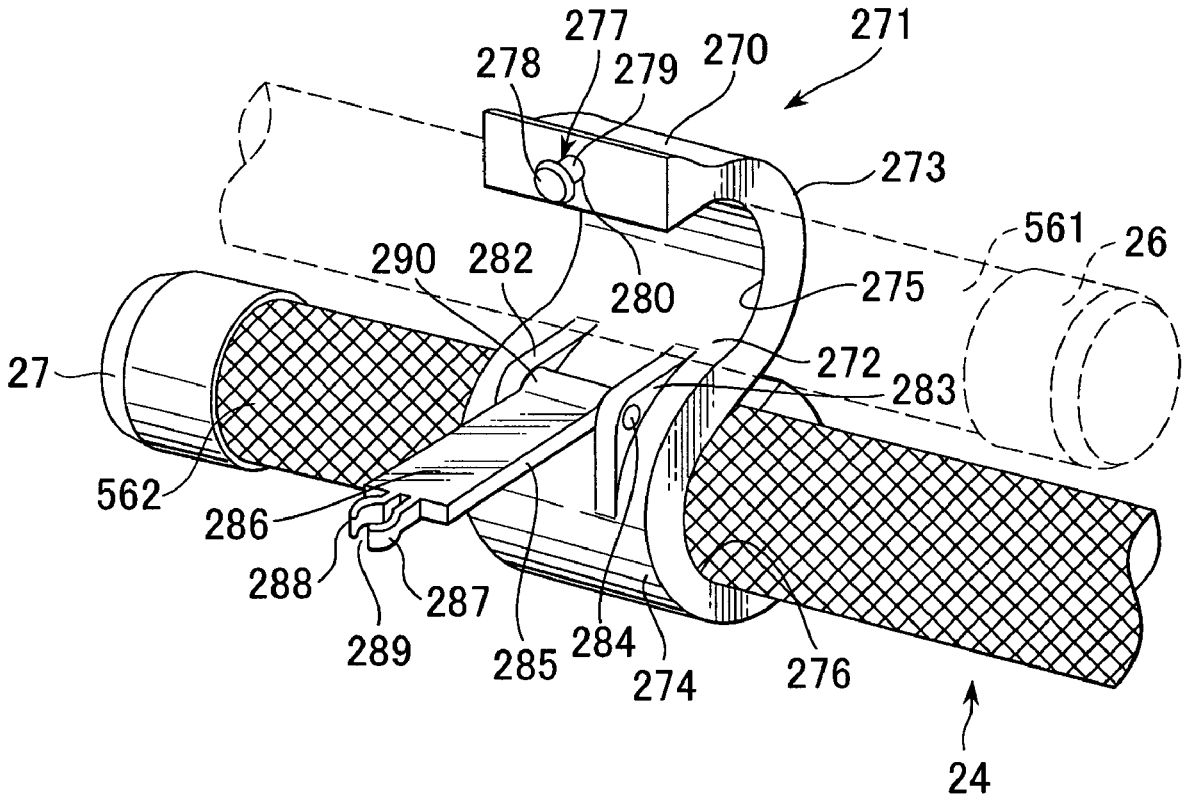
FIG. 53 is a perspective view showing a personal ornament according to a sixteenth embodiment of the invention.
Figure 54:
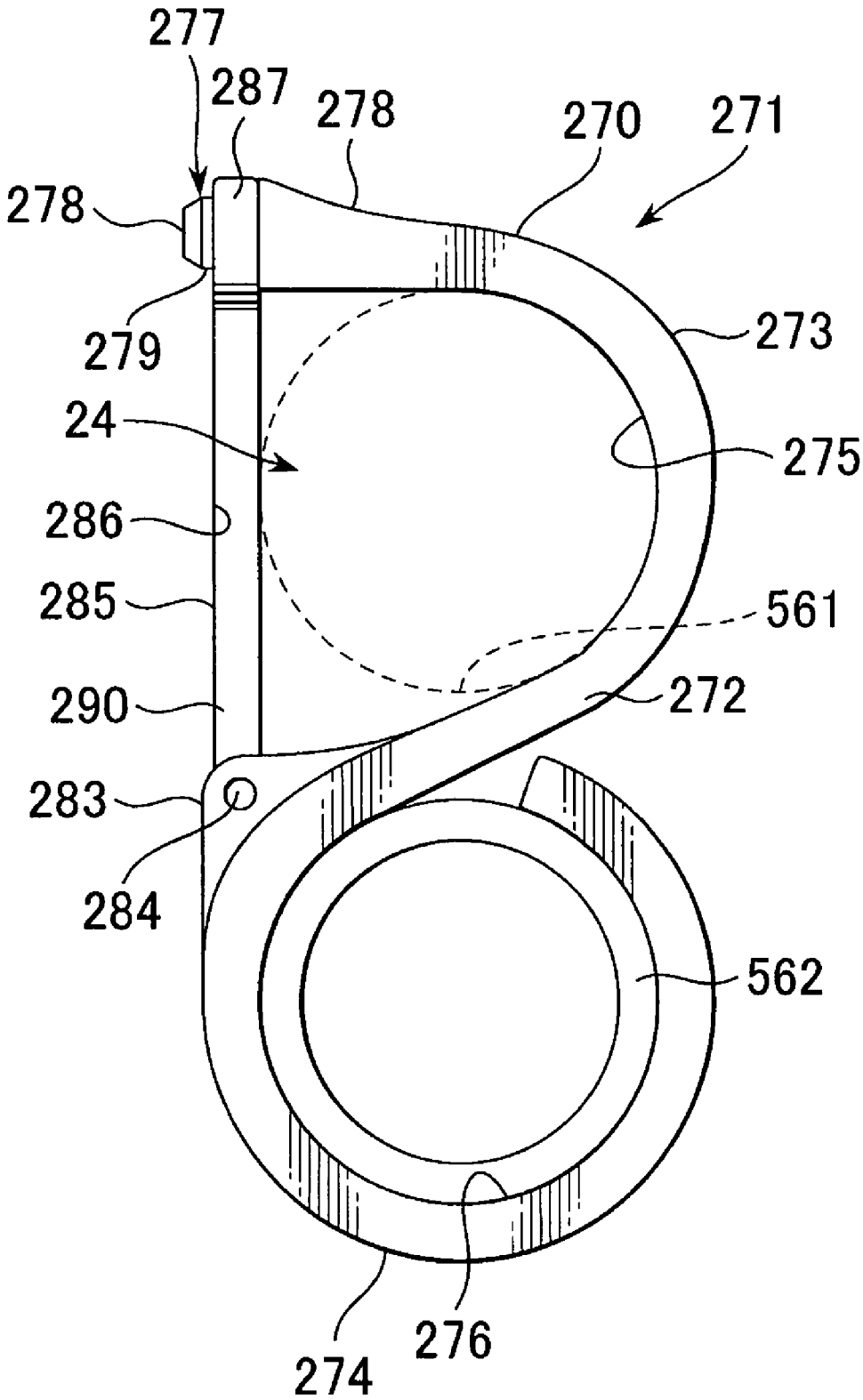
FIG. 54 is a side view showing the personal ornament according to the sixteenth embodiment of the invention.

Sixteenth Embodiment (FIG. 53 and FIG. 54)

FIG. 53 is a perspective view showing a personal ornament according to the sixteenth embodiment of the invention. As shown in FIG. 53, a retainer 271 of the present embodiment is molded out of a material such as a metal or a resin and so forth, and has a retainer body 270 formed in substantially in an inverted S-shape as viewed from the side surface. The retainer body 270 comprises a semi-cylindrical personal ornament detachable cylinder part 273 and a cylindrical fixed cylinder part 274 which is fixed to other end side 562 of the personal ornament body 24 wherein the semi-cylindrical personal ornament detachable cylinder part 273 and cylindrical fixed cylinder part 274 are connected with each other via central part 272.

One space (through part) 275 is formed inside the personal ornament detachable cylinder part 273, and the curvature radius of the one space 275 is larger than the diameters of the one end side and outer cap 26 of the personal ornament body 24. As a result, the one end side 561 of the personal ornament body 24 can be freely inserted into or extracted from the personal ornament detachable cylinder part 273. Meanwhile, other space 276 of the fixed cylinder part 274 is smaller than the one space 275 of the personal ornament detachable cylinder part 273, while the diameter of the other space 276 is substantially the same as the outer diameter of the other end side 562 of the personal ornament body 24.

The other end side 562 and outer cap 27 are preliminarily inserted into the fixed cylinder part 274 and fixed thereto. That is, according to the retainer 271 of the present embodiment, the other end side 562 and outer cap 27 are inserted into and fixed to the other space 276 of the fixed cylinder part 274, while the outer cap 26 of the personal ornament body 24 can pass through the one space 275 of the personal ornament detachable cylinder part 273 in a state where it is inserted into or extracted from the personal ornament detachable cylinder part 273.

Meanwhile, the upper half of the retainer 271 has a shape of an alligator clip, and it is configured that a closing plate 285 serving as a clipping piece is closably connected to the retainer 271 by a hinge shaft 284. The personal ornament detachable cylinder part 273 is configured as a curved piece having a predetermined width and it has a semi-circular arc plate shape so as to press a substantially half part of the outer peripheral surface of the one end side of the personal ornament body 24 from the outside. Meanwhile, the closing plate 285 is structured by a flat plate shaped closing body 286 so as to press a substantially half part of the outer peripheral surface of the other end side of the personal ornament body 24 from the outside.

Opposite hinge ears 282, 283 stand upright on the outer end part of the personal ornament detachable cylinder part 273 and they are supported by the hinge shaft 284. Meanwhile, a hinge end 290 of the closing plate 285 is supported by the hinge shaft 284, and a pin shaft holding piece 287 and a pin shaft holding piece 288 are provided at the other end of the closing plate 285 while an opening 289 is provided between the pin shaft holding pieces 287 and 288.

Further, a pin shaft 277 protrudes from the tip end of the personal ornament detachable cylinder part 273. A large diameter head part 278 is formed on the tip end of the pin shaft 277 and a screw part 279 is formed on the outer periphery of the pin shaft 277. The screw part 279 is screwed into a screw hole 280 of the personal ornament detachable cylinder part 273.

FIG. 54 is a view showing a state of use of the retainer 271 in the case where the personal ornament body 24 is retained by the retainer 271. As shown in FIG. 54, the personal ornament body 24 is caused to pass through the retainer 271 and a closing plate body 286 is turned about the hinge shaft 284 as a fulcrum so as to cause the pin shaft 277 to retain the pin holding pieces 287 and 288.

With such a configuration, the one end side and other end side of the personal ornament body 24 can be detachably fitted to the retainer. Further, the personal ornament body 24 retained by the retainer 271 is rendered in an adhesion state by the magnetic attraction force of the internal magnets, and moreover it is prevented from being come off reliably in the peripheral direction with a holding force of the retainer 271. Accordingly, there is no fear of losing the personal ornament body 24 caused by sudden dropping-off and so forth and it is not come off by tearing the personal ornament body 24 from the outside of the wearer, so that theft and so forth can be prevented with assurance.

Further, according to the present embodiment, the personal ornament is configured to comprise the personal ornament body formed by inserting a plurality of columnar metallic magnets into a string-shaped tube made of a flexible material and capable of being twisted and bent, wherein N poles and S poles of the respective magnets are alternately arranged on opposite peripheral surface of the columnar magnets, and a retainer fixed to other end side of the personal ornament body and capable of fixing one end of the personal ornament body to the other end side of the personal ornament body in a state where one end side and other end side of the personal ornament body are aligned in parallel with each other.

As described above, according to the sixteenth embodiment of the invention, it is configured to comprise a plurality of columnar metallic magnets which are inserted into the string-shaped tube, and which is flexible and capable of being twisted and bent, wherein the N poles and S poles of the respective magnets are arranged on opposite peripheral surfaces of the magnets, and the retainer capable of retaining the one end side and other end side of the personal ornament which are fitted to each other in a state where the one end side and other end side of the personal ornament are aligned in parallel with each other.

Accordingly, the other end side 562 of the personal ornament body 24 is inserted into and fitted to the fixed cylinder part 274, and when the personal ornament body 24 is used, the one end side 561 can be inserted into the personal ornament detachable cylinder part 273 so that the personal ornament body 24 can be adjusted as a necklace having a prescribed diameter and worn around the neck.

Figure 55:
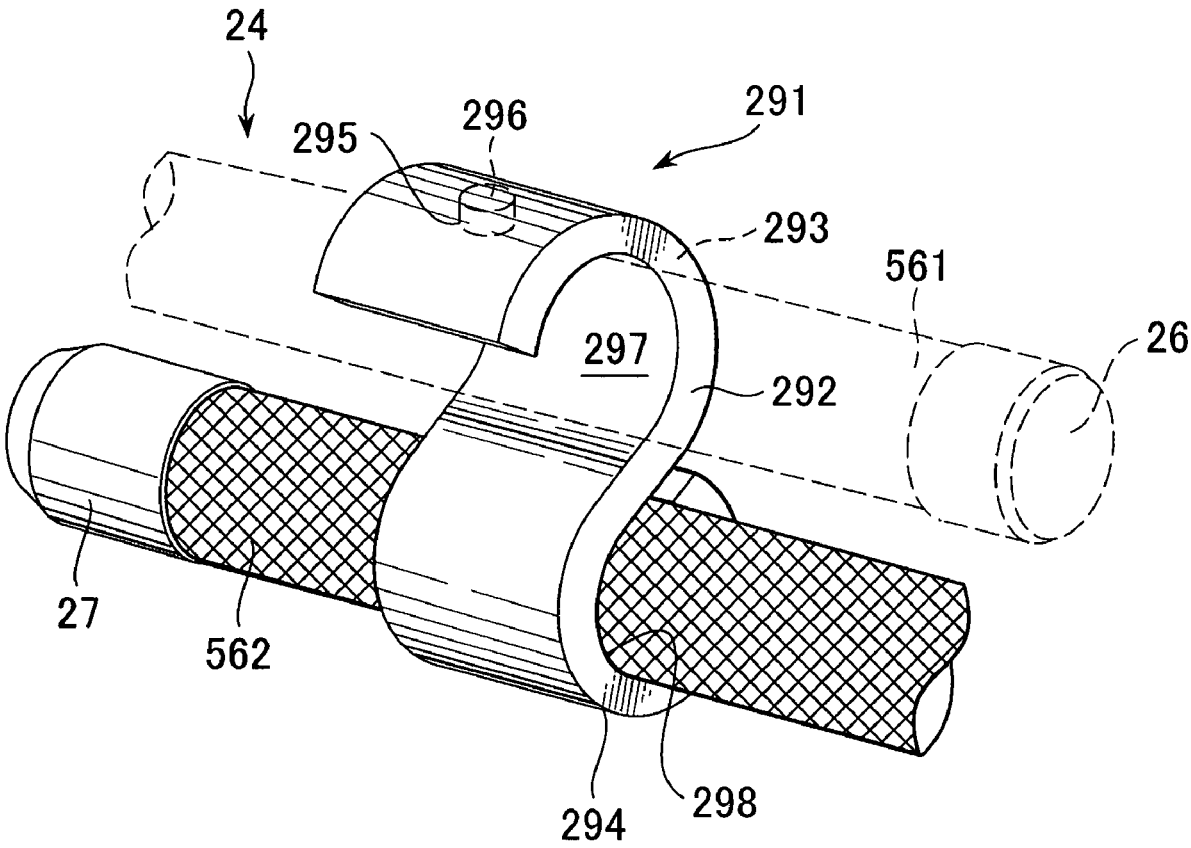
FIG. 55 is a perspective view showing a personal ornament according to a seventeenth embodiment of the invention.
Figure 56:
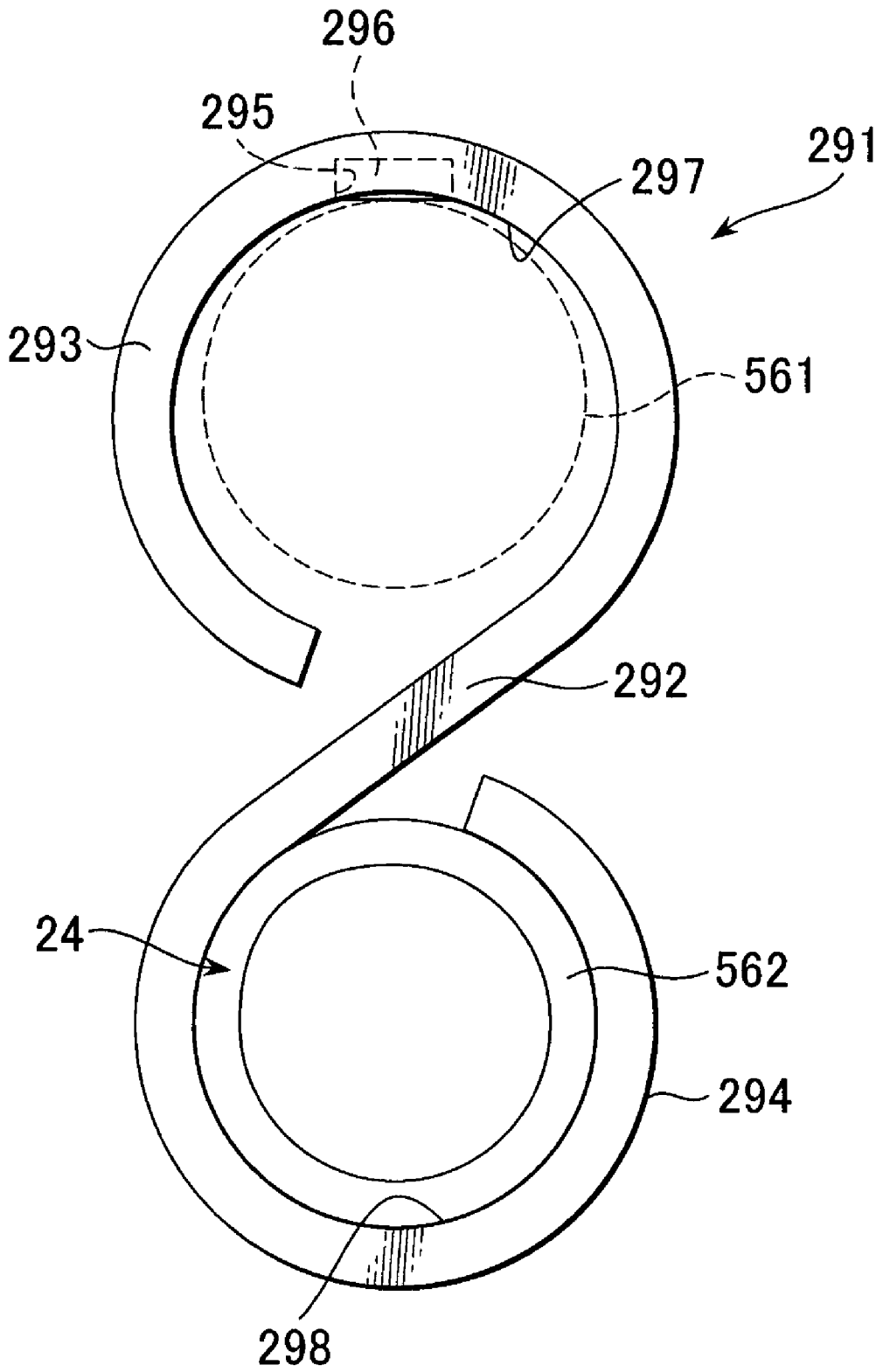
FIG. 56 is a side view showing the personal ornament according to the seventeenth embodiment of the invention.

Seventeenth Embodiment (FIG. 55 and FIG. 56)

FIG. 55 is a perspective view showing a personal ornament according to the sixteenth embodiment of the invention. As shown in FIG. 55, a retainer 291 of the sixteenth embodiment is molded out of a material such as a metal or a resin and so forth, and formed in substantially in an inverted S-shape as viewed from the side surface. The retainer 291 comprises a semi-cylindrical personal ornament detachable cylinder part 293 and a cylindrical fixed cylinder part 294 which is preliminarily fixed to other end side 562 of the personal ornament body 24 wherein the semi-cylindrical personal ornament detachable cylinder part 293 and cylindrical fixed cylinder part 294 are connected with each other via a central part 292.

One space (through part) 297 is formed inside the personal ornament detachable cylinder part 293, and the curvature radius of the one space 297 is larger than the diameters of the one end side and outer cap 26 of the personal ornament body 24. As a result, the one end side 561 of the personal ornament body 24 can be freely inserted into or extracted from the personal ornament detachable cylinder part 293. Further, other space 298 of the fixed cylinder part 294 is smaller than the one space 297 of the personal ornament detachable cylinder part 293, while the diameter of the other space 298 is substantially the same as the outer diameter of the other end side 562 of the personal ornament body 24.

The other end side 562 and outer cap 27 are preliminarily inserted into the fixed cylinder part 294 and fixed thereto. That is, according to the retainer 291 of the present embodiment, the other end side 562 and outer cap 27 are inserted into and fixed to the other space 298 of the fixed cylinder part 294, while the outer cap 26 of the personal ornament body 24 can pass through the one space 297 of the personal ornament detachable cylinder part 293 in a state where it can be inserted into or extracted therefrom.

Meanwhile, a magnet holding hole 295 is formed on the upper half of the retainer 291 and a magnet 296 is fitted to the magnet holding hole 295.

FIG. 56 is a sectional view taken along a plane orthogonal to an axis of the retainer 291 as shown in FIG. 55. As shown in FIG. 56, the magnet 296 is provided on the upper half piece of the retainer 291 and the one end side 561 of the personal ornament body 24 is attracted by the magnetic force of the magnet 295.

With such a configuration, the one end side 561 of the personal ornament body 24 which is inserted into the one through part 297 of the retainer 291 is held in the retainer 291 from the periphery thereof and is also held by the magnet 296. Accordingly, the one end side 561 of the personal ornament body 24 is not transversely come off. Further, the personal ornament body 24 is rendered in an adhesion state by the magnetic attraction force of the internal magnets, and moreover it is prevented from being come off reliably in the peripheral direction with a holding force of the retainer 291. Accordingly, there is no fear of losing the personal ornament body 24 caused by sudden dropping-off and so forth and it is not come off by tearing the personal ornament body 24 from the outside of the wearer, so that theft and so forth can be prevented with assurance. Meanwhile, in the case where the wearer removes the personal ornament body 24 from his or her body, the personal ornament body 24 can be easily removed by merely extracting the one end side 561 of the personal ornament body 24 from the one through part 297 of the retainer 291 in the axial direction.

Figure 57:
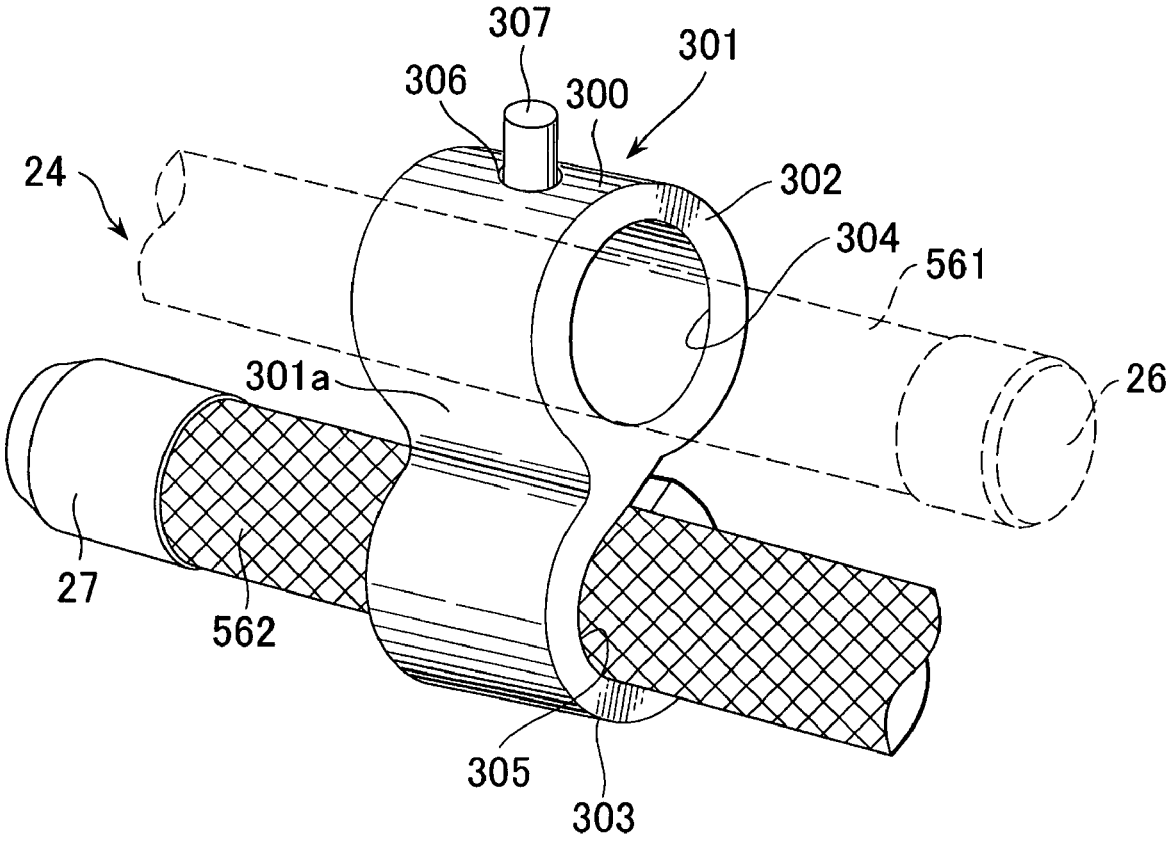
FIG. 57 is a perspective view showing a personal ornament according to an eighteenth embodiment of the invention.
Figure 58:
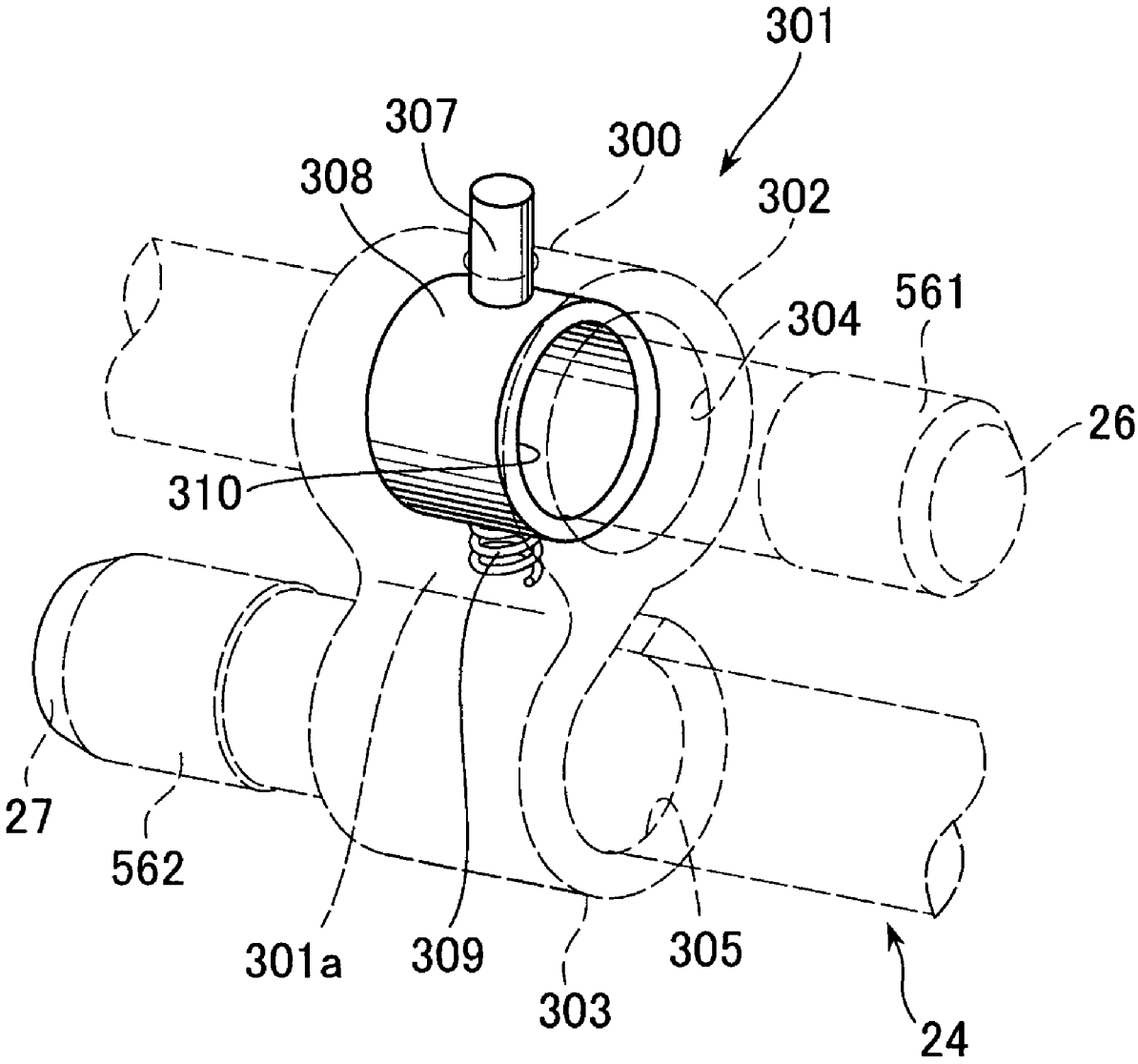
FIG. 58 is an internal perspective view showing the personal ornament according to the eighteenth embodiment of the invention.

Eighteenth Embodiment (FIG. 57 and FIG. 58)

FIG. 57 is a perspective view showing a personal ornament according to the eighteenth embodiment of the invention. As shown in FIG. 57, a retainer 301 of the present embodiment is molded out of a material such as a metal or a resin and so forth, and formed in substantially in the shape of the number "8", as viewed from the side surface. A retainer body 300 of the retainer 301 comprises a semi-cylindrical personal ornament detachable cylinder part 302 and a cylindrical fixed cylinder part 303 which is preliminarily fixed to other end side 562 of the personal ornament body 24 wherein the semi-cylindrical personal ornament detachable cylinder part 302 and cylindrical fixed cylinder part 303 are connected with each other via a central part 301*a*.

One space (through part) 304 is formed inside the personal ornament detachable cylinder part 302, and the curvature radius of the one space 304 is larger than the diameters of the one end side and outer cap 26 of the personal ornament body 24. As a result, the one end side 561 of the personal ornament body 24 can be freely inserted into or extracted from the personal ornament detachable cylinder part 302. Meanwhile, other space 305 of the fixed cylinder part 303 is smaller than the one space 304 of the personal ornament detachable cylinder part 302, while the diameter of the other space 305 is substantially the same as the outer diameter of the other end side 562 of the personal ornament body 24.

The other end side 562 and outer cap 27 are preliminarily inserted into the fixed cylinder part 303 and fixed thereto. That is, according to the retainer 301 of the present embodiment, the other end side 562 and outer cap 27 are inserted into and fixed to the other space 305 of the fixed cylinder part 303, while the outer cap 26 of the personal ornament body 24 can pass through the one space 304 of the personal ornament detachable cylinder part 302 in a state where it can be inserted into or extracted therefrom. Meanwhile, a screw hole 306 is formed on the upper portion of the retainer 301 and a push-on screw 307 is fitted in the screw hole 306.

FIG. 58 is an interior perspective view showing the personal ornament body 24 according to the eighteenth embodiment of the invention. As shown in FIG. 58, an inner ring 308 is provided inside the personal ornament detachable cylinder part 302. The inner ring 308 is urged upward by a compression spring 309 disposed under the inner ring 308 and it is pushed down and moved by the push-on screw 307 disposed above the inner ring 308. That is, the inner ring 308 is urged outward (upward in FIG. 58) by an elastic force of the compression spring 309 while the one end side 561 of the personal ornament body 24 is pressed from the inside to outward by the inner ring 308. Accordingly, the one end side 561 of the personal ornament body 24 is fixed in the retainer 301.

When releasing the fixation of the one end side 561 of the personal ornament body 24 from the retainer 301, an operation for pushing the push-on screw 307 downward to reduce a contact force of the retainer body 300 against the one end side 561, thereby releasing the pressing force against the one end side 561 of the personal ornament body 24. Accordingly, the one end side 561 of the personal ornament body 24 can be inserted into or removed from the retainer 301.

As described above, the personal ornament body 24 retained by the retainer 301 is rendered in an adhesion state by the magnetic attraction force of the internal magnets, and moreover it is prevented from being come off reliably in the peripheral direction with a holding force of the retainer 301. Accordingly, there is no fear of losing the personal ornament body 24 caused by sudden dropping-off and so forth and it is not come off by tearing the personal ornament body 24 from the outside of the wearer, so that theft and so forth can be prevented with assurance. Meanwhile, in the case where the wearer removes the personal ornament body 24 from his or her body, the personal ornament body 24 can be easily removed by merely extracting the one end side 561 of the personal ornament body 24 from the inner surface of the retainer body 300 while loosening the push-on screw 307.

Figure 59:
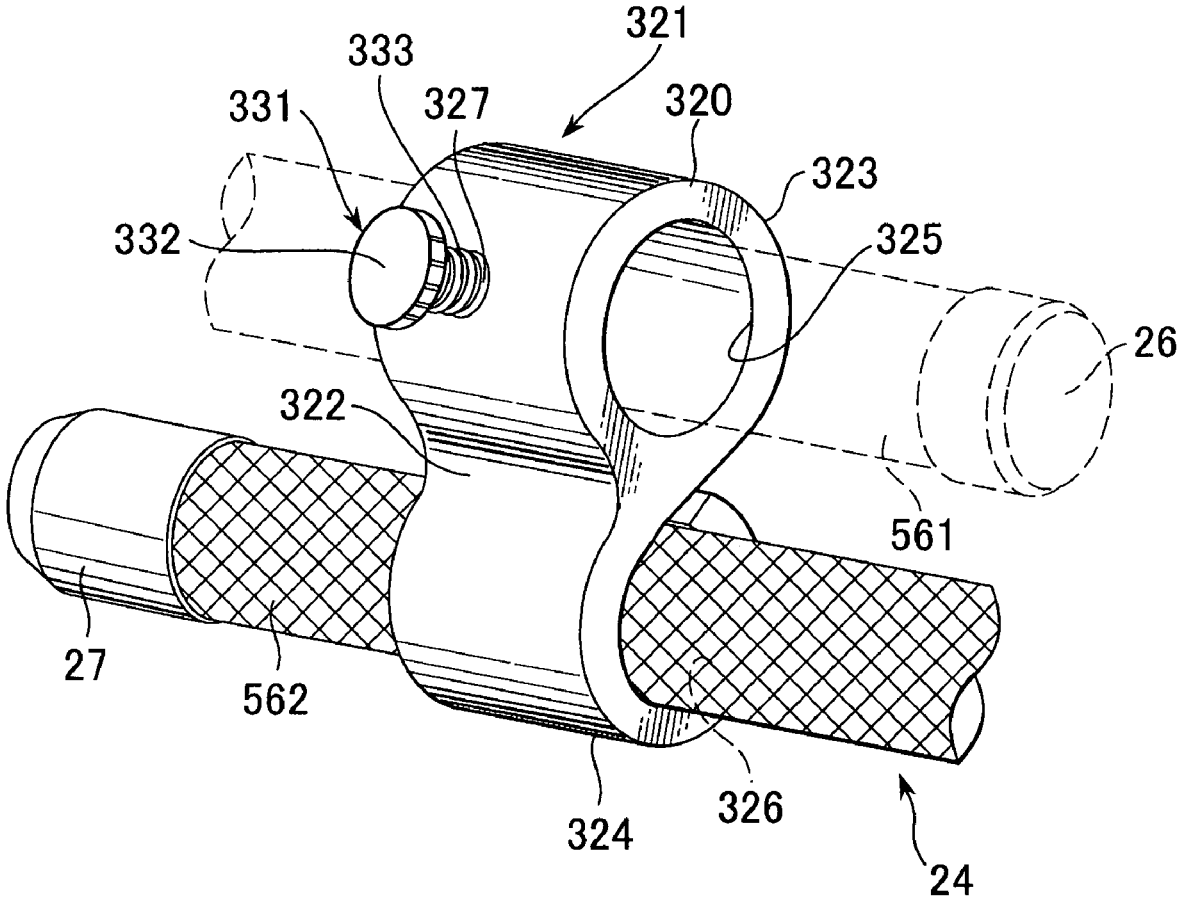
FIG. 59 is a perspective view showing a personal ornament according to a nineteenth embodiment of the invention.
Figure 60:
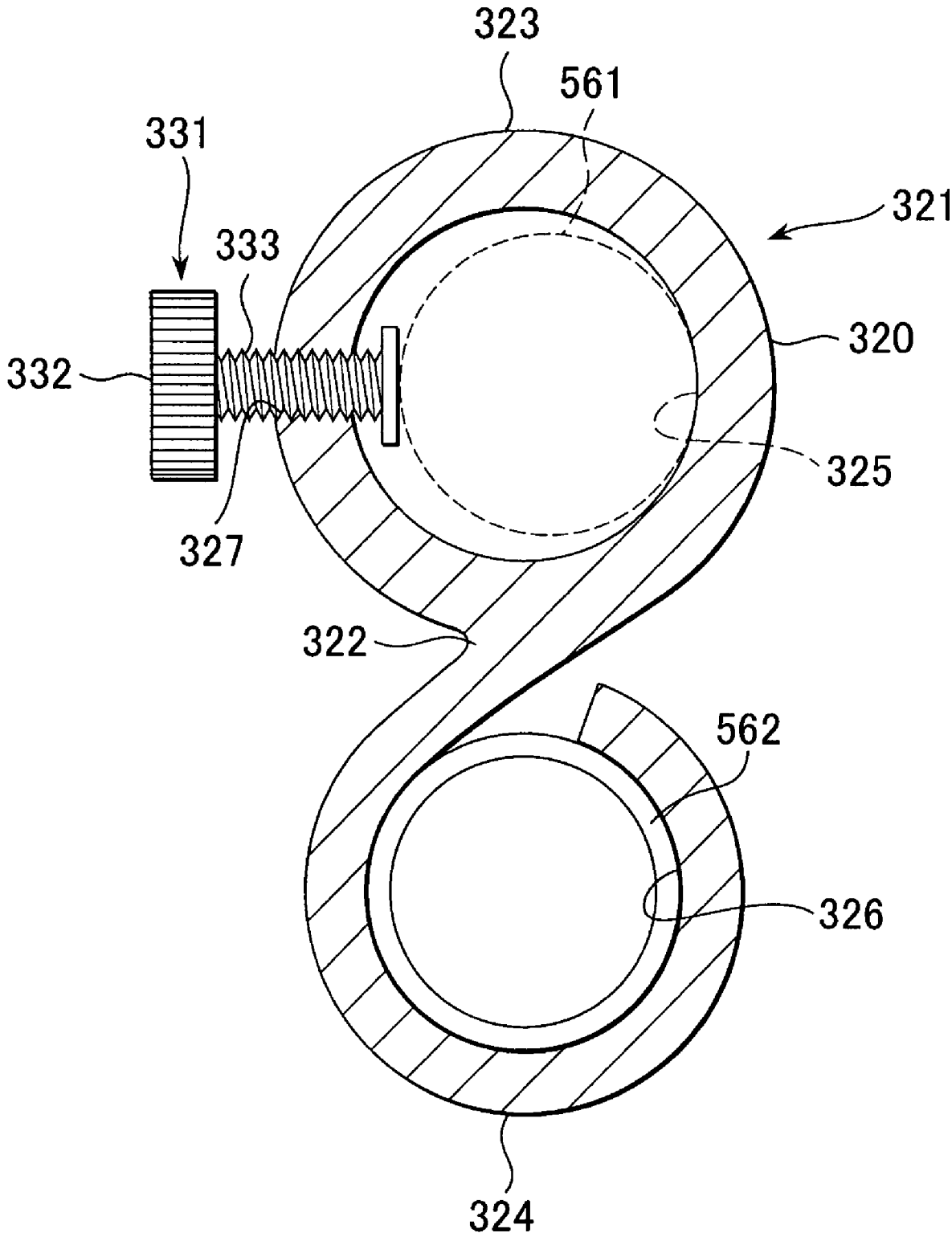
FIG. 60 is a longitudinal sectional view showing the personal ornament according to the nineteenth embodiment of the invention.

Nineteenth Embodiment (FIG. 59 and FIG. 60)

FIG. 59 is a perspective view showing a personal ornament according to the nineteenth embodiment of the invention. As shown in FIG. 59, a retainer 321 of the present embodiment is molded out of a material such as a metal or a resin and so forth, and formed in substantially in the shape of the number "8", as viewed from the side surface. A retainer body 320 of the retainer 321 comprises a semi-cylindrical personal ornament detachable cylinder part 323 and a cylindrical fixed cylinder part 324 which is preliminarily fixed to other end side 562 of the personal ornament body 24 wherein the semi-cylindrical personal ornament detachable cylinder part 323 and cylindrical fixed cylinder part 324 are connected with each other via a central part 322.

One space (through part) 325 is formed inside the personal ornament detachable cylinder part 323, and the curvature radius of the one space 325 is larger than the diameters of the one end side and outer cap 26 of the personal ornament body 24. As a result, the one end side 561 of the personal ornament body 24 can be freely inserted into or extracted from the personal ornament detachable cylinder part 323. Further, other space 326 of the fixed cylinder part 324 is smaller than the one space 325 of the personal ornament detachable cylinder part 323, while the diameter of the other space 326 is substantially the same as the outer diameter of the other end side 562 of the personal ornament body 24.

Further, a screw hole 327 is provided in the personal ornament detachable cylinder part 323 and a fastening screw 331 is screwed into the screw hole 327 from the side. That is, the fastening screw 331 has a large diameter head part 332 and a screw part 333 protruding from the center of the head part wherein when the head part 332 is manually operated, the fastening screw 331 can be inserted into or extracted from the screw hole 327.

FIG. 60 is a sectional view taken along a plane orthogonal to an axis of the retainer 321. As shown in FIG. 60, the diameter of the personal ornament detachable cylinder part 323 is substantially equal to that of the fixed cylinder part 324. The screw part 333 of the fastening screw 331 protrudes into the inner peripheral surface side of the personal ornament detachable cylinder part 323 of the retainer 321. A pressing plate having a wide width is provided on the tip end of the screw part 333 of the fastening screw 331. The pressing plate pushes the personal ornament body 24 to cause the personal ornament body 24 to press against the inner surface of the personal ornament detachable cylinder part 323.

With such a configuration, the one end side 561 of the personal ornament body 24 can be easily fitted to and removed from the retainer 321 by merely implementing turning operation of the fastening screw 331 while detachably inserting the personal ornament body 24 into the retainer 321. The personal ornament body 24 retained by the retainer 321 is rendered in an adhesion state with the magnetic attraction force of the internal magnets, and is prevented from being come off reliably in a peripheral direction with a holding force of the retainer 321 having the shape of the eyeglasses. Accordingly, there is no fear of losing the personal ornament body 24 caused by sudden dropping-off and so forth and it is not come off by tearing the personal ornament body 24 from the outside of the wearer, so that theft and so forth can be prevented with more assurance.

Figure 61:
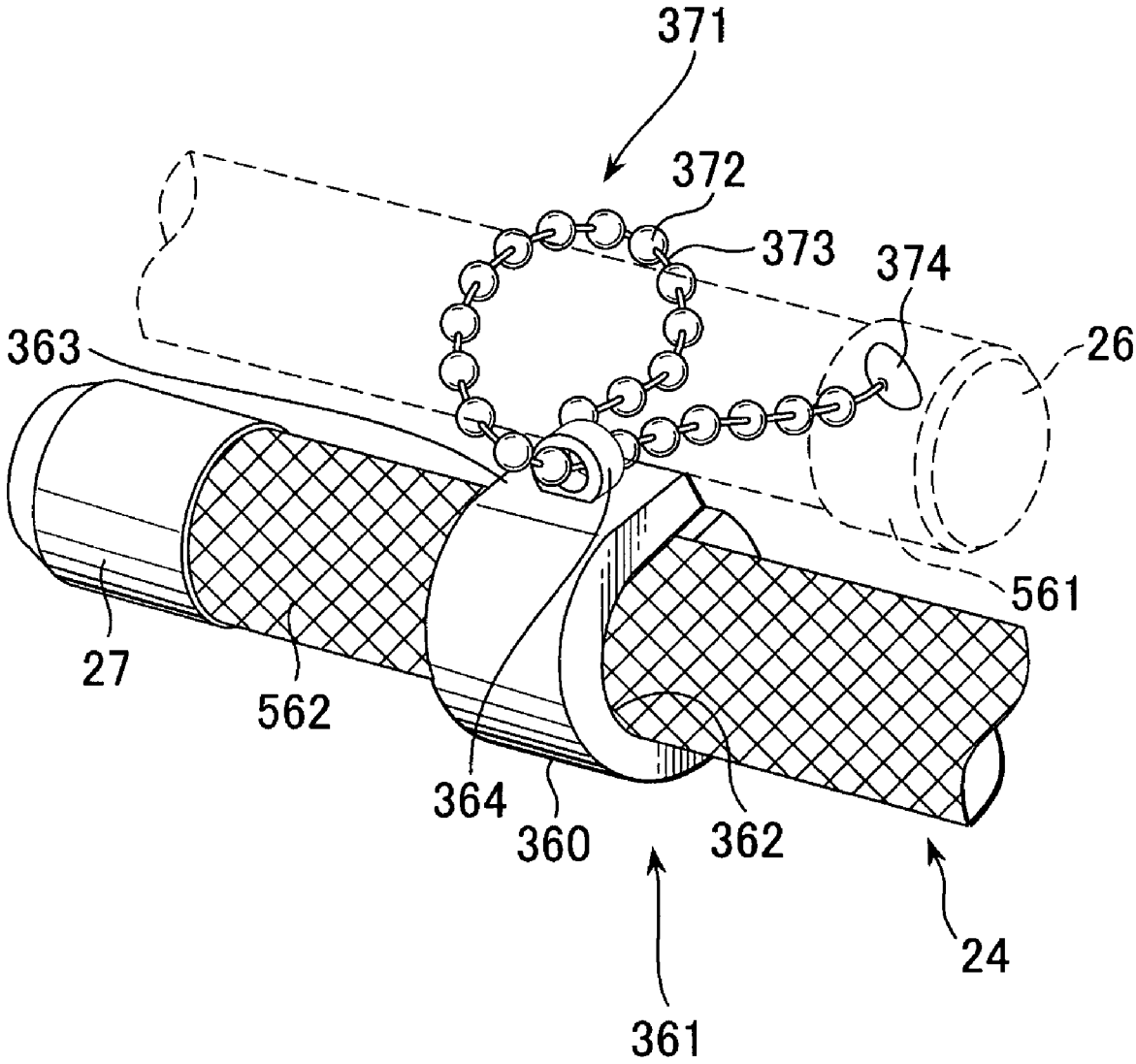
FIG. 61 is a perspective view showing a personal ornament according to a twentieth embodiment of the invention.

Twentieth Embodiment (FIG. 61)

FIG. 61 is a perspective view of a personal ornament according to the twentieth embodiment of the invention. According to a personal ornament 361 of the present embodiment, a bead-shaped string body 371 is used instead of the personal ornament detachable cylinder part 323, described in the nineteenth embodiment of the invention.

First, a retainer body 360 is formed of a flat shaped member made of a material such as a metal-or a resin and so forth, and is wound around the end part of the personal ornament body 24 in a ring shape. A retainer ring 364 is fitted to the retainer body 360 and a beads-shaped string body 371 is fitted to the retainer ring 364.

The string body 371 has balls 372 at one end side of a flexible string 373 at regular intervals at one end side thereof. The balls 372 are made of, e.g., an elastic material and they have outer diameters substantially the same as the inner diameter of the retainer ring 364, and they are configured such that when they are pulled with not less than a predetermined force, they can pass through the outer side retainer ring 364 while when they are pulled with not more than a predetermined force, they are not come off the retainer ring 364. An end plate 374 having a diameter which is larger than the inner diameter of the retainer ring 364 is provided on one end of the string body 371, while the other end of the string body 371 is fixed to the retainer ring 364.

With such a configuration, in the case where the retainer 361 is fitted to the personal ornament body 24, the string body 371 is curved so as to be opened larger than the outer diameter of the personal ornament body 24, and the one end side 561 of the personal ornament body 24 is caused to pass through the opening defined between the string body 371 and retainer ring 364 and it is pressed by the 371 from the outer peripheral surface thereof by the string body 371.

When the one end side 561 of the personal ornament body 24 is removed, the string body 371 is curved so as to be opened larger than the outer diameter of the personal ornament personal ornament body 24, then the one end side 561 of the personal ornament body 24 is pulled out.

With such a configuration, the one end side 561 of the personal ornament body 24 can be easily fitted to and removed from the retainer body 360 by merely operating the string body 371. Further, the personal ornament body 24 retained by the retainer 361 is rendered in an adhesion state with the magnetic attraction force of the internal magnets, and is prevented from being come off reliably in a peripheral direction with a holding force of the retainer 361. Accordingly, there is no fear of losing the personal ornament body 24 caused by sudden dropping-off and so forth and it is not come off by tearing the personal ornament body 24 from the outside of the wearer, so that theft and so forth can be prevented with more assurance.

Figure 62A:
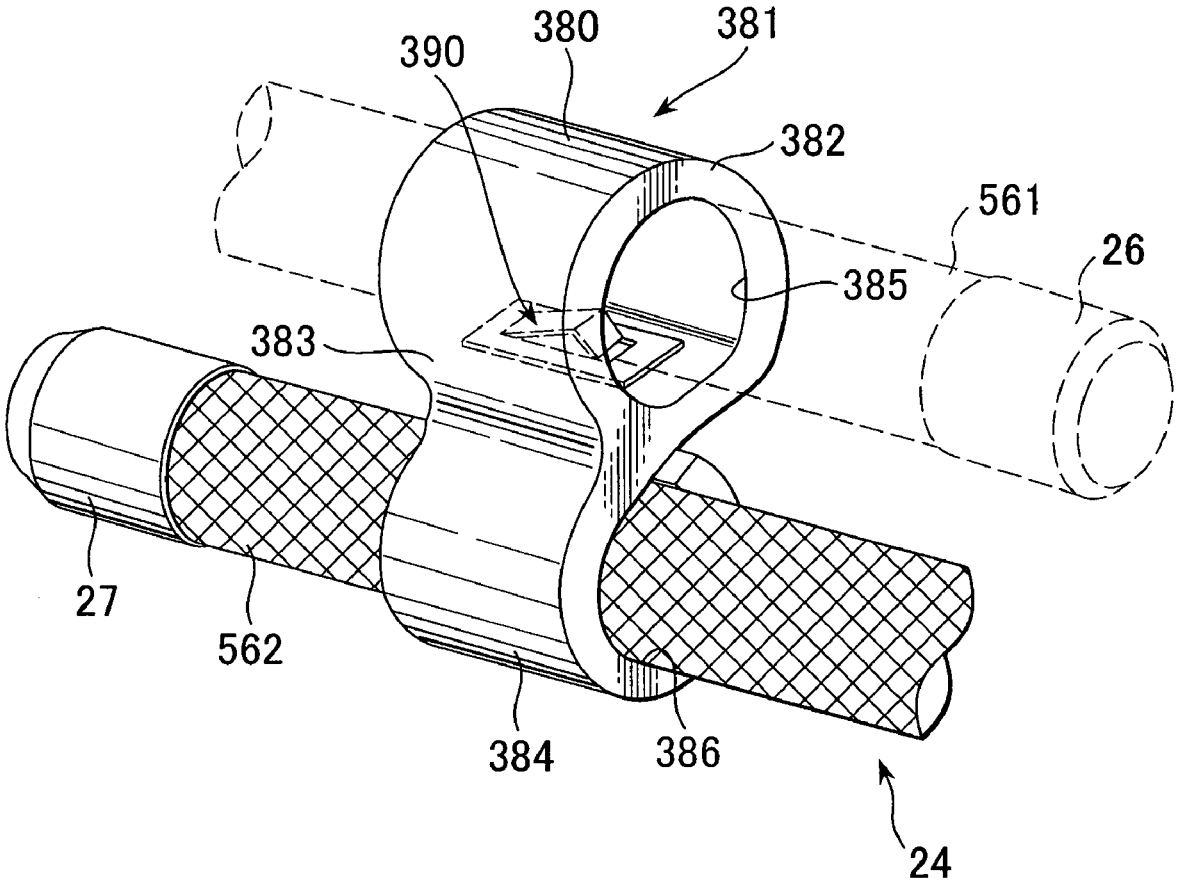
FIG. 62(A) is a perspective view showing a personal ornament according to a twenty-first embodiment of the invention and FIG. 62(B) is a view for explaining a component thereof.
Figure 62B:
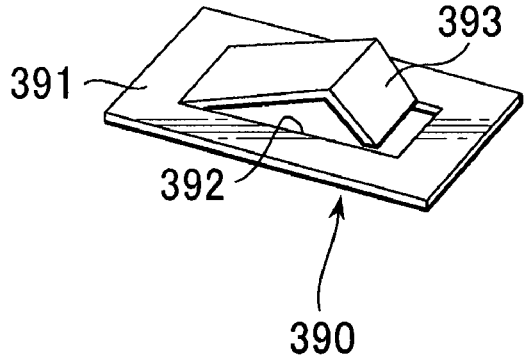
Figure 63:
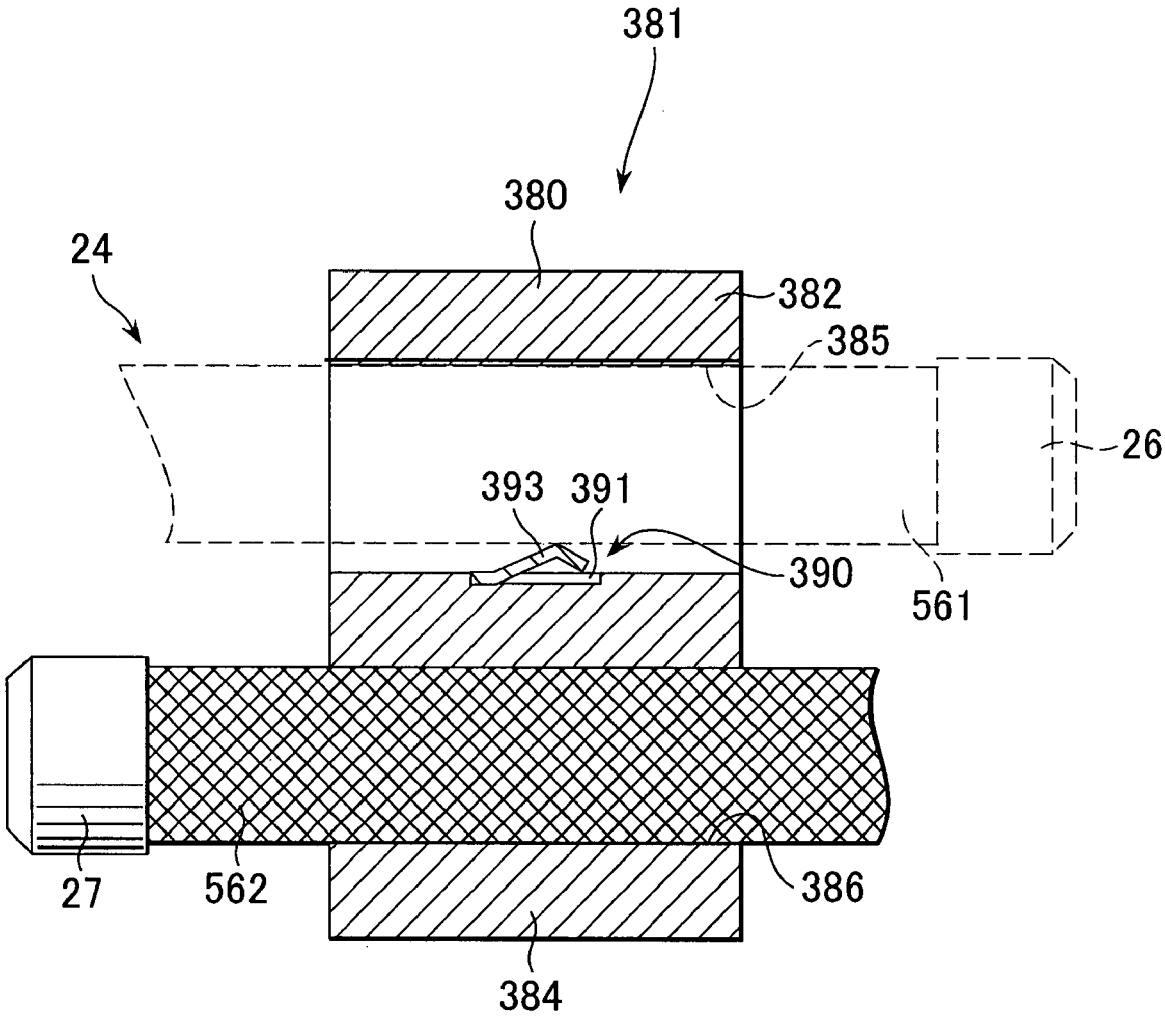
FIG. 63 is a longitudinal sectional view showing the personal ornament according to the twenty-first embodiment of the invention.

Twenty-First Embodiment (FIG. 62 and FIG. 63)

FIG. 62(A) is a perspective view showing a personal ornament according to the twenty-first embodiment of the invention, and FIG. 62(B) is a view for explaining a component of the personal ornament body 24. As shown in FIG. 62(A), a retainer 381 of the present embodiment is molded out of a material such as a metal or a resin and so forth, and formed in substantially in the shape of the number "8", as viewed from the side surface. A retainer body 380 of the retainer 381 comprises a semi-cylindrical personal ornament detachable cylinder part 382 and a cylindrical fixed cylinder part 384 which is preliminarily fixed to other end side 562 of the personal ornament body 24 wherein the semi-cylindrical personal ornament detachable cylinder part 382 and cylindrical fixed cylinder part 384 are connected with each other via a central part 383.

One space (through part) 385 is formed inside the personal ornament detachable cylinder part 382, and the curvature radius of the one space 385 is larger than the diameters of the one end side and outer cap 26 of the personal ornament body 24. As a result, the one end side one end side 561 of the personal ornament body 24 can be freely inserted into or extracted from the personal ornament detachable cylinder part 382. Meanwhile, other space 386 of the fixed cylinder part 384 is smaller than the one space 385 of the personal ornament detachable cylinder part 382, while the diameter of the other space 386 is substantially the same as the outer diameter of the other end side 562 of the personal ornament body 24.

Further, the other end side 562 and outer cap 27 of the personal ornament body 24 are preliminarily inserted into and fixed to the fixed cylinder part 384. Meanwhile, a spring member 380 is provided in the personal ornament detachable cylinder part 382.

FIG. 62(B) shows the configuration of a spring member 390 which is enlarged. As shown in FIG. 62(B), the spring member 390 is formed of a spring plate 393 by cutting process and so forth, and the spring plate 393 can be bent in a notched hole 392 in the direction of the thickness thereof.

FIG. 63 is a sectional view taken along a plane orthogonal to an axis of the retainer 381 shown in FIG. 62. As shown in FIG. 63, the spring member 390 is housed in the inner peripheral surface of the personal ornament detachable cylinder part 382. In the case where the one end side 561 of the personal ornament body 24 is inserted into the personal ornament detachable cylinder part 382 by the spring member 391 having such a configuration, it can be pressed into and held by the personal ornament detachable cylinder part 382 by an arbitrary length with resilient forces of the spring plate 393. Further, in the case where the other end side 562 of the personal ornament body 24 is inserted into the personal ornament detachable cylinder part 382 by the spring member 391, it can be held in the personal ornament detachable cylinder part 382 by an arbitrary length with resilient forces of the spring plate 393.

With such a configuration, the one end side 561 of the personal ornament body 24 can be easily fitted to and removed from the retainer 381 by merely detachably inserting the personal ornament body 24 into the retainer 381 without resorting to any specific operation. Further, the personal ornament body 24 retained by the retainer 381 is rendered in an adhesion state with the magnetic attraction force of the internal magnets, and is prevented from being come off reliably in a peripheral direction with a holding force of the retainer 381. Accordingly, there is no fear of losing the personal ornament body 24 caused by sudden dropping-off and so forth and it is not come off by tearing the personal ornament body 24 from the outside of the wearer, so that theft and so forth can be prevented with more assurance.

Figure 64:
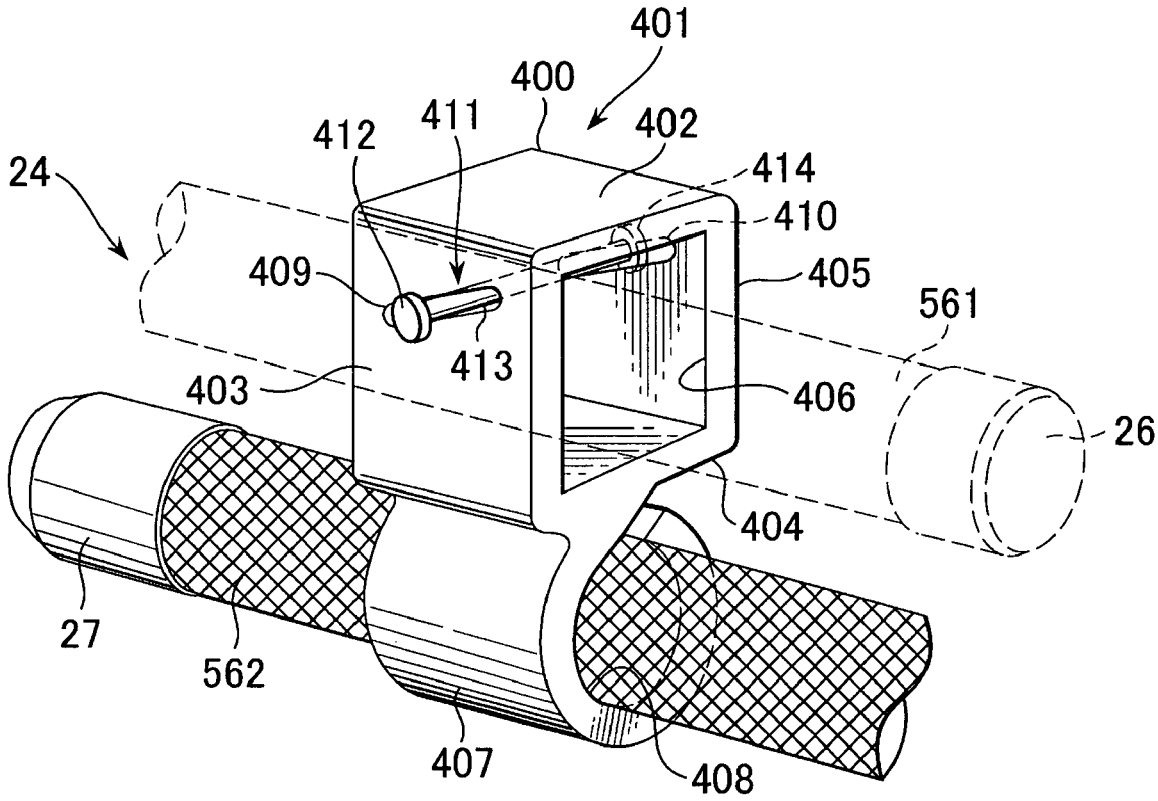
FIG. 64 is a perspective view showing a personal ornament according to a twenty-second embodiment of the invention.
Figure 65:
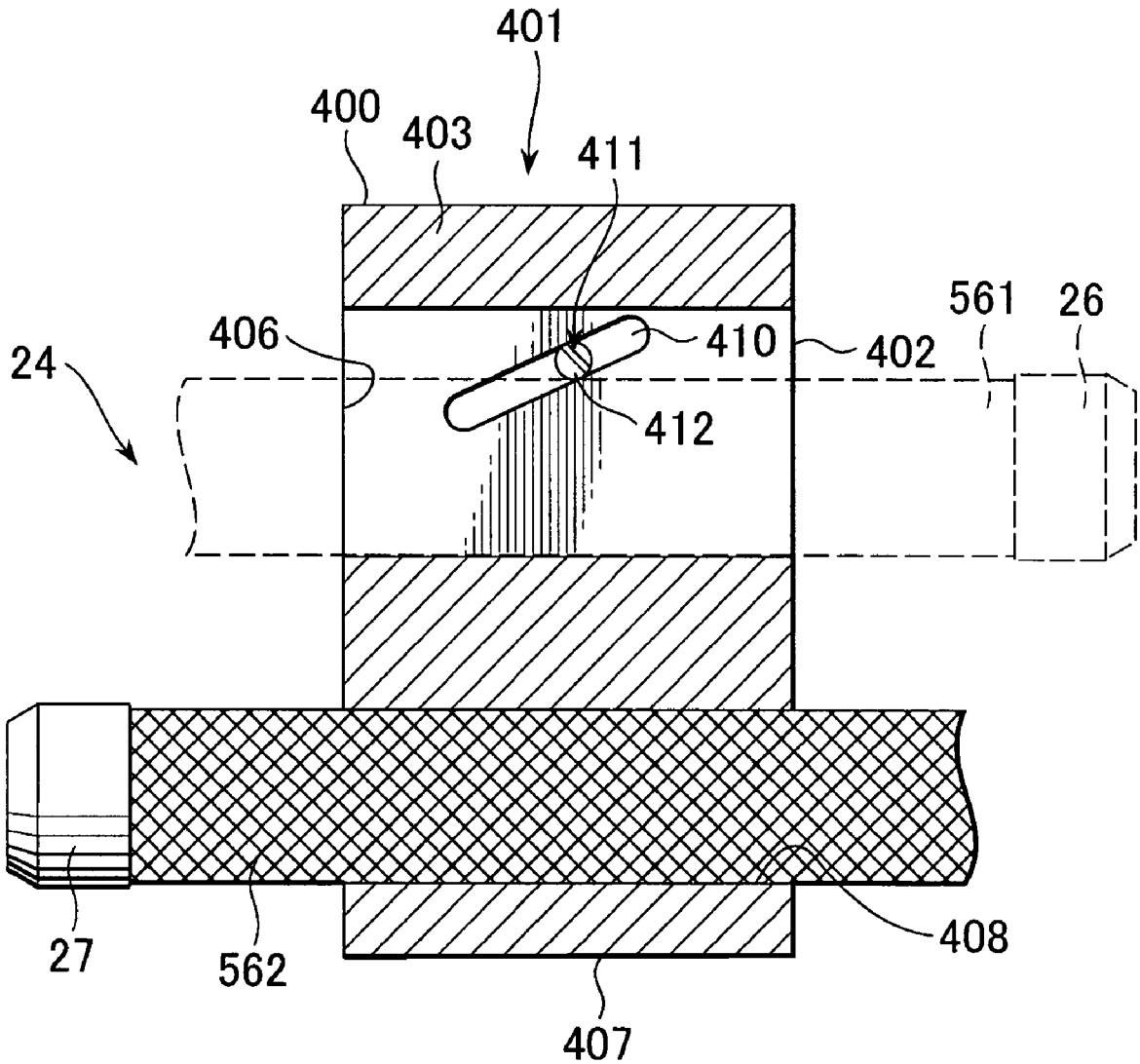
FIG. 65 is a longitudinal sectional view showing the personal ornament according to the twenty-second embodiment of the invention.

Twenty-Second Embodiment (FIG. 64 and FIG. 65)

FIG. 64 is a perspective view showing a personal ornament according to the twenty-second Embodiment of the invention. As shown in FIG. 64, a retainer 401 of the present embodiment is molded out of a material such as a metal or a resin and so forth, and comprises a square personal ornament detachable cylinder part 400 and a cylindrical fixed cylinder part 407 which is preliminarily fixed to other end side 562 of the personal ornament body 24.

One space (through part) 406 is formed in the personal ornament detachable cylinder part 400 and it is larger than the diameters of the one end side 561 and outer cap 26 of the personal ornament body 24. As a result, the one end side 561 of the personal ornament body 24 can be freely inserted into or extracted from the personal ornament detachable cylinder part 400. Meanwhile, other space 408 of the cylindrical fixed cylinder part 407 is smaller than the one space 406 of the personal ornament detachable cylinder part 400 and the diameter of the other space 408 is substantially the same as the outer diameter of the other end side 562 of the personal ornament body 24.

The other end side 562 and outer cap 27 are preliminarily inserted into and fixed to the cylindrical fixed cylinder part 407. That is, according to the retainer 401 of the present embodiment, the other end side 562 and outer cap 27 of the personal ornament body 24 are inserted into and fixed to the other space 408 of the cylindrical fixed cylinder part 407 while the outer cap 26 of the personal ornament body 24 can pass through the one space 406 of the personal ornament detachable cylinder part 400 in a state where it can be inserted into or extracted from the one space 406.

Meanwhile, the personal ornament detachable cylinder part 400 has an upper piece 402, side piece (left side piece) 403, a lower piece 404 and a side piece (right side piece) 405 as shown in FIG. 64. The personal ornament detachable cylinder part 400 forms a space (through part) 406 inside thereof, and one end side 561 of the personal ornament body 24 can be detachably and transversely inserted into the space (through part) 406.

Inclined holes 409, 410 which are inclined at a predetermined angle, respectively, are bored in the opposite side piece (left side piece) 403 and side piece (right side piece) 405 of the personal ornament detachable cylinder part 400. A retainer pin 411 is inserted into the inclined holes 409, 410. The retainer pin 411 has a shaft part 413 having a length to be inserted into the inclined holes 409, 410, and both tip ends of the shaft part 413 protrudes outward the side piece (left side piece) 403 and side piece (right side piece) 405. Large diameter head parts 412, 414 are integrally provided on both tip ends of the shaft part 413. The inclined holes 409, 410 are long holes having a symmetrical shape, and have the same height, length and inclined angles.

FIG. 65 is a sectional view taken along a plane orthogonal to an axis of the retainer 401 shown in FIG. 64. As shown in FIG. 65, the height of the lower end portions of the inclined holes 409, 410 is set at a position lower than the top portion of the one end side 561 of the personal ornament body 24. The height of the higher end portions of the inclined holes 409, 410 is set at a position higher than the top portion of the one end side 561 of the personal ornament body 24.

Accordingly, when using the personal ornament body 24 shown in FIG. 65, the large diameter head part 412 is pushed up and smoothly inserted into the inclined holes 409, 410 by inserting the one end side 561 of the personal ornament body 24 into the inclined holes 409, 410 from the lower portion toward the higher portion (leftward in FIG. 65). Meanwhile, when the one end side 561 of the personal ornament body 24 is pulled out from the higher portion of the inclined holes 409, 410 toward the lower portion thereof (rightward in FIG. 65), the large diameter head part 412 is interlocked with the pulling out of the one end side 561 toward the lower portion with a friction force therebetween so that the large diameter head part 412 presses down the one end side 561 of the personal ornament body 24, thereby preventing the personal ornament body 24 from being come off.

According to the present embodiment of the invention, the one end side 561 of the personal ornament body 24 can be easily fitted to and removed from the retainer 401 by merely detachably inserting the personal ornament body 24 into the retainer 401. Further, the personal ornament body 24 retained by the retainer 401 is rendered in an adhesion state with the magnetic attraction force of the internal magnets, and is prevented from being come off reliably in a peripheral direction with a holding force of the retainer 401. Accordingly, there is no fear of losing the personal ornament body 24 caused by sudden dropping-off and so forth and it is not come off by tearing the personal ornament body 24 from the outside of the wearer, so that theft and so forth can be prevented with more assurance.

Figure 66:
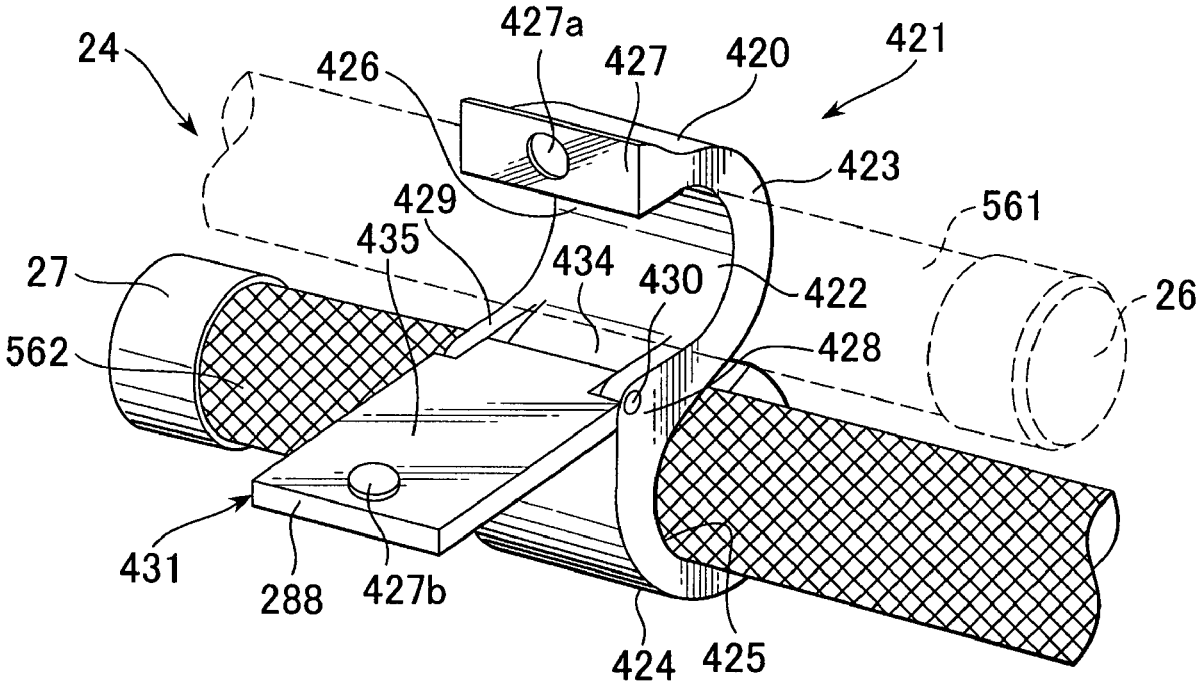
FIG. 66 is a perspective view showing a personal ornament according to a twenty-third embodiment of the invention.
Figure 67:
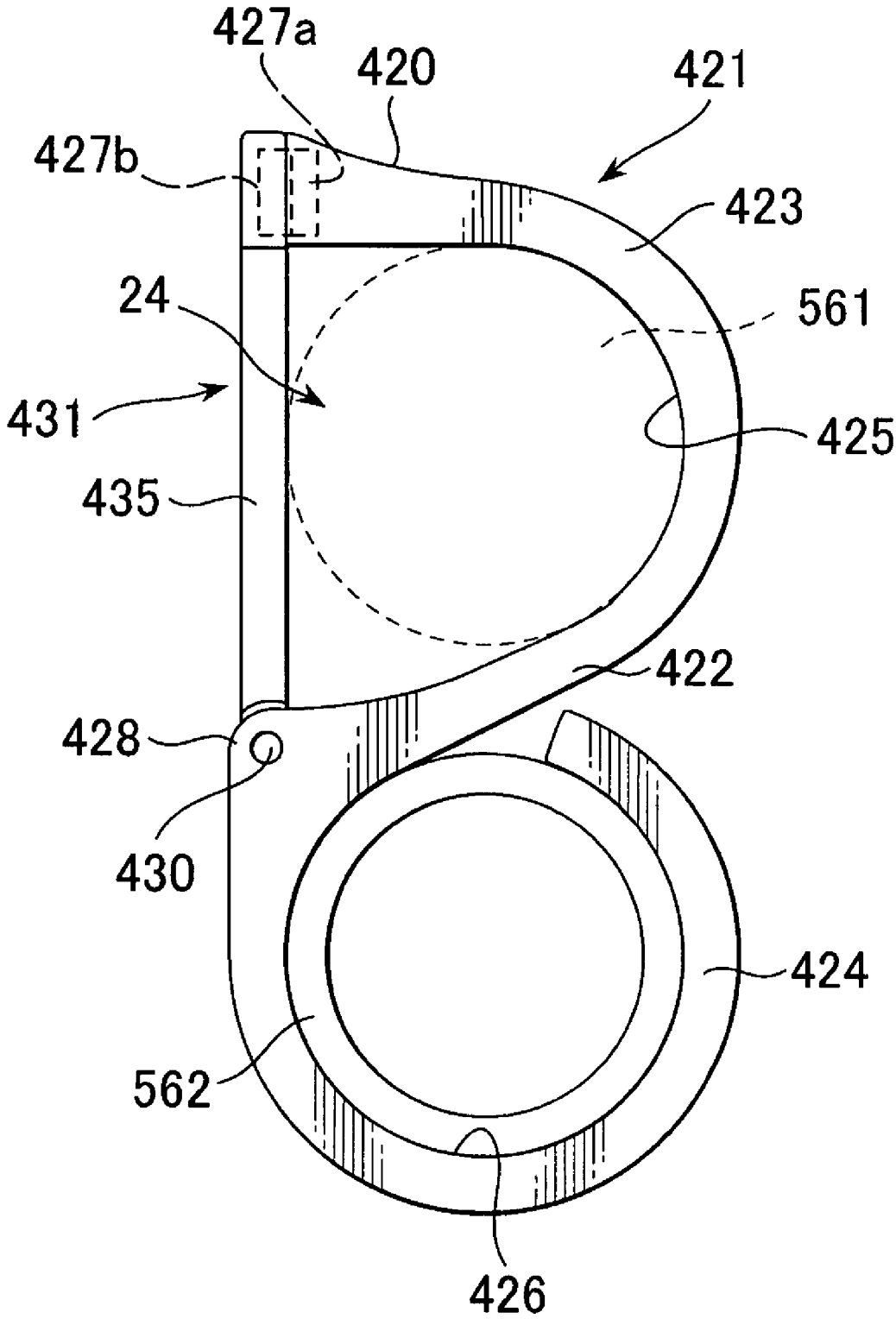
FIG. 67 is a side view showing the personal ornament according to the twenty-third embodiment of the invention.

Twenty-Third Embodiment (FIG. 66 and FIG. 67)

FIG. 66 is a perspective view showing a personal ornament according to the twenty-third embodiment of the invention. As shown in FIG. 66, a retainer 421 of the present embodiment is molded out of a material such as a metal or a resin and so forth. A retainer body 420 of the retainer 421 comprises a semi-cylindrical personal ornament detachable cylinder part 423 which is formed substantially in a bow shape as viewed from the side surface and a cylindrical fixed cylinder part 424 wherein the semi-cylindrical personal ornament detachable cylinder part 423 and cylindrical fixed cylinder part 424 are connected with each other via a barrel part 422.

One space (through part) 426 is formed at the concave surface side of the personal ornament detachable cylinder part 423, and the curvature radius of the one space 426 is larger than the diameters of the one end side and outer cap 26 of the personal ornament body 24. As a result, the one end side 561 of the personal ornament body 24 can be freely inserted into or extracted from the personal ornament detachable cylinder part 423. Further, a space 425 of the fixed cylinder part 424 is smaller than the space 426 of the personal ornament detachable cylinder part 423, while the diameter of the space 425 is substantially the same as the outer diameter of the other end side 562 of the personal ornament body 24.

The other end side 562 and outer cap 27 are preliminarily inserted into the fixed cylinder part 424 and fixed thereto. That is, according to the retainer 421 of the present embodiment, the other end side 562 and outer cap 27 are inserted into and fixed to the space 425 of the fixed cylinder 424, while the outer cap 26 of the personal ornament body 24 can pass through the space 426 of the personal ornament detachable cylinder part 423 in a state where it can be inserted into or extracted from the space 426.

Meanwhile, the upper half of the personal ornament detachable cylinder part 423 has a shape of an alligator clip, and it is configured that a closing plate 431 serving as a clipping piece is openably and closably connected to the personal ornament detachable cylinder part 423 by a hinge shaft 434. The personal ornament detachable cylinder part 423 is configured as a curved piece having a predetermined width and it has a semi-circular arc plate-shape so as to press the substantially half part of the outer peripheral surface of the -one end side of the personal ornament body 24 from the outside. Meanwhile, the closing plate 431 is structured by a flat plate shaped closing body 435 so as to press the substantially half part of the outer peripheral surface of the other end side of the personal ornament body 24 from the outside.

Opposite hinge ears 428, 429 stand upright on the outer end part of the personal ornament detachable cylinder part 423 and they are supported by the hinge shaft 428. Meanwhile, a hinge end 434 of the closing plate 431 is supported by the hinge shaft 430, and a magnet 427*b* is provided on the turning end part of the closing plate 431 at the side opposite to the hinge end 434. Further, a magnet 427*a* is provided on the tip end 427 of the turning end part of the personal ornament detachable cylinder part 423.

FIG. 67 is a view showing a state of use of the retainer 421 in the case where the personal ornament body 24 is retained by the retainer 421. As shown in FIG. 67, the personal ornament body 24 is caused to pass through the retainer 421 and the closing plate body 435 is turned about the hinge shaft 430 as a fulcrum so as to cause the magnets 427*a* and 427*b* to be attracted.

With such a configuration, the one end side and other end side of the personal ornament body 24 are detachably fitted to the retainer. Further, the personal ornament body 24 retained by the retainer 421 is rendered in an adhesion state by the magnetic attraction force of the internal magnets, and moreover it is prevented from being come off reliably in the peripheral direction with a holding force of the retainer 421. Accordingly, there is no fear of losing the personal ornament body 24 caused by sudden dropping-off and so forth and it is not come off by tearing the personal ornament body 24 from the outside of the wearer, so that theft and so forth can be prevented with assurance.

Further, according to the present embodiment, the personal ornament is configured to comprise the personal ornament body formed by inserting a plurality of columnar metallic magnets into a string-shaped tube made of a flexible material and capable of being twisted and bent, wherein N poles and S poles of the respective magnets are alternately arranged on opposite peripheral surface of the columnar magnets, and a retainer fixed to other end side of the personal ornament body and capable of fixing one end of the personal ornament body to the other end side of the personal ornament body in a state where one end side and other end side of the personal ornament body are aligned in parallel with each other.

Accordingly, the one end side 561 of the personal ornament body 24 is preliminarily inserted into and fitted to the fixed cylinder 424, and when the personal ornament body 24 is used, the one end side 561 of the personal ornament body 24 which is worn around the neck and so forth is inserted into the personal ornament detachable cylinder part 423, so that the personal ornament body 24 can be adjusted as a necklace having a predetermined diameter and worn around the neck.

Figure 68:
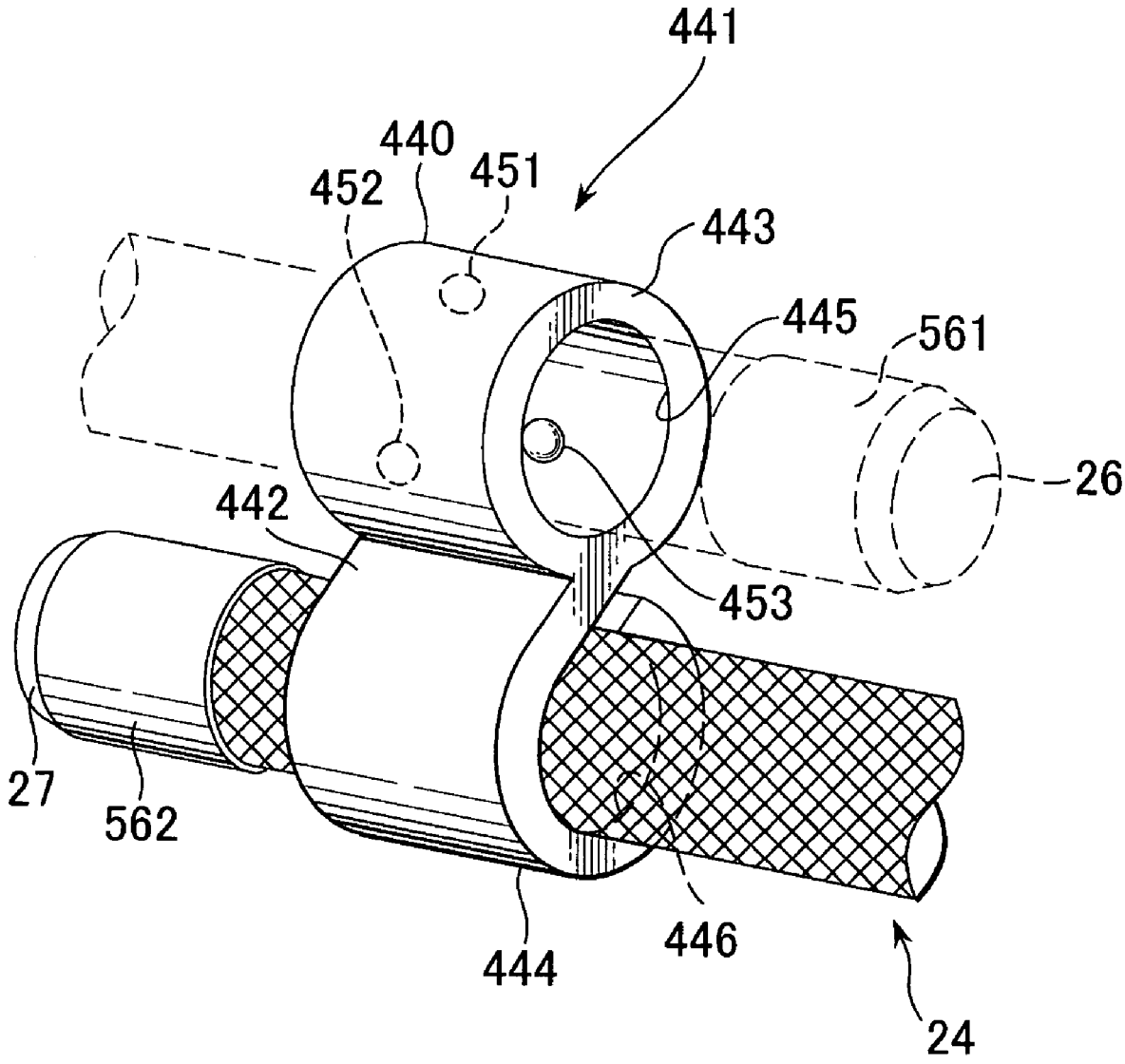
FIG. 68 is a perspective view showing a personal ornament according to a twenty-fourth embodiment of the invention.
Figure 69:
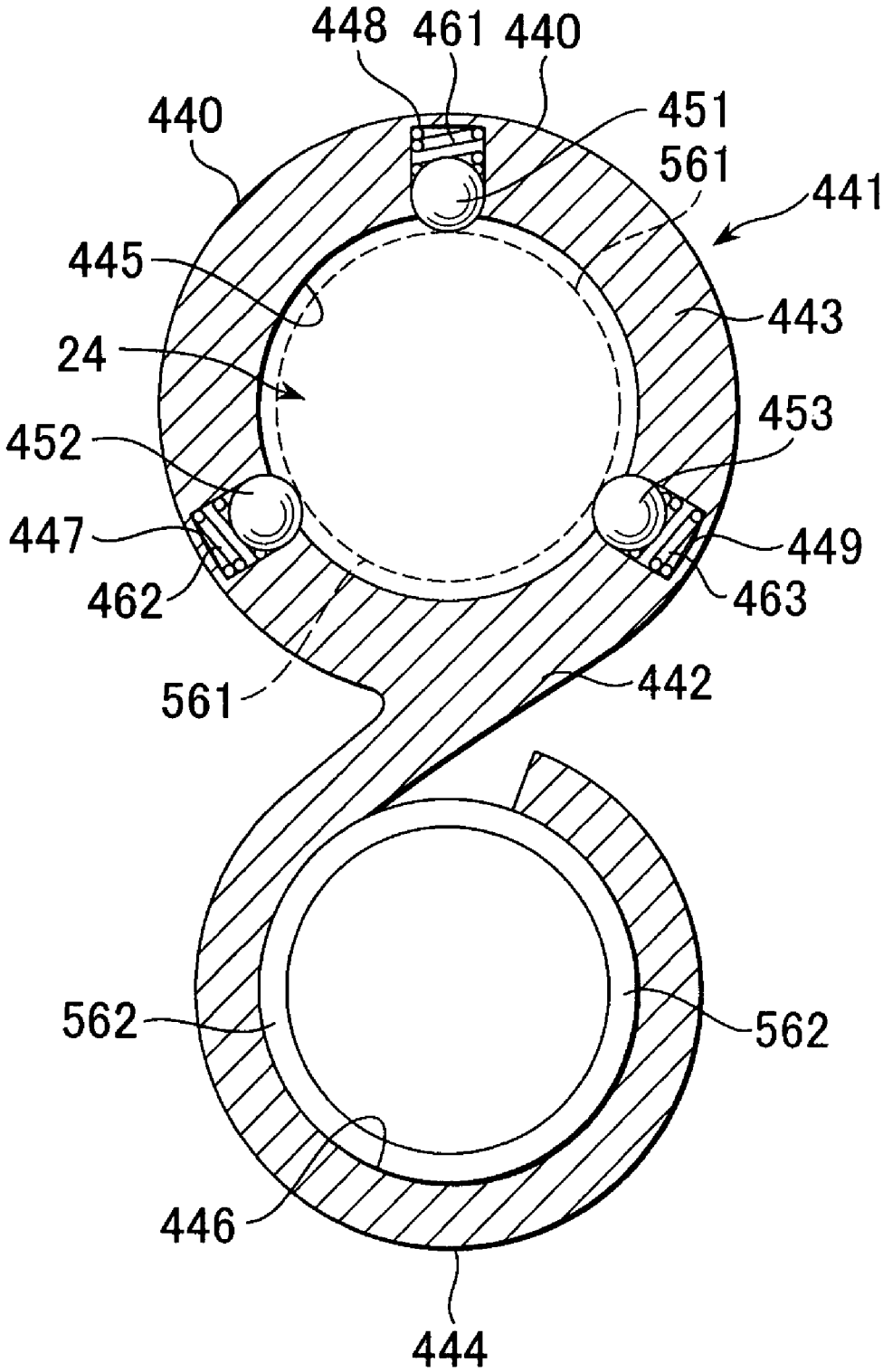
FIG. 69 is a longitudinal sectional view showing the personal ornament according to the twenty-fourth embodiment of the invention.

Twenty-Fourth Embodiment (FIG. 68 and FIG. 69)

FIG. 68 is a perspective view showing a personal ornament according to the twenty-fourth embodiment of the invention. As shown in FIG. 68, a retainer 441 of the nineteenth embodiment is molded out of a material such as a metal or a resin and so forth, and has a retainer body 440 formed in substantially in eyeglasses (in the shape of the number "8")), as viewed from the side surface. The retainer body 440 comprises a semi-cylindrical personal ornament detachable cylinder part 443 and a cylindrical fixed cylinder part 444 which is preliminarily fixed to other end side 562 of a personal ornament body 24, wherein the semi-cylindrical personal ornament detachable cylinder part 443 and cylindrical fixed cylinder part 444 are connected with each other via a barrel part 442, thereby forming a frame body having the shape of integrally structured eyeglasses.

One space (through part) 445 is formed in the personal ornament detachable cylinder part 443 and it is larger than the diameters of the one end side 561 and outer cap 26 of the personal ornament body 24. As a result, the one end side 561 of the personal ornament body 24 can be freely inserted into or extracted from the cylindrical one end part 443. Meanwhile, other space 446 of the cylindrical fixed cylinder part 444 is smaller than the one space 445 of the personal ornament detachable cylinder part 443 and the diameter of the other space 446 is substantially the same as the outer diameter of the other end side 562 of the personal ornament body 24.

The other end side 562 and outer cap 27 are preliminarily inserted into and fixed to the cylindrical fixed cylinder part 444. That is, according to the retainer 441 of the present embodiment, the other end side 562 and outer cap 27 of the personal ornament body 24 are inserted into and fixed to the other space 446 of the cylindrical fixed cylinder part 444 while the outer cap 26 of the personal ornament body 24 can pass through the one space 445 of the personal ornament detachable cylinder part 443 in a state where it can be inserted into or extracted from the one space 445. Further, three balls, i.e. balls 451, 452, 453 are housed in the personal ornament detachable cylinder part 443 in the peripheral direction thereof at equal intervals.

FIG. 69 is a sectional view taken along a plane orthogonal to an axis of the retainer 441 shown in FIG. 68. As shown in FIG. 69, the diameter of the personal ornament detachable cylinder part 443 is larger than the cylindrical fixed cylinder part 444. Three balls 451, 452, 453 are disposed on the inner peripheral surface of the personal ornament detachable cylinder part 443 in the peripheral direction thereof at equal intervals. The ball 451 is housed in a hole of the personal ornament detachable cylinder part 443 and is pressed toward the inner peripheral side of the personal ornament detachable cylinder part 443 by a spring (compression coil spring) 461 with resiliency. Meanwhile, the diameter of the end part of a hole 448 in the personal ornament detachable cylinder part 443 is smaller than the diameter of the ball 451 so that the ball 441 is not dropped into the inside of the personal ornament detachable cylinder part 443. The holes inside the personal ornament detachable cylinder part 443 are closed at the outer peripheral sides, and the spring (compression coil spring) 461 is housed in the closed space so as to always press the ball 451 toward the inside of the personal ornament detachable cylinder part 443.

Likewise, the ball 452 is housed in a hole 448 of the personal ornament detachable cylinder part 443 and is pressed toward the inner peripheral side of the personal ornament detachable cylinder part 443 by a spring (compression coil spring) 462 with resiliency. Meanwhile, the diameter of the end part of the hole 447 in the personal ornament detachable cylinder part 443 is smaller than the diameter of the ball 452 so that the ball 452 is not dropped into the inside of the personal ornament detachable cylinder part 443. The hole 447 inside the personal ornament detachable cylinder part 443 is closed at the outer peripheral sides, and the spring (compression coil spring) 462 is housed in the closed space so as to always press the ball 452 toward the inside of the personal ornament detachable cylinder part 443.

Further likewise, the ball 453 is housed in a hole 448 of the personal ornament detachable cylinder part 443 and is pressed toward the inner peripheral side of the personal ornament detachable cylinder part 443 by a spring (compression coil spring) 463 with resiliency. Meanwhile, the diameter of the end part of the hole 449 in the personal ornament detachable cylinder part 443 is smaller than the diameter of the ball 453 so that the ball 453 is not dropped into the inside of the personal ornament detachable cylinder part 443. The hole 449 is closed at the outer peripheral side of the personal ornament detachable cylinder part 443, and the spring (compression coil spring) 463 is housed in the closed space so as to always press the ball 453 toward the inside of the personal ornament detachable cylinder part 443.

In the case where one end side of the retainer body is inserted into the personal ornament detachable cylinder part 443 by the balls 451, 452, 453 having such a configuration, the one end side of the personal ornament body 24 can be inserted into the personal ornament detachable cylinder part 443 by an arbitrary length with a resilient force of the springs (compression coil spring) 461, 462, 463.

Meanwhile, the diameter of the cylindrical fixed cylinder part 444 connected to the personal ornament detachable cylinder part 443 via the barrel part 442 is smaller than that of the personal ornament detachable cylinder part 443, and is substantially the same as the outer diameter of the other end side 562 of the personal ornament body 24. The other end side 562 of the personal ornament body 24 is preliminarily inserted into the other space (through part) 446 of the cylindrical fixed cylinder part 444.

As described above, according to the present embodiment, the personal ornament is configured to comprise the personal ornament body formed by inserting a plurality of columnar metallic magnets into a string-shaped tube made of a flexible material and capable of being twisted and bent, wherein N poles and S poles of the respective magnets are alternately arranged on opposite peripheral surface of the columnar magnets, and a retainer fixed to other end side of the personal ornament body and capable of fixing one end of the personal ornament body to the other end side of the personal ornament body in a state where one end side and other end side of the personal ornament body are aligned in parallel with each other.

Accordingly, the other end side 562 of the personal ornament body 24 is inserted into and fitted to the cylindrical fixed cylinder part 444, and when the personal ornament body 24 is used, the one end side 561 of the personal ornament body 24 which is worn around the neck and so forth is inserted into the personal ornament detachable cylinder part 443, so that the personal ornament body 24 can be adjusted as a necklace having a predetermined diameter and worn around the neck.

What is claimed is:

1. A personal ornament comprising:

a string-shaped tube made of a flexible material and capable of being twisted and bent;

a plurality of columnar metallic magnets being inserted into the string-shaped tube along the longitudinal direction thereof and tandemly arranged therein while both ends thereof being opposed to each other in the axial direction; and an outer covering provided on an outer peripheral surface of the string-shaped tube, wherein N poles and S poles of the respective magnets are arranged alternately on opposite peripheral surface of the columnar magnets.

2. The personal ornament according to claim 1 further comprising spacers arranged between the magnets and made of a non-magnetic material.

3. The personal ornament according to claim 1, wherein the magnets are arranged in full range of the tube along the longitudinal direction or in a given range at both ends of the tube.

4. The personal ornament according to claim 2, wherein the magnets and the spacers are arranged alternately by an arbitrary number of one or not less than two.

5. The personal ornament according to claim 1, wherein magnetic force of a part of the magnets is larger than magnetic force of the other part of the magnets.

* * * * *